US011905708B2

(12) United States Patent
Scrafford et al.

(10) Patent No.: US 11,905,708 B2
(45) Date of Patent: Feb. 20, 2024

(54) MODULAR SPACE FRAME SUPPORT SYSTEM, WORK PLATFORM SYSTEM AND METHODS OF ERECTING THE SAME

(71) Applicant: BrandSafway Services, LLC, Atlanta, GA (US)

(72) Inventors: Roy T. Scrafford, Scotia, NY (US); Alana Martalock, Flushing, NY (US); Jerry Dolly, Flushing, NY (US); Paul Jolicoeur, Troy, NY (US); Scott Tomlinson, Flushing, NY (US); Jonathan Burkhart, Flushing, NY (US); Mathieu Grumberg, Delmar, NY (US)

(73) Assignee: BrandSafway Services, LLC, Atlanta, GA (US)

( * ) Notice: Subject to any disclaimer, the term of this patent is extended or adjusted under 35 U.S.C. 154(b) by 0 days.

(21) Appl. No.: 16/962,812

(22) PCT Filed: Jan. 15, 2019

(86) PCT No.: PCT/US2019/013658

§ 371 (c)(1),
(2) Date: Jul. 16, 2020

(87) PCT Pub. No.: WO2019/143615

PCT Pub. Date: Jul. 25, 2019

(65) Prior Publication Data

US 2022/0042304 A1 Feb. 10, 2022

Related U.S. Application Data

(60) Provisional application No. 62/682,644, filed on Jun. 8, 2018, provisional application No. 62/618,067, filed on Jan. 16, 2018.

(51) Int. Cl.
*E04B 5/10* (2006.01)
*E04B 5/14* (2006.01)
(Continued)

(52) U.S. Cl.
CPC ..... *E04B 5/10* (2013.01); *E04B 5/14* (2013.01); *E04C 3/08* (2013.01); *E04C 5/16* (2013.01);
(Continued)

(58) Field of Classification Search
CPC ... E04G 1/15; E04G 1/152; E04B 5/10; E04B 5/14; E04C 3/08; E04C 5/16
See application file for complete search history.

(56) References Cited

U.S. PATENT DOCUMENTS 3,948,012 A 6/1976 Papayoti
4,026,079 A 5/1977 Morris
(Continued)

FOREIGN PATENT DOCUMENTS

DE 102013102492 A1 * 9/2014 ..... E04G 1/15
EP 0 460 004 B1 12/1993
(Continued)

OTHER PUBLICATIONS

International Search Report and Written Opinion for International Application No. PCT/US2019/013658, dated Apr. 12, 2019, 11 pages.
(Continued)

*Primary Examiner* — Christine T Cajilig
(74) *Attorney, Agent, or Firm* — Foley & Lardner LLP

(57) ABSTRACT

A modular space frame support system comprises an upper frame comprising a plurality of joists interconnected with a plurality of interconnection structures; a lower frame comprising a plurality of joists or chords interconnected with a plurality of interconnection structures; at least two intercon-
(Continued)

nection structure brackets, wherein a first of the at least two interconnection structure brackets is connected to one of the plurality of interconnection structures of the upper frame and a second of the at least two interconnection structure brackets is connected to one of the plurality of interconnection structures of the lower frame, each interconnection structure bracket comprising a hollow tubular section, and at least one chord-engaging structure; and at least one chord secured at a first end to the first of the at least two interconnection structure brackets and at a second end to the second of the at least two interconnection structure brackets.

19 Claims, 53 Drawing Sheets

(51) Int. Cl.

| | |
|---|---|
| ***E04C 3/08*** | (2006.01) |
| ***E04C 5/16*** | (2006.01) |
| ***E04G 1/15*** | (2006.01) |
| ***E04C 3/04*** | (2006.01) |
| ***E04G 1/34*** | (2006.01) |
| ***E04G 3/22*** | (2006.01) |
| ***E04G 3/30*** | (2006.01) |
| ***E04G 5/14*** | (2006.01) |
| ***E04G 7/26*** | (2006.01) |

(52) U.S. Cl.
CPC ..... *E04G 1/15* (2013.01); *E04G 1/34* (2013.01); *E04G 3/22* (2013.01); *E04G 3/30* (2013.01); *E04G 5/14* (2013.01); *E04G 7/26* (2013.01); *E04C 2003/0491* (2013.01); *E04C 2003/0495* (2013.01)

(56) References Cited

U.S. PATENT DOCUMENTS

| | | | | |
|---|---|---|---|---|
| 4,211,044 | A | 7/1980 | Gugliotta et al. | |
| 4,483,118 | A | 11/1984 | Betschart | |
| 4,641,477 | A | 2/1987 | Schleck | |
| 4,746,056 | A | 5/1988 | Thomsen | |
| 5,214,899 | A | 6/1993 | Beeche | |
| 5,498,093 | A | 3/1996 | Imai | |
| 6,321,502 | B1 | 11/2001 | Castano | |
| 7,779,599 | B2 * | 8/2010 | Jolicoeur | E04G 1/34 52/651.1 |
| 9,976,264 | B2 * | 5/2018 | Grumberg | E04G 7/28 |
| 10,465,396 | B2 * | 11/2019 | Apostolopoulos | E04G 3/22 |
| 2005/0217936 | A1 * | 10/2005 | Jolicoeur | E04G 1/34 182/130 |
| 2013/0333320 | A1 | 12/2013 | Reynolds et al. | |
| 2014/0230360 | A1 | 8/2014 | Naito | |
| 2014/0262619 | A1 * | 9/2014 | Bains | E04G 7/34 248/351 |
| 2015/0041252 | A1 * | 2/2015 | Grumberg | E04G 5/165 182/222 |
| 2016/0115697 | A1 | 4/2016 | Shaw | |
| 2017/0198484 | A1 | 7/2017 | Grumberg et al. | |

FOREIGN PATENT DOCUMENTS

| | | | | |
|---|---|---|---|---|
| WO | WO-2014184750 | A1 * | 11/2014 | E04G 1/04 |
| WO | 2016059574 | A1 | 4/2016 | |
| WO | 2019143615 | A1 | 7/2019 | |

OTHER PUBLICATIONS

International Search Report and Written Opinion for International Application No. PCT/US2020/042386, dated Oct. 16, 2020, 17 pages.

* cited by examiner

MODULAR SPACE FRAME SUPPORT SYSTEM, WORK PLATFORM SYSTEM AND METHODS OF ERECTING THE SAME

FIELD OF THE DISCLOSURE

This disclosure relates to space frame assemblies which may be used as building components in forming floors, roofs, and walls, or as work platform and access systems such as for construction and maintenance of buildings, bridges and other structures. More particularly, this disclosure relates to a system of modular components which may be assembled to provide space frames which can be readily adapted to a variety of sizes and configurations.

BACKGROUND OF THE INVENTION

There are many applications in the building industry where an easy to assemble and disassemble space frame assembly is desirable. Some examples are temporary floors, walls, and roofs, and the work platform systems employed to perform construction and maintenance tasks on various portions of buildings, bridges and other structures. Space frame assemblies which have been employed in the past have typically been constructed so that the task involved could be performed on one portion of a building or structure at a time.

Work platform systems using modular components have previously been introduced, including, for example, U.S. Pat. No. 5,214,899, which provides a modular space frame utilizing a limited number of interchangeable components to form frame assemblies of various sizes and configurations. Such modular work platforms, however, are labor intensive to assemble. Further, in order to suspend such modular work platform systems, the system must be assembled on the ground and subsequently hoisted into position. Hoisting large and heavy objects is expensive, time consuming, and requires specialized equipment and highly trained personnel. Further still, many such modular work platforms have only a single working platform level with at least one level of just framework and support underneath.

Therefore, in view of the foregoing, it would be advantageous to provide a space frame system, work platform system or other structure that addresses one or more of the above deficiencies or other problems.

SUMMARY

In accordance with at least some embodiments of the present disclosure, it is advantageous to provide a space frame which is usable in a wide variety of applications.

In accordance with at least some embodiments of the present disclosure, it is advantageous to provide a space frame which utilizes a limited number of interchangeable components to form space frame assemblies and work platform systems of various sizes and configurations.

In accordance with at least some embodiments of the present disclosure, it is advantageous to provide a space frame which may be assembled at elevation.

In accordance with at least some embodiments of the present disclosure, it is advantageous to provide a space frame which can utilize more than one level as a work platform.

In accordance with at least some embodiments of the present disclosure, provided herein is a rigidly connected space frame for supporting a load. In accordance with at least some embodiments of the present disclosure, provided herein is a space frame wherein the levels are rigidly connected and one or more of which can be used as a work platform. In accordance with at least some embodiments of the present disclosure, provided herein is a suspended work platform having multiple levels and made from a space frame, wherein the levels are rigidly connected.

In accordance with at least some embodiments of the present disclosure, provided herein is a method of assembling a work platform system comprising:

assembling a first frame comprising a plurality of interconnection structures and a plurality of joists;

at least one of (i) providing at plurality of interconnection structure brackets and attaching at least one interconnection structure bracket to at least two of the plurality of interconnection structures of the first frame and (ii) providing a plurality of vertical supports and connecting a first end of the vertical support a corresponding interconnection structure of the plurality of interconnection structures of the first frame;

assembling a second frame comprising a plurality of interconnection structures and at least one of (i) a plurality of joists and (ii) a plurality of chords; and at least one of (i) providing at plurality of interconnection structure brackets and attaching at least one interconnection structure bracket to at least two of the plurality of interconnection structures of the second frame and (ii) securing a second end of the vertical supports of the plurality of vertical supports to a corresponding interconnection structure of the plurality of interconnection structures of the second frame.

In accordance with at least some embodiments of the present disclosure, provided herein is a modular space frame support system comprising:

an upper frame comprising at least four interconnection structures and at least four joists arranged such that:

- a first interconnection structure connected in fixed relation to a second interconnection structure using a first joist;
- a second joist connectable to the first interconnection structure, wherein, when connected, the second joist is pivotable relative to the first joist from a collapsed position to an extended or final position;
- a third joist connectable to the second interconnection structure, wherein, when connected, the third joist is pivotable relative to the first joist from a collapsed position to an extended or final position;
- a third interconnection structure connected to the second joist;
- a fourth interconnection structure connected to the third joist; and
- a fourth joist connected to the third and fourth interconnection structures, wherein the third and fourth interconnection structures are connected in fixed relation to one another using the fourth joist;

a lower frame comprising at least four interconnection structures and at least one of (i) four joists and (ii) four chords arranged such that:

- a fifth interconnection structure connected in fixed relation to a sixth interconnection structure using a fifth joist or chord;
- a sixth joist or chord connectable to the fifth interconnection structure;
- a seventh joist or chord connectable to the sixth interconnection structure;
- a seventh interconnection structure connected to the sixth joist or chord;
- an eighth interconnection structure connected to the seventh joist or chord; and
- an eighth joist or chord connected to the seventh and eighth interconnection structures;

at least one of a diagonal chord or a vertical support connected at a first end to one of the first, second, third or fourth interconnection structures of the upper frame and at a second end to one of the fifth, sixth, seventh or eighth interconnection structures of the lower frame.

In accordance with at least some embodiments of the present disclosure, provided herein is a method of assembling a modular space frame support system comprising:

providing a first frame comprising at least four interconnection structures and at least four joists, wherein the providing a first frame comprises providing a first interconnection structure, second interconnection structure and first joist, wherein the first joist is connected to and in operable association with the first and second interconnection structures, providing a second joist, a third joist, a third interconnection structure and a fourth interconnection structure, connecting the second joist to the first interconnection structure and the third interconnection structure, connecting the third joist to the second interconnection structure and the fourth interconnection structure, providing a fourth joist, connecting the fourth joist to the third and fourth interconnection structures, and articulating the second joist, third joist, fourth joist, third interconnection structure and fourth interconnection structure with respect to the first joist, first interconnection structure and second interconnection structure from a collapsed position to an extended position, providing a second frame comprising at least four interconnection structures and at least one of (i) four chords and (ii) four joists;

providing at least one of a diagonal chord and a vertical support; and connecting the at least one of the diagonal chord and vertical support to at least one interconnection structure of the first frame and at least one interconnection structure of the second frame.

In accordance with at least some embodiments of the present disclosure, provided herein is a modular space frame support system comprising:

an upper frame comprising a plurality of joists interconnected with a plurality of interconnection structures;

a lower frame comprising a plurality of joists or chords interconnected with a plurality of interconnection structures;

at least two interconnection structure brackets, wherein a first of the at least two interconnection structure brackets is connected to one of the plurality of interconnection structures of the upper frame and a second of the at least two interconnection structure brackets is connected to one of the plurality of interconnection structures of the lower frame, each interconnection structure bracket comprising a hollow tubular section, and at least one chord-engaging structure; and at least one chord secured at a first end to the first of the at least two interconnection structure brackets and at a second end to the second of the at least two interconnection structure brackets.

In accordance with at least some embodiments of the present disclosure, provided herein is a method of assembling a work platform system comprising:

assembling a first frame comprising a plurality of interconnection structures and a plurality of joists;

securing the first frame with one or more suspension connectors;

at least one of (i) providing at plurality of interconnection structure brackets and attaching at least one interconnection structure bracket to at least two of the plurality of interconnection structures of the first frame and (ii) providing a plurality of vertical supports and connecting a first end of the vertical support a corresponding interconnection structure of the plurality of interconnection structures of the first frame;

assembling a second frame comprising a plurality of interconnection structures and at least one of (i) a plurality of joists and (ii) a plurality of chords;

securing the second frame with one or more suspension connectors;

at least one of (i) providing at plurality of interconnection structure brackets and attaching at least one interconnection structure bracket to at least two of the plurality of interconnection structures of the second frame and (ii) securing a second end of the vertical supports of the plurality of vertical supports to a corresponding interconnection structure of the plurality of interconnection structures of the second frame; and removing the one or more suspension connectors securing the first frame.

In accordance with some embodiments of the present disclosure, provided herein is a modular space frame support system.

In accordance with some embodiments of the present disclosure, provided herein is a work platform system.

In accordance with some embodiments of the present disclosure, provided herein is an interconnection structure bracket.

In accordance with some embodiments of the present disclosure, provided herein is a connection between an upper frame and a lower frame of a modular space frame support system.

In accordance with some embodiments of the present disclosure, provided herein is a method of assembling a modular space frame support system.

In accordance with some embodiments of the present disclosure, provided herein is a method of assembling a work platform system.

In accordance with some embodiments of the present disclosure, provided herein is a method of connecting an upper frame of modular space frame support system and a lower frame of a modular space frame support system.

In accordance with some embodiments of the present disclosure, provided herein is a method of assembling a modular space frame support system from an existing work platform system.

In accordance with some embodiments of the present disclosure, provided herein is a chord for a modular space frame support system.

Figure 1:
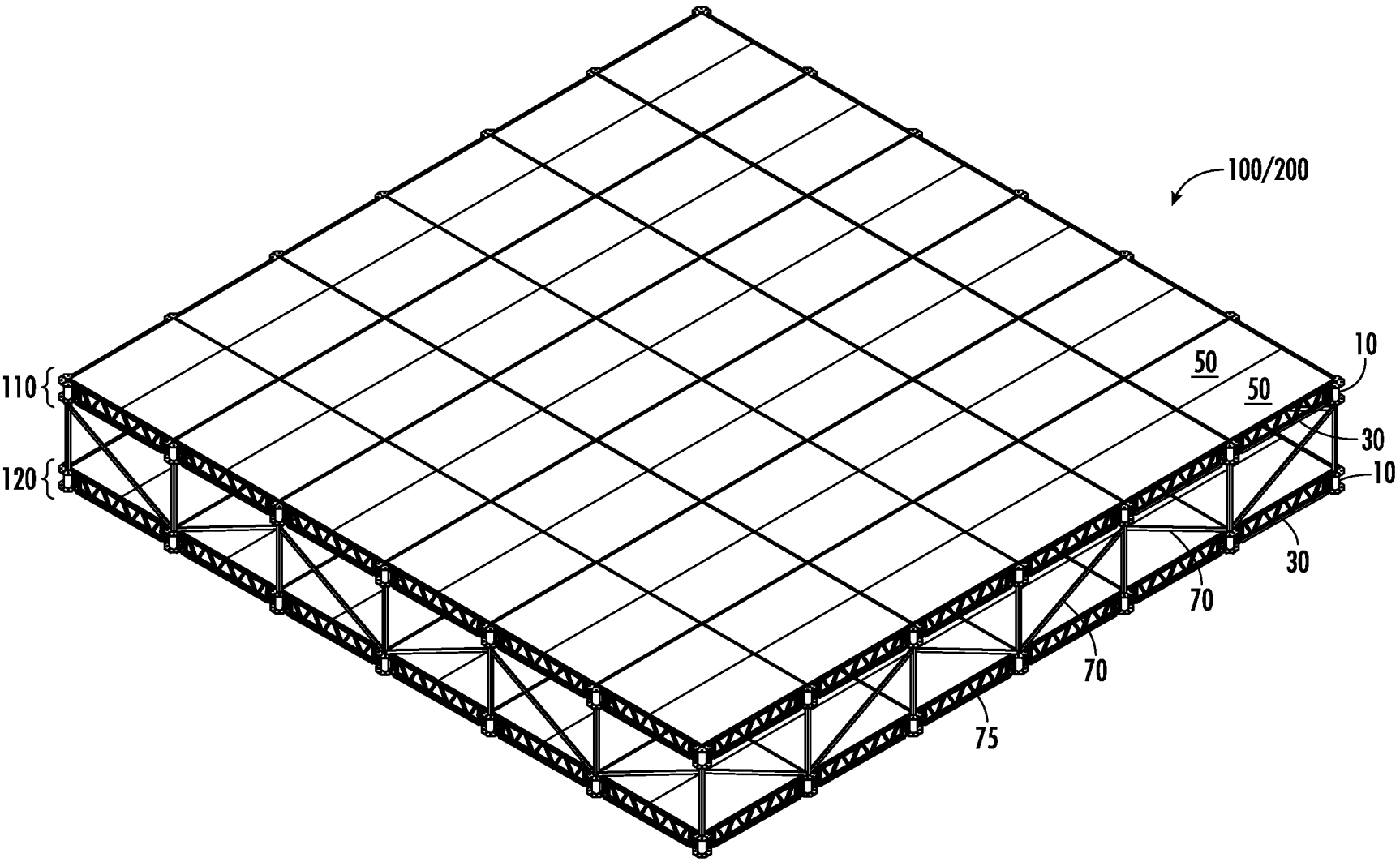
FIG. 1 is an isometric view of an exemplary embodiment of a modular space frame support system forming a work platform system.

Although certain preferred embodiments of the present invention will be shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., and are disclosed simply as an example of an embodiment. The features and advantages of the present invention are illustrated in detail in the accompanying drawings, wherein like reference numerals refer to like elements throughout the drawings.

DETAILED DESCRIPTION

As a preface to the detailed description, it should be noted that, as used in this specification and the appended claims, the singular forms "a", "an" and "the" include plural referents, unless the context clearly dictates otherwise.

Articulation, as used herein, is defined as the capability to swing, and/or rotate, about a pivot point or axis.

As used herein, the term "single section or unit of a modular space frame support system" and related phrases refers to a planar structure composed of at least three interconnection structures 10 and the joists 30 and/or chords 70 which connect the at least three interconnection structures. With respect to a "single section or unit of a modular space frame support system," the terms "section" and/or "unit" can be used interchangeably. Moreover, it will be appreciated that adjacent sections of units of a modular space frame support system may share one or more components, e.g., two adjacent sections of a modular space frame support system may share one or more interconnections structures and one joist or chord.

As used herein, the term "multi-level" and related phrases refers to a structure having two or more distinct sections separated by a vertical distance. Generally, each level of a "multi-level" structure will be approximately horizontal or in a generally horizontal plane.

The term "stress" refers to how much tension or compression a material or structure is subject to.

The term "span" refers to the distance between supports. When used in reference to a multi-level structure in which individual levels are generally horizontal or in a generally horizontal plane, a support is a generally vertically oriented structure between one or more levels of a multi-level structure or between one or more levels of a multi-level structure and an independent structure (e.g., building, bridge, etc.). As used herein, "supports" are generally vertical support members, diagonal chords, and suspension components, e.g., suspension connectors/suspension connector assemblies.

As used herein, the term "section" refers to a physical property of a structure, e.g., an elongated structure such as a beam, joist, chord, etc., which determines how much bending the structure can resist.

FIG. 1 is an exemplary embodiment of a multi-level framework which is a modular space frame support system 100 having an upper frame 110 and a lower frame 120 made of interconnection structures 10, joists 30, chords 70, and vertical support members 75. Work platforms 50 positioned on the upper frame 110 and lower frame 120 create the work platform system 200 using the modular space frame support system 100. The individual components which may be used in a modular space frame support system and related work platform system are described in further detail below.

Interconnection Structure

Figure 2:
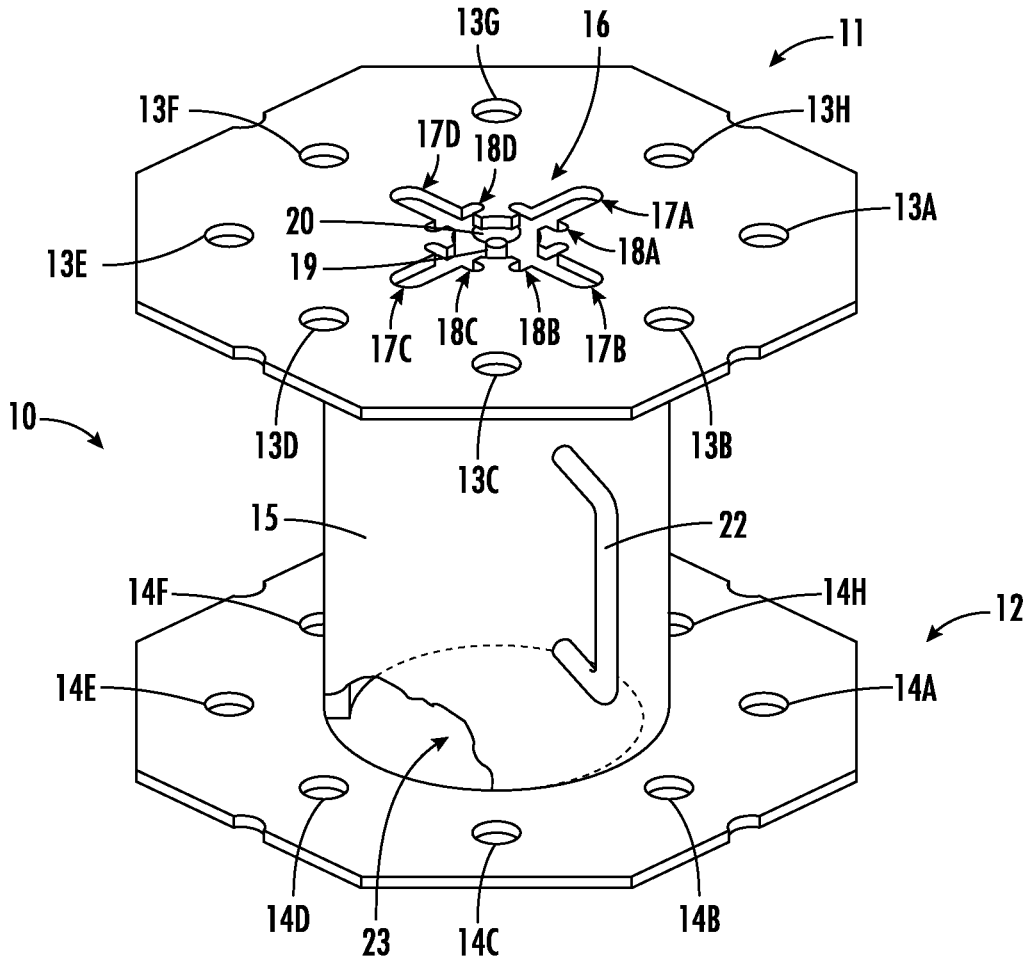
FIG. 2 is top perspective view of an interconnection structure, in accordance with the present disclosure.

FIG. 2 illustrates a portion of a modular space frame support system of the present disclosure, namely an interconnection structure 10. The interconnection structure 10 is configured so that, when attached to a joist 30 (see FIG. 6), allows for articulation of both the interconnection structure 10 and the joist 30. An interconnection structure is any structure which connects one or more joist or other elongated structural member, such as a node, hinge, pivot, post, column, center, shaft, spindle, or the like.

The interconnection structure 10 includes a top element 11 and a bottom element 12 spaced at distal ends of a middle section 15. The top element 11 and bottom element 12 may be substantially planar in configuration, as well as, being parallel to each other. The top element 11 and bottom element 12, in the embodiment shown, are octagonal in plan. In other embodiments, the top element 11 and bottom element 12 can have other shapes, such as square, polygonal, circular, etc.

The middle section 15 may be a cylindrical section wherein a longitudinal axis of the middle section 15 is normal to the planes of the top element 11 and bottom element 12. In the embodiment shown, the middle section 15 is a right circular cylinder. However, in alternative embodiments, the middle section 15 can have different shape, such as any prism having a polygonal face. In FIG. 2, a lower portion of the middle section 15 is removed for clarity purposes to show that the middle section 15 is hollow.

There are a plurality of openings 13, 14, extending through both the top element 11 and bottom element 12, respectively. The plurality of openings 13 (e.g., 13A, 13B, 13C, 13D, 13E, 13F, 13G, 13H) are interspersed on the top element 11 so as to offer various locations for connecting to one, or more, joists 30 (see e.g., FIG. 6). The plurality of openings 14 (e.g., 14A, 14B, 14C, 14D, 14E, 14F, 14G, 14H) are similarly spaced on the bottom element 12 so that respective openings (e.g., 13A and 14A) are coaxial.

At the center of the top element 11 is a center opening 16. In an embodiment, the center opening 16 receives a suspension connector 80 (see e.g., FIGS. 33, 34A, 35A, 35B). In other embodiments, the center opening 16 receives a vertical support member 75 (see e.g., FIG. 23). The center opening 16 may be generally cruciform in configuration due to its center opening area 19 with four slots 17 (e.g., 17A, 17B, 17C, 17D) extending therefrom. Transverse to each of the four slots 17A, 17B, 17C, 17D, and interconnected thereto, are a series of cross slots 18A, 18B, 18C, 18D, whose utility will be apparent as discussed below. For added strength a second reinforcing plate 20 is added to the underside of the top element 11 wherein openings on the reinforcing plate 20 correspond to the center opening 16 configuration and all the ancillary openings thereto (17, 18, 19). A handle 22 is optionally added to the side of the middle section 15.

Figure 3:
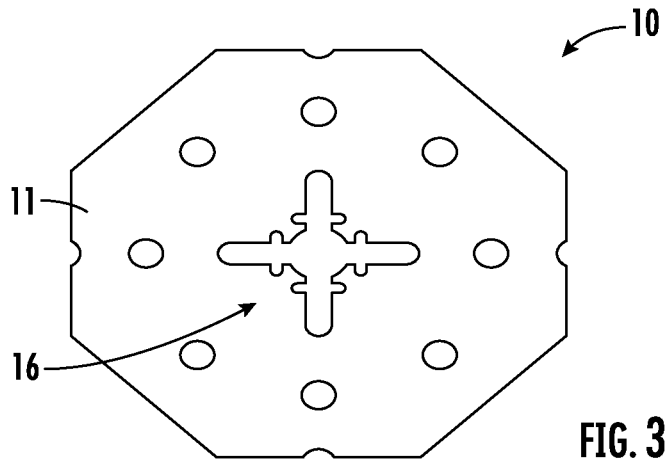
FIG. 3 is top view of an interconnection structure, in accordance with the present disclosure.
Figure 4:
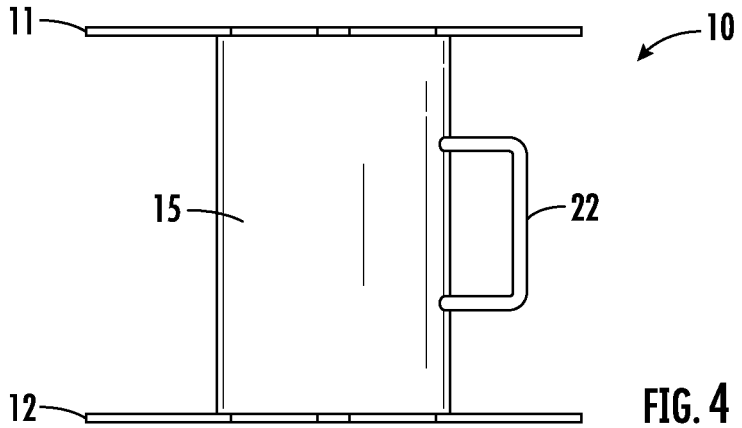
FIG. 4 is a side elevation view of an embodiment of an interconnection structure, in accordance with the present disclosure.
Figure 5:
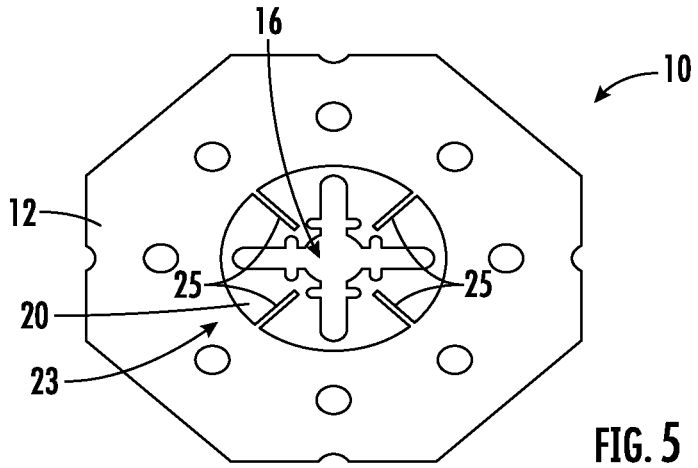
FIG. 5 is bottom view of an interconnection structure, in accordance with the present disclosure.

FIGS. 3, 4, and 5 show the top, side, and bottom view of the same embodiment of the interconnection structure 10 depicted in FIG. 2. FIG. 5 shows inter alia a bottom opening 23 on the bottom element 12. In an embodiment, the bottom opening 23 receives a vertical support member (see e.g., FIG. 23). The bottom face of the reinforcing plate 20 can be seen within the bottom opening 23. Attached to the reinforcing plate 20 and the interior face of the middle section 15 are a plurality of gussets 25 that provide added support to the interconnection structure 10.

Joist

Figure 6:
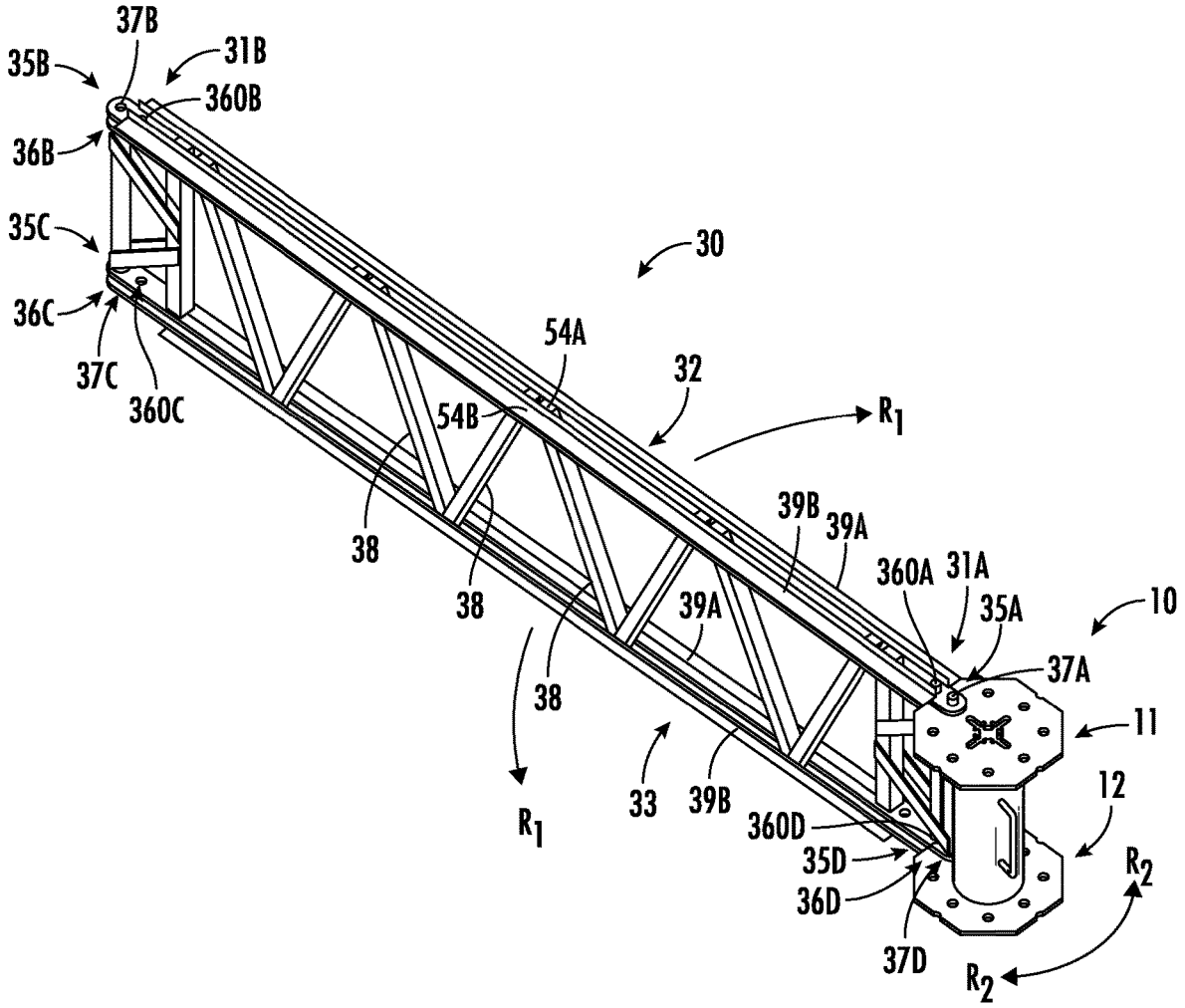
FIG. 6 is a top perspective view of an interconnection structure and joist, in accordance with the present disclosure.
Figure 7B:
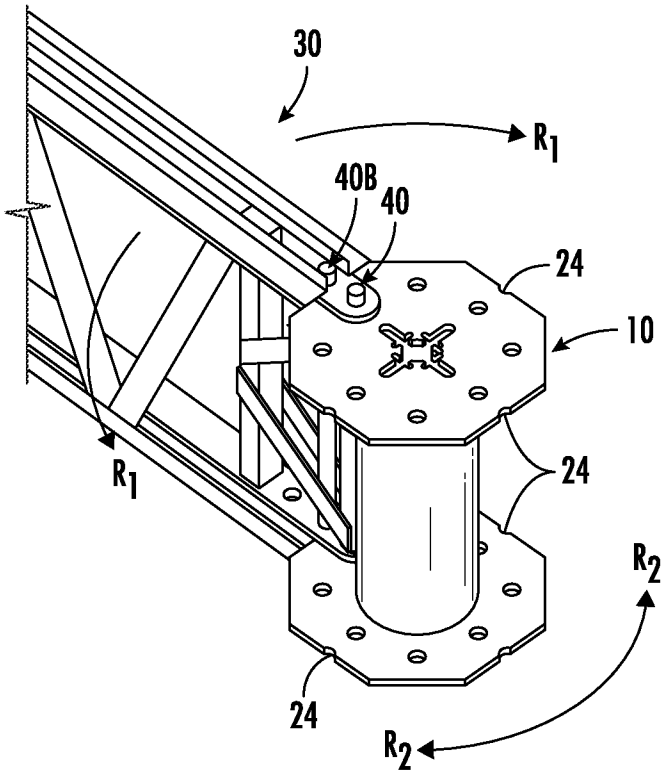
FIG. 7B is a top perspective view of the view in FIG. 6A, in accordance with the present disclosure.
Figure 7A:
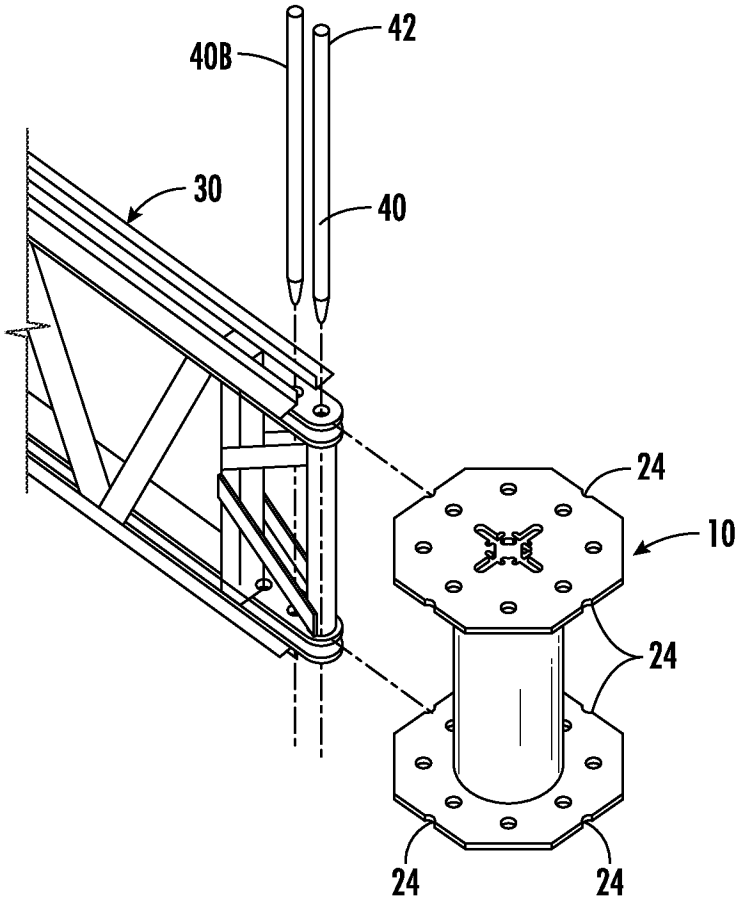
FIG. 7A is an exploded top perspective view of an interconnection between an interconnection structure and joist, in accordance with the present disclosure.

FIG. 6 depicts a top perspective view of the interconnection between a single interconnection structure 10 and a single joist 30, while FIGS. 7A and 7B shows an exploded close-up view, and a regular perspective close-up view, respectively, of a typical connection detail between the interconnection structure 10 and joist 30.

The joist 30 includes an upper element 32 and a bottom element 33. Interspersed between elements 32, 33 are a plurality of diagonal support members 38. Each element 32, 33 is made of two L-shaped pieces of angle iron 39A, 39B. Elements 32, 33 typically may be identical in construction, with the exception being upper element 32 includes connector holes 54A, 54B at its midspan (See e.g., FIGS. 8A, 8B). The joist 30 includes a first end 31A and a second end 31B. At either end 31A, 31B of both the upper element 32 and bottom element 33 extends an upper connecting flange 35 and a lower connecting flange 36. Through both upper and lower connection flanges 35, 36 are connecting holes 37. Thus, there are four upper connecting flanges 35A, 35B, 35C, 35D; four lower connecting flanges 36A, 36B, 36C, 36D. Thus, at a first end 31A, extending from the upper element 32, is an upper connection flange 35A and lower connection flange 36A, with a connecting hole 37A therethrough. Similarly, at the second end 31B of the upper element 32, extends an upper connection flange 35B and lower connection flange 36B, with a connecting hole 37B therethrough. Continuing, at the first end 31A of the lower element 33 extends an upper connection flange 35D and lower connection flange 36D. Through these connection flanges 35D, 36D are a connecting hole 37D. At the second end 31B of the joist 30 extending from the lower element 33 is an upper connection flange 35C and lower connection flange 36C with a connecting hole 37C therethrough.

Interior to each of the connector holes 37A, 37B, 37C, 37D are additional locking holes 360A, 360B, 360C, 360D also located on the connection flanges 35A, 35B, 35C, 35D.

As FIGS. 7A and 7B depict in further clarity, a pin 40 may be placed through the connecting holes 37 any two corresponding top and bottom openings 13, 14 of the interconnection structure 10. In this manner, the joist 30 can be connected in a virtually limitless number of ways, and angles, to the interconnection structure 10. For example, a pin 40 may be placed in through an upper connection flange 35A; through an opening 13A; through a lower connection flange 36A (all of the first end 31A of the upper element 32); through an upper connection flange 35D; through an opening 14A; and, then through the lower connection flange 36D. In this scenario, the pin 40 further threads through connecting holes 37A and 37D. The pin 40 includes two roll pins 42 at its upper end. The lower of the two roll pins 42 acts as a stop, thereby preventing the pin 40 from slipping all the way through the joist 30 and interconnection structure 10. The upper roll pin 42 acts as a finger hold to allow easy purchase and removal of the pin 40 from the joist 30 and interconnection structure 10.

The design of these various parts is such that free rotation of both the joist 30 and interconnection structure 10 is allowed, even while the joist 30 and interconnection structure 10 are connected together. Rotational arrow $R_1$ show the rotation of the joist 30, while rotational arrow $R_2$ shows the rotation of the interconnection structure 10. These rotational capabilities of the joist 30 and interconnection structure 10 provide, in part, the articulating capability of the present invention.

While free rotation of a joist 30 and interconnection structure 10 is allowed, such free rotation is restricted when a section or unit of a modular space frame support system is assembled and ready for use. In an embodiment, free rotation is restricted by at least one of: i) an additional (second) pin that is to be located proximate a perimeter of the at least one interconnection structure; and ii) at least a portion of a work platform when the platform is positioned with respect to the interconnection structures and joists in an extended position.

In the particular embodiment shown, a second optional locking pin 40B may be added through the locking holes 360A, 360C, 360C, 360D at the end of joist 30 in order to lock the joist 30 to prevent articulation, if so desired. The locking pin 40B abuts a groove 24 on the interconnection structure 10. The grooves are situated on both the top element 11 and bottom element 12. Similarly, the locking pin 40B can include additional two roll pins 42 as does the pin 40.

It should be apparent to one skilled in the art that, while the joist 30 depicted in the figures is made of particular shaped elements, there are other embodiments that provide the aspects of the present invention. A joist is any elongate structural member adapted for bearing or supporting a load, such as a bar joist, truss, shaped-steel (i.e., I-beam, C-beam, etc.), or the like. For example, the joist 30 in the figures may commonly be called a bar joist, or open-web beam or joist. The joist 30 could also be made of shaped steel (e.g., wide flange elements, narrow flange members, etc.), or other suitable shapes and materials.

The assembly of interconnection structures 10 and joists 30 to form a section or unit 115 of a modular space frame support system 100 is discussed in further detail below.

Figure 8:
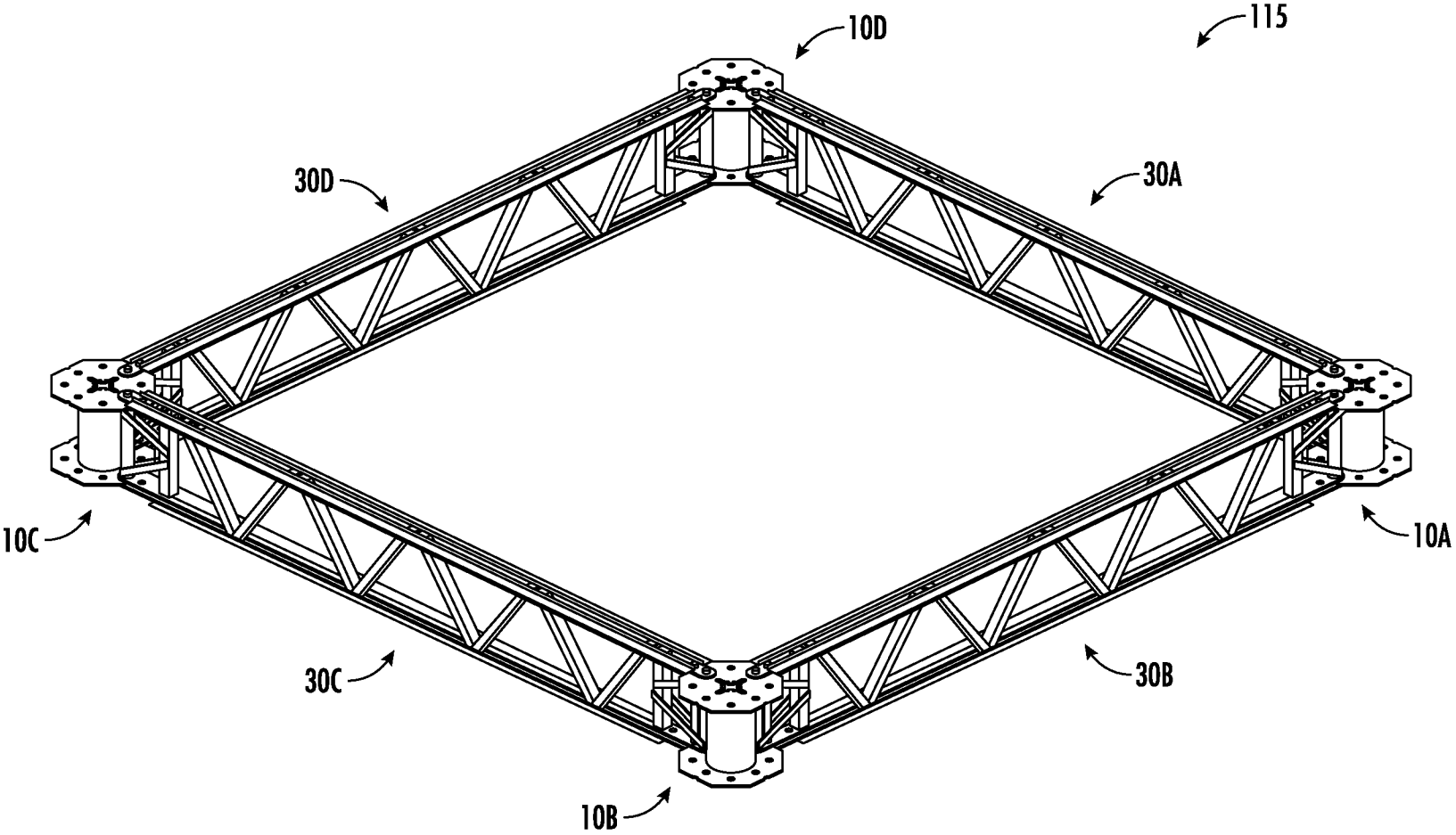
FIG. 8 is a top perspective view of a single unit of a modular space frame support system, in accordance with embodiments of the present disclosure.

FIG. 8 depicts a single section or unit 115 of a modular space frame support system 100 made using interconnection structures 10 and joists 30. Note that four interconnection structures 10A, 10B, 10C, 10D are interconnected with four joists 30A, 30B, 30C, 30D. FIG. 8 shows the single frame unit 115 that is square in plan. It should be apparent to one skilled in the art, that other shapes and configurations can be made. By varying the lengths of joists 30, for example, other shapes can be made. For example, a frame unit 115 that is rectangular can be constructed. Also, by attaching joists 30 to various openings 13, 14 of the interconnection structure 10, various angles at which the joists 30 interconnect with the interconnection structure 10 can be achieved. For example, a frame unit 115 that is triangular in plan (not shown) may be constructed. Thus, by changing joist 30 lengths (See e.g., FIGS. 12A-12D) and/or changing the angle(s) at which the joists 30 extend from the interconnection structure 10, virtually any shape and size frame unit 115, and resulting modular space frame support system 100 and work platform systems 200 may be constructed. Further, different shape, size, and configuration of frame sections or units 115 can be joined and abutted with each other, so that the modular space frame support system design, and work platform system design, is virtually completely customizable. This adaptability of the modular space frame support system 100 provides a convenient way to gain access to virtually any shape work area required in construction.

Figure 9A:
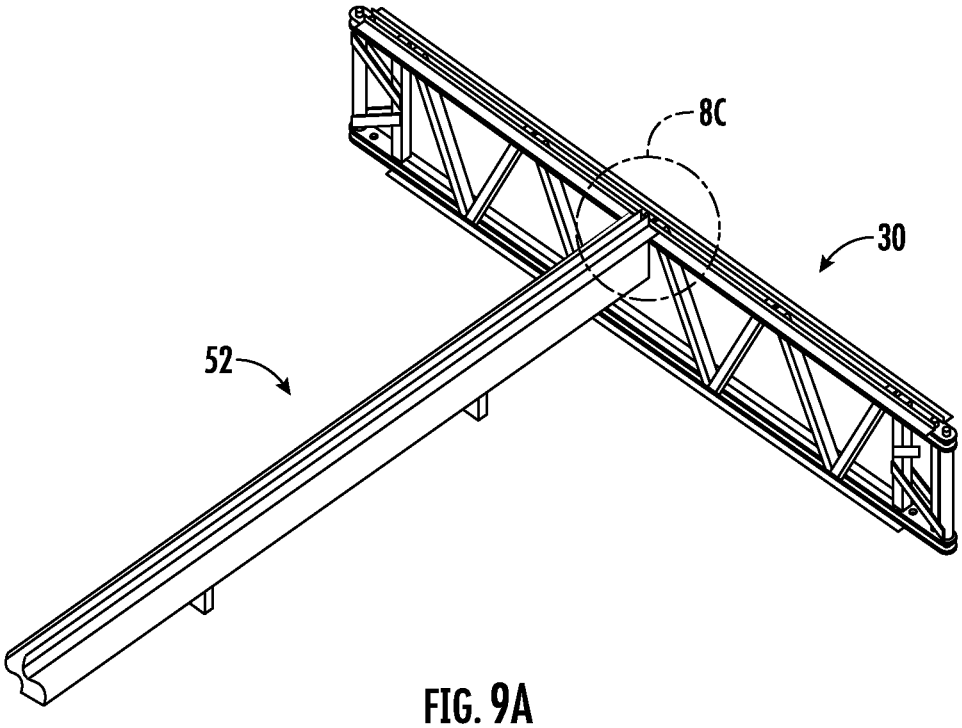
FIG. 9A is a top perspective view of an interconnection between a joist and deck support, in accordance with embodiments of the present disclosure.
Figure 9B:
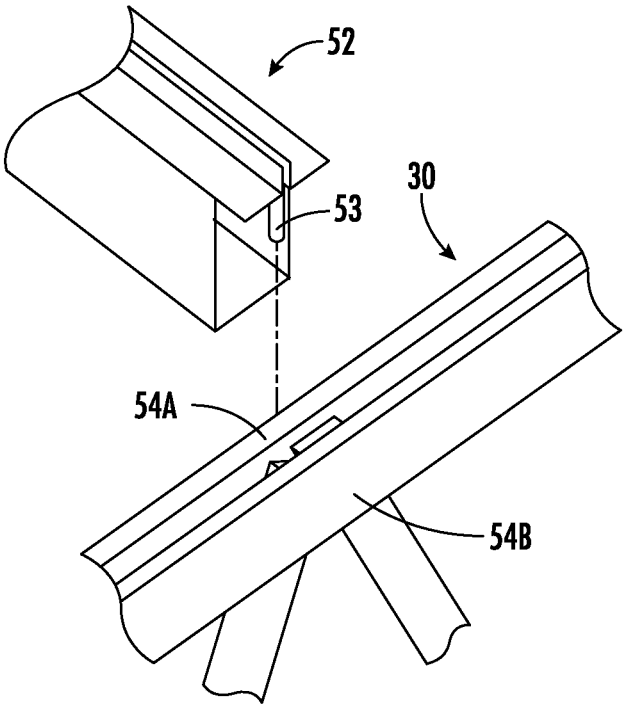
FIG. 9B is a exploded reverse top perspective view of an interconnection between a joist and deck support, in accordance with embodiments of the present disclosure.
Figure 9C:
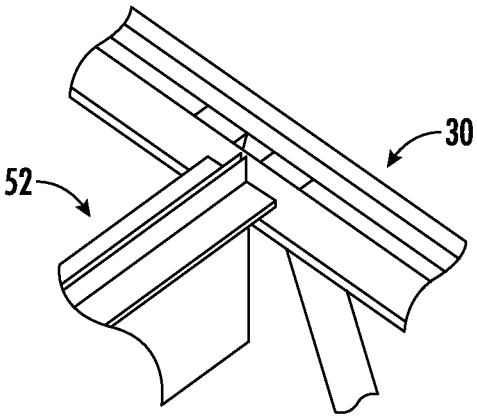
FIG. 9C is a close-up top perspective view of an interconnection between a joist and deck support, in accordance with embodiments of the present disclosure.

FIGS. 9A, 9B, and 9C depict various views, and close-up views of the interconnection between a middle support deck joist 52 and the joist 30. The middle support deck joist 52 provides added support to support platforms 50 (see e.g., FIG. 10) and may span between two joists 30. At either end of the middle support deck joist 52 is a pin 53 which communicates with a corresponding hole 54 on the upper portion of the joist 30. For example, FIG. 9B depicts an exploded view of the interconnection, wherein pin 53 will go in hole 54A. In this manner, movement (both lateral and axial) of the middle support deck joist 52 is minimized.

Figure 10:
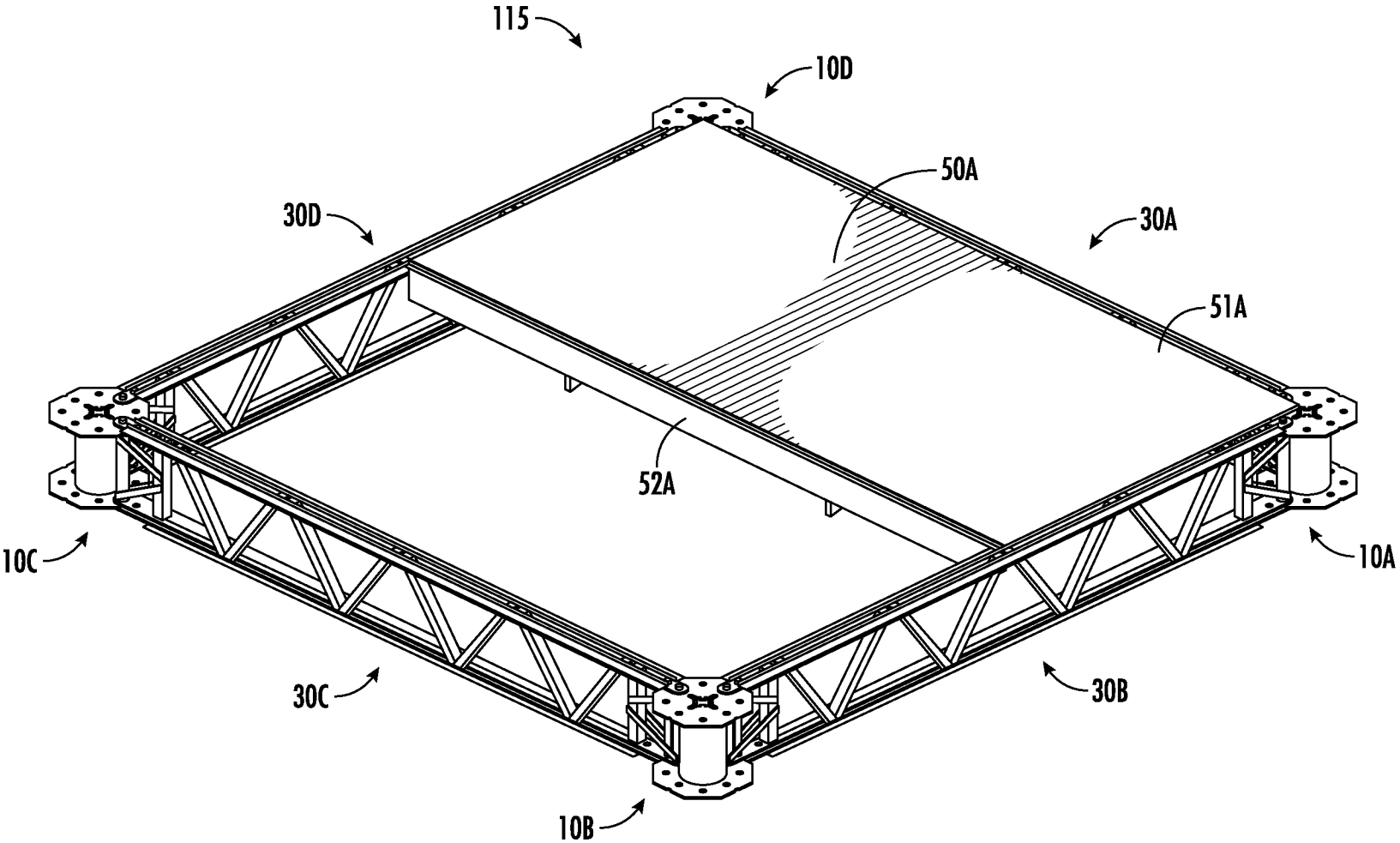
FIG. 10 is a top perspective view of a single unit of a modular space frame support system configured for use as a single unit of a work platform system, in accordance with embodiments of the present disclosure.
Figure 11:
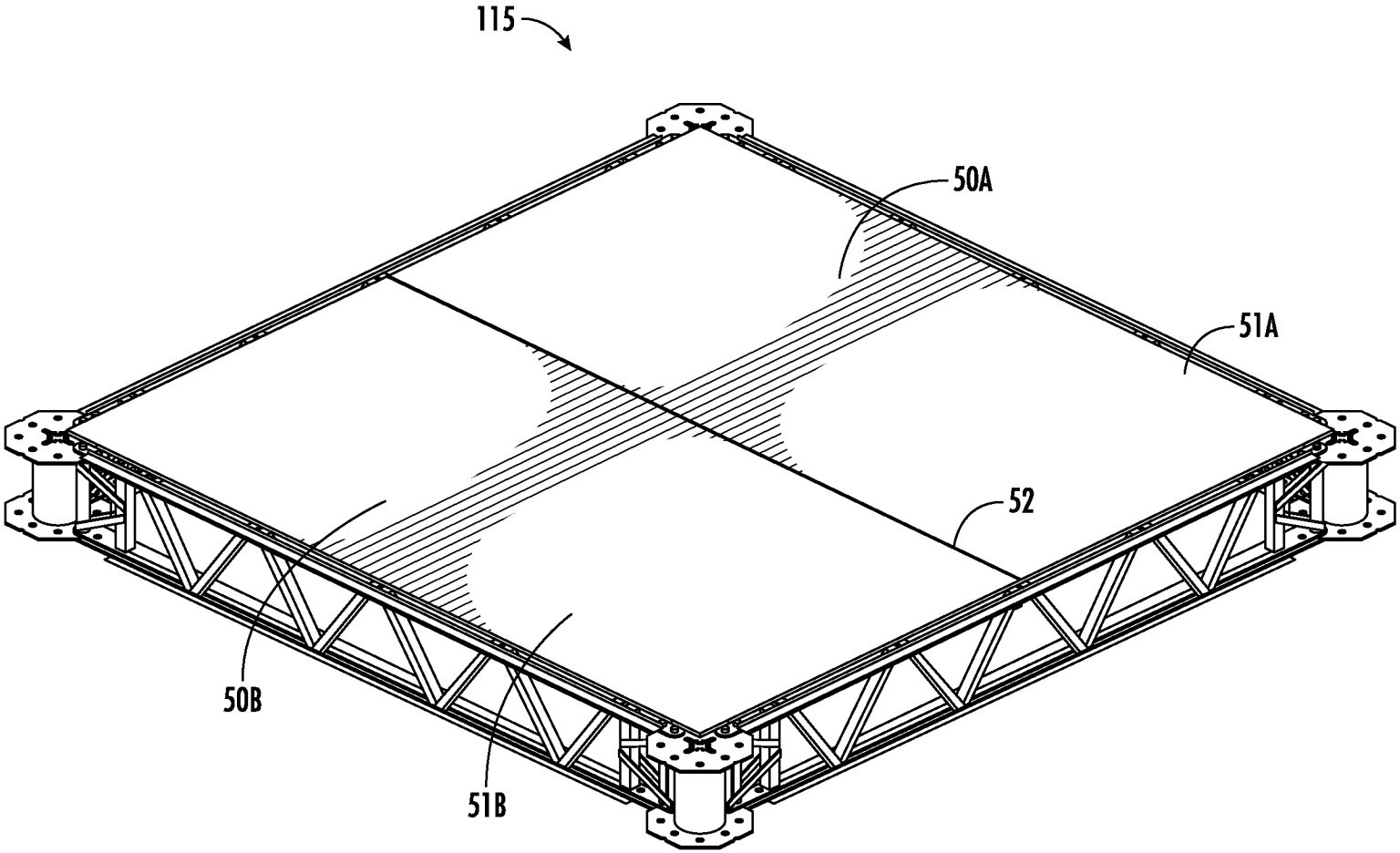
FIG. 11 is a top perspective view of a second embodiment of a single units of a modular space frame support system configured for use as a single unit of a work platform system, in accordance with embodiments of the present disclosure.

FIG. 10 shows the embodiment of single frame section or unit 115 from FIG. 8 wherein a platform 50A has been placed on the single frame unit 115 thus transforming the single frame unit 115 into a single unit of a work platform system 200. The platform 50A rests, in this embodiment, on the middle support deck joist 52A and on the joists 30A, 30B, 30D. The edges of the platform 50A may rest on the top of the middle support deck joist 52 and the angle iron 39A, 39B on the top of the applicable joists 30A, 30B, 30D. The configuration of the top of the middle support deck joist 52 and the angle iron 39A, 39B is such that vertical and horizontal movement of the platform 50A is avoided. The work platform 50 typically is sized to be a 4"×8' piece of material. The work platform 50A may include a wood panel 51A, for example. Suitable work platform 50 may be made from metal (e.g., steel, aluminum, etc.), wood, plastic, composite, or other suitable materials. Similarly, the work platform 50 may be made of items that are solid, corrugated, grated, smooth, or other suitable configurations. For example, the work platform 50 may be wood sheeting, plywood, roof decking material, metal on a frame, grating, steel sheeting, and the like. Thus, after placing a first work platform 50A on the unit 115 of the modular space frame support system 100, an installer may continue in this manner and place additional multiple work platforms 50A, 50B, such as shown in FIG. 11, so that an entire upper frame 110 and/or lower frame 120 is covered with wood platforms 51A, 51B so that a complete work platform system 200 is created.

Figure 12A:
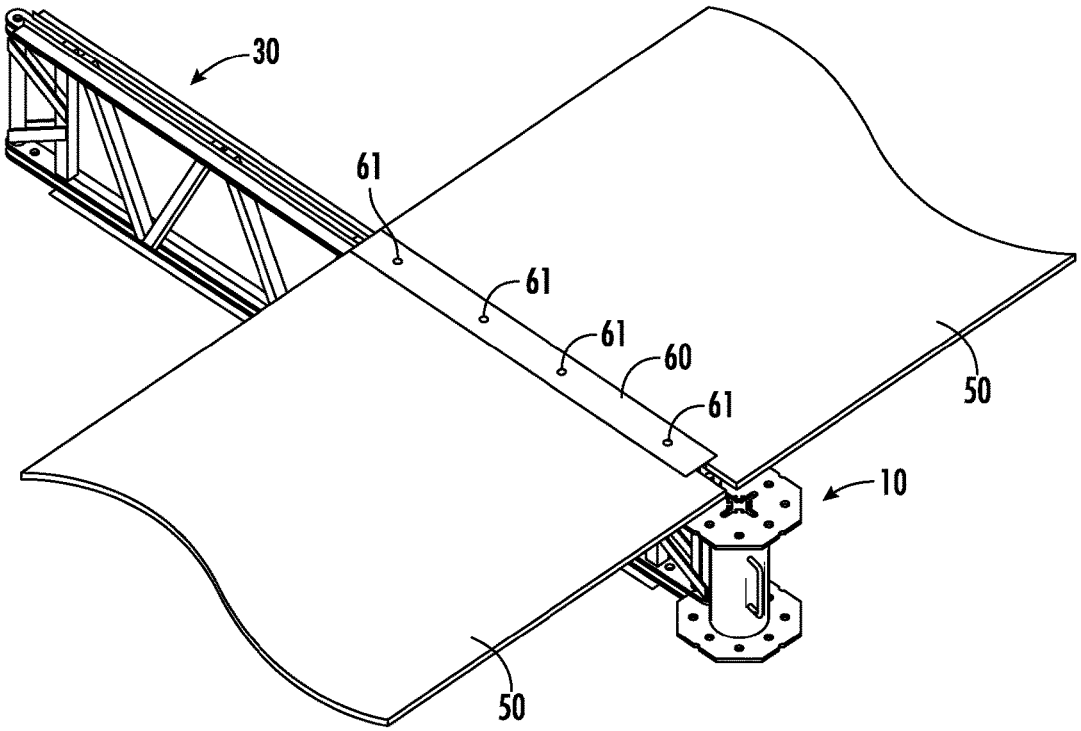
FIG. 12A is a top perspective view of a joist, interconnection structure, and portion of a deck retainer assembly, in accordance with embodiments of the present disclosure.
Figure 12B:
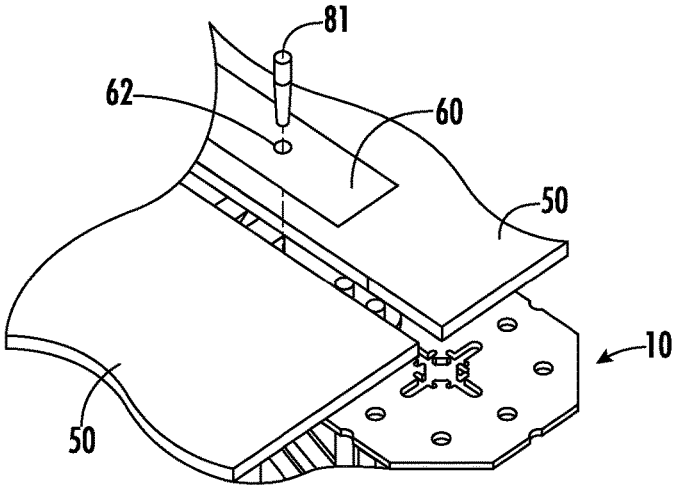
FIG. 12B is an exploded close-up perspective view of a joist, interconnection structure, and portion of a deck retainer assembly, in accordance with embodiments of the present disclosure.
Figure 12C:
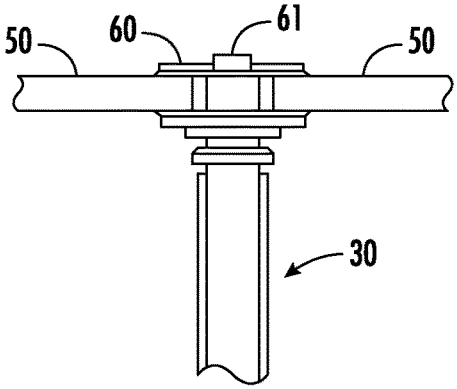
FIG. 12C is an end sectional view of a joist and a portion of a deck retainer assembly, in accordance with embodiments of the present disclosure.

FIGS. 12A, 12B, and 12C show various close-up views of an additional, optional feature that can be used with a modular space frame support system 100 to form a work platform system 200. A deck retainer plate 60 may be placed over the spacing between the multiple work platforms 50. The deck retainer plate 60 may include a plurality of holes 62 so that a plurality of deck retainer bolts 61 may adhere the deck retainer plate 60 to the joist 30. The deck retainer plate 60 is one way in which to secure work platforms 50 to the modular space frame support system 100.

Figure 13:
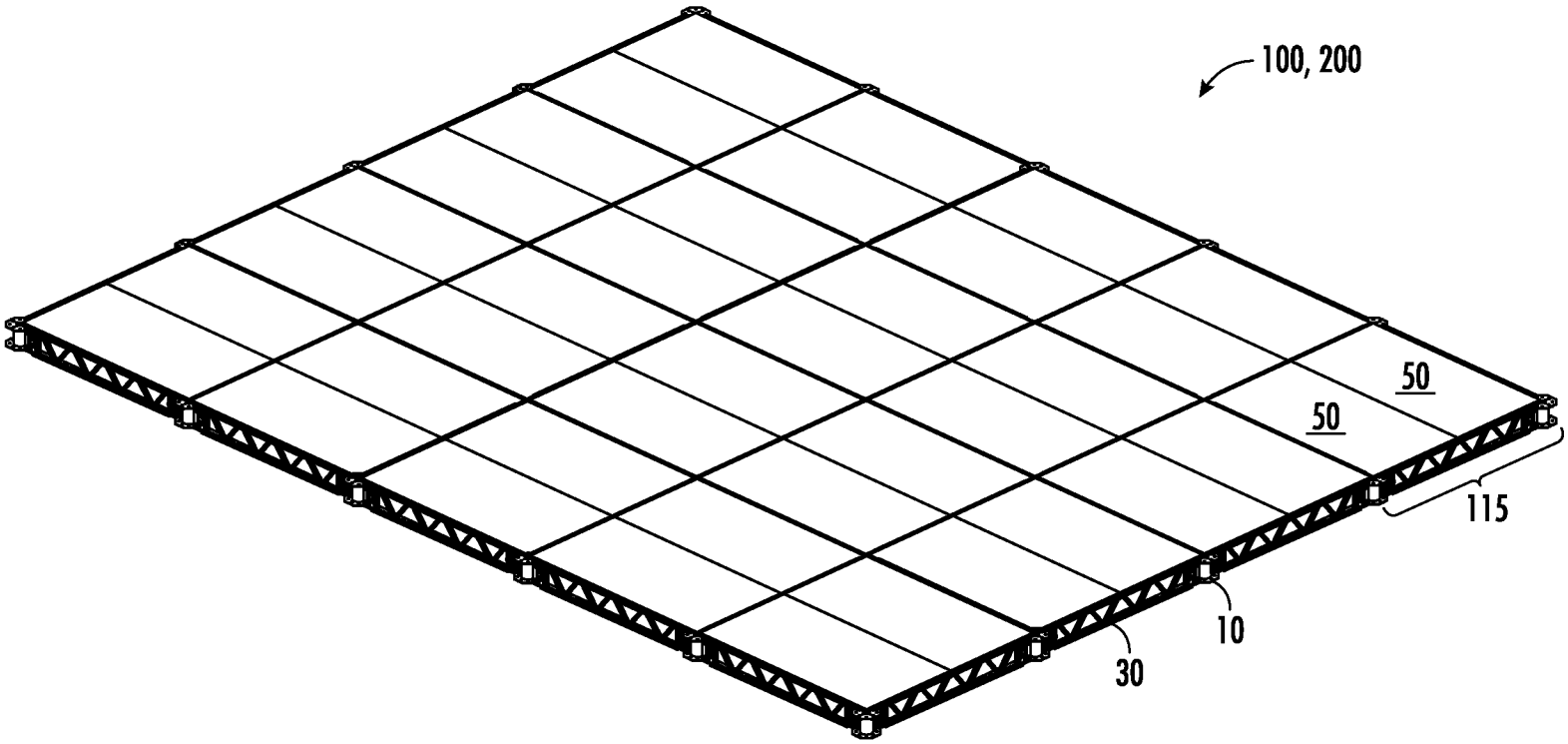
FIG. 13 is a top perspective view of an embodiment of a single level of a modular space frame support system forming a single level of a work platform system, in accordance with embodiments of the present disclosure.
Figure 14:
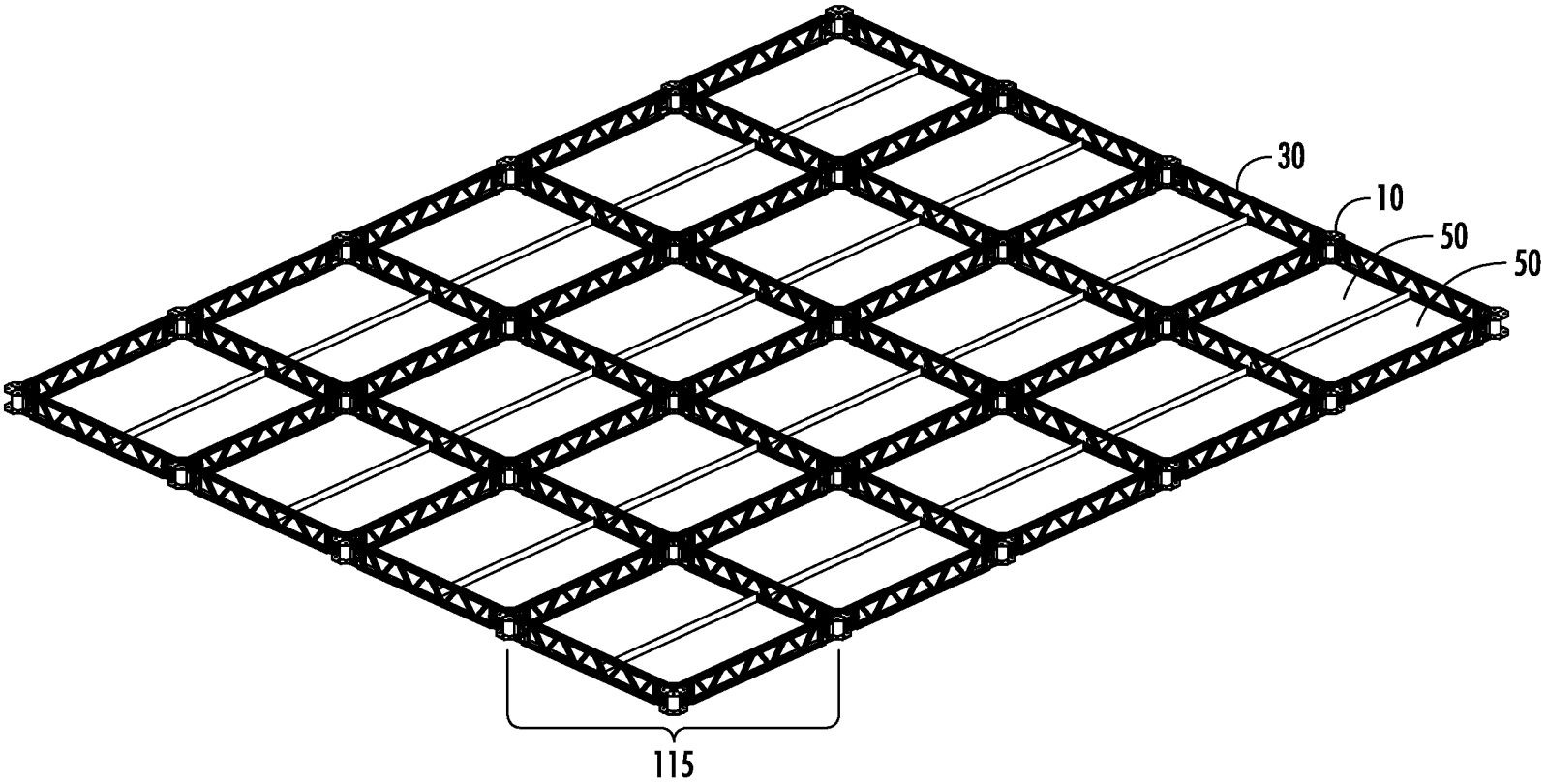
FIG. 14 is a bottom perspective view of the embodiment shown in FIG. 13, in accordance with embodiments of the present disclosure.

As FIGS. 13 and 14 depict, there is virtually no limit as to the size and shape of the modular space frame support system 100 and work platform system 200 that can be made in accordance with the present disclosure. FIGS. 13 and 14 show top and bottom perspective views, respectively, of one large rectangular embodiment of a single level of modular space frame support system 100 with work platforms 50 in place to make a work platform system 200.

As stated above, one deficiency of numerous existing work platforms are their inability to be installed in situ and also their inability to be relocated, extended, or removed, while a portion of the work platform is already installed in place. The present disclosure overcomes this deficiency. That is, the modular space frame support system and resulting work platform system allows for a worker, or workers, to add on additional sections of a modular space frame support system 100 (and, ultimately, work platform system 200) while this worker(s) is physically on an existing, installed portion or unit of a modular space frame support system and/or work platform system. That is the worker(s) can extend, relocate, or remove a portion of a work platform system 200 and/or modular space frame support system 100 with only the need of hand tools. No mechanical tools, hoists, cranes, or other equipment is required to add to, subtract from, or relocate the modular space frame support system 100. This advantage, thus, offers savings in labor, time, and equipment.

For as FIGS. 15 through 19 depict the gradual articulation of just one section or unit of a single section or unit 115 of a modular space frame support system 100, when made using interconnection structures 10 and joists 30, into place. This can be readily accomplished by one, or two, workers by simply placing sequentially an additional joist 30D off of an existing interconnection structure 10A. Then a "new" interconnection structure 10D is connected to the first joist 30D. A second additional joist 30E is connected to the interconnection structure 30D. Further, another interconnection structure 10E and joist 30F are connected so that the final joist 30F is connected back to an existing interconnection structure 10B. In this manner, a worker(s) can install a new section or unit of a modular space frame support system (e.g., made up of "new" interconnection structures 10D, 10E and "new" joists 30D, 30E, 30F) off of an existing section of a modular space frame support system (e.g., made up of inter alia hubs 10Q, 10B, 10C and joists 30A, 30B). The worker(s) can install new, or relocate, sections or units of the modular space frame support system 100 while the worker remains on existing sections of work platform 50. That is, additional lift equipment, machinery is not required to install, relocate, or remove the additional units or sections of a modular space frame support system when made using interconnection structures 10 and joists 30.

Figure 15:
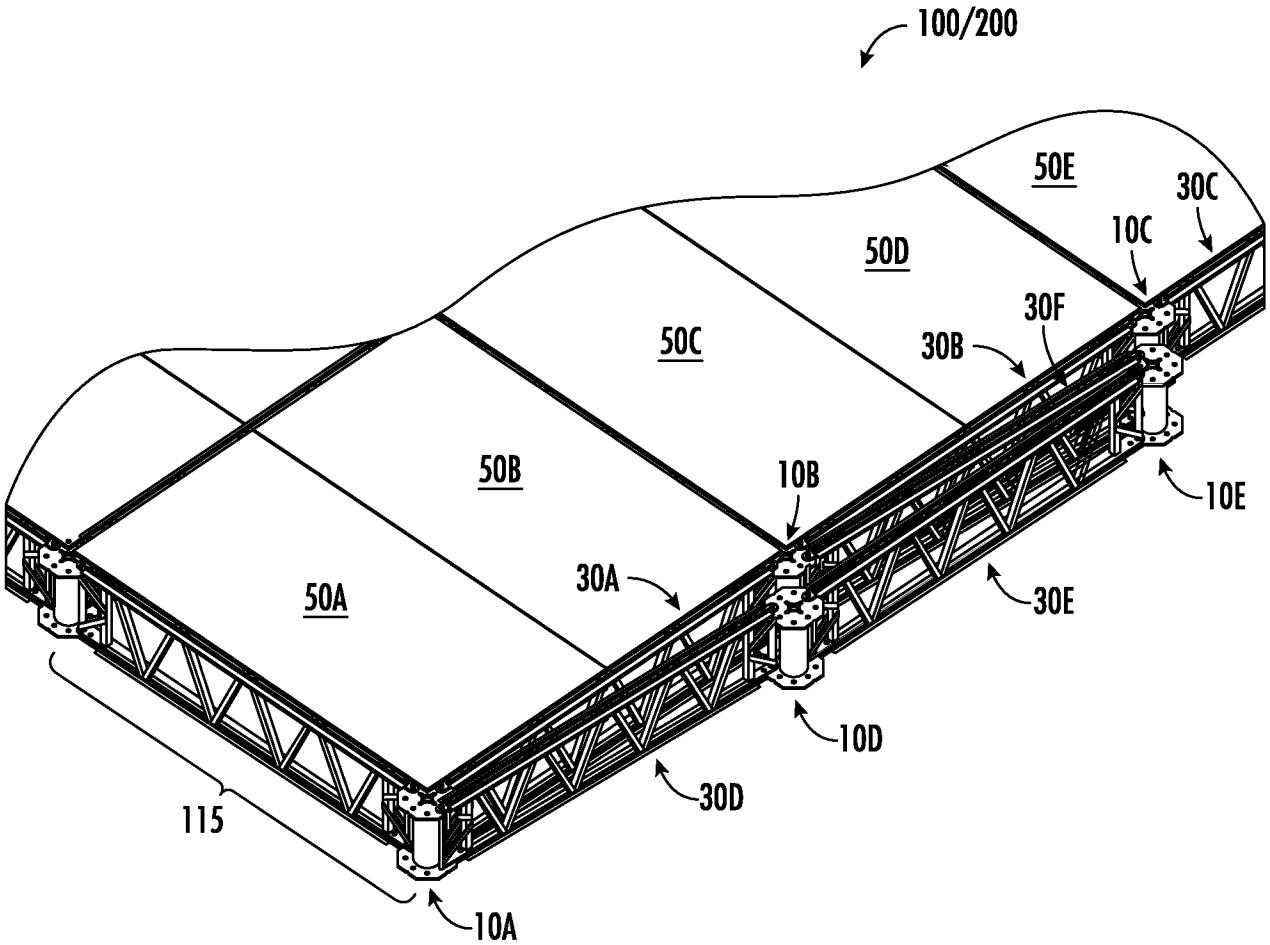
FIG. 15 is a top perspective view of a single level of a modular space frame support system configured for use as a work platform system, having a single unit of the modular space frame support system shown prior to articulation, in accordance with embodiments of the present disclosure.

Further, the installing worker(s) need not extend beyond the existing installed frame unit 115 or, they need only extend barely beyond the installed frame unit 115. For example, as shown in FIG. 15, the installer(s) can be on the existing work platforms 50A, 50B, 50C, 50D when relocating, or installing, the next section(s) of the modular space frame support system 100.

Figure 16:
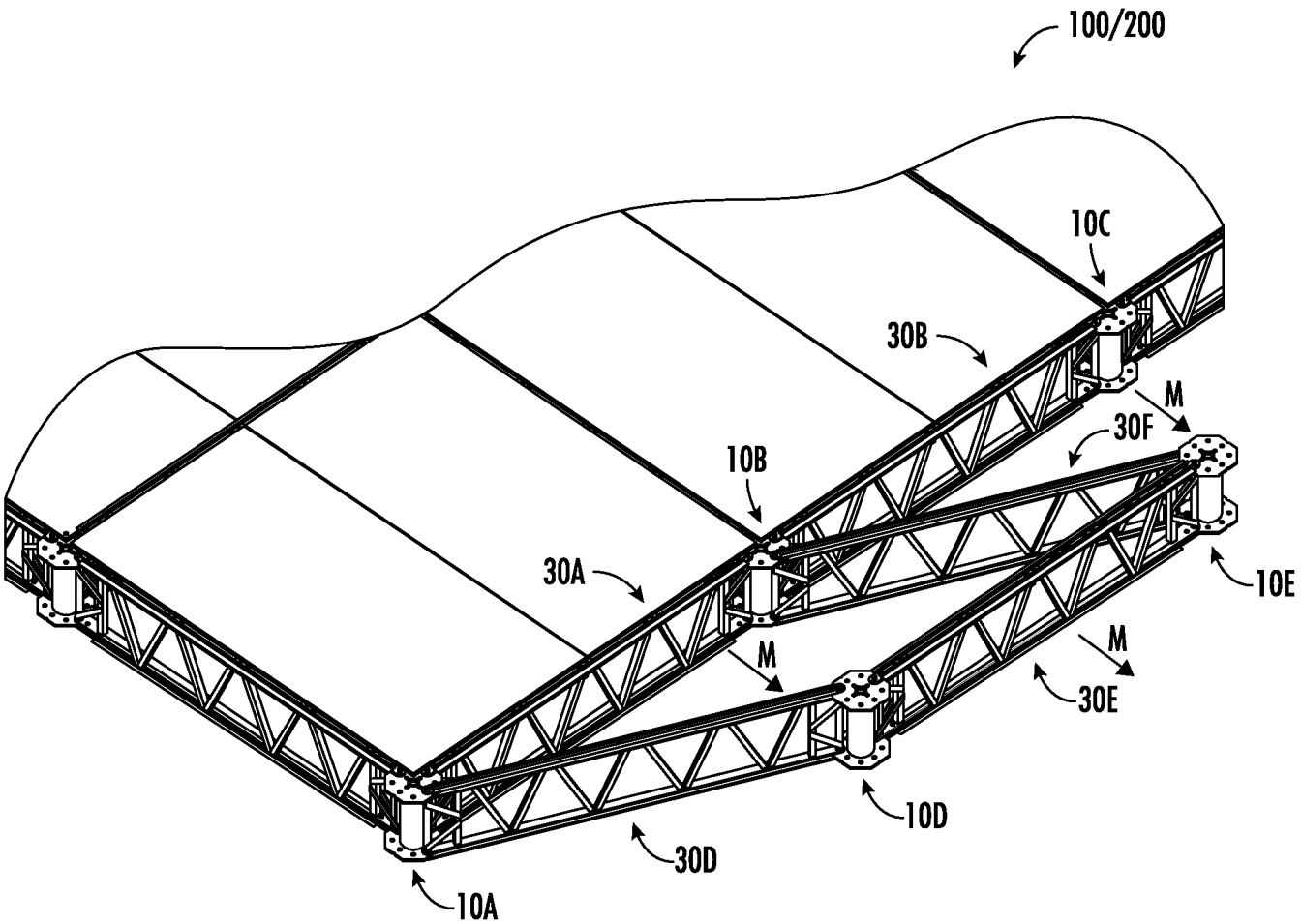
FIG. 16 is a top perspective view of the embodiment in FIG. 15 with the single unit undergoing articulation, in accordance with embodiments of the present disclosure.
Figure 17:
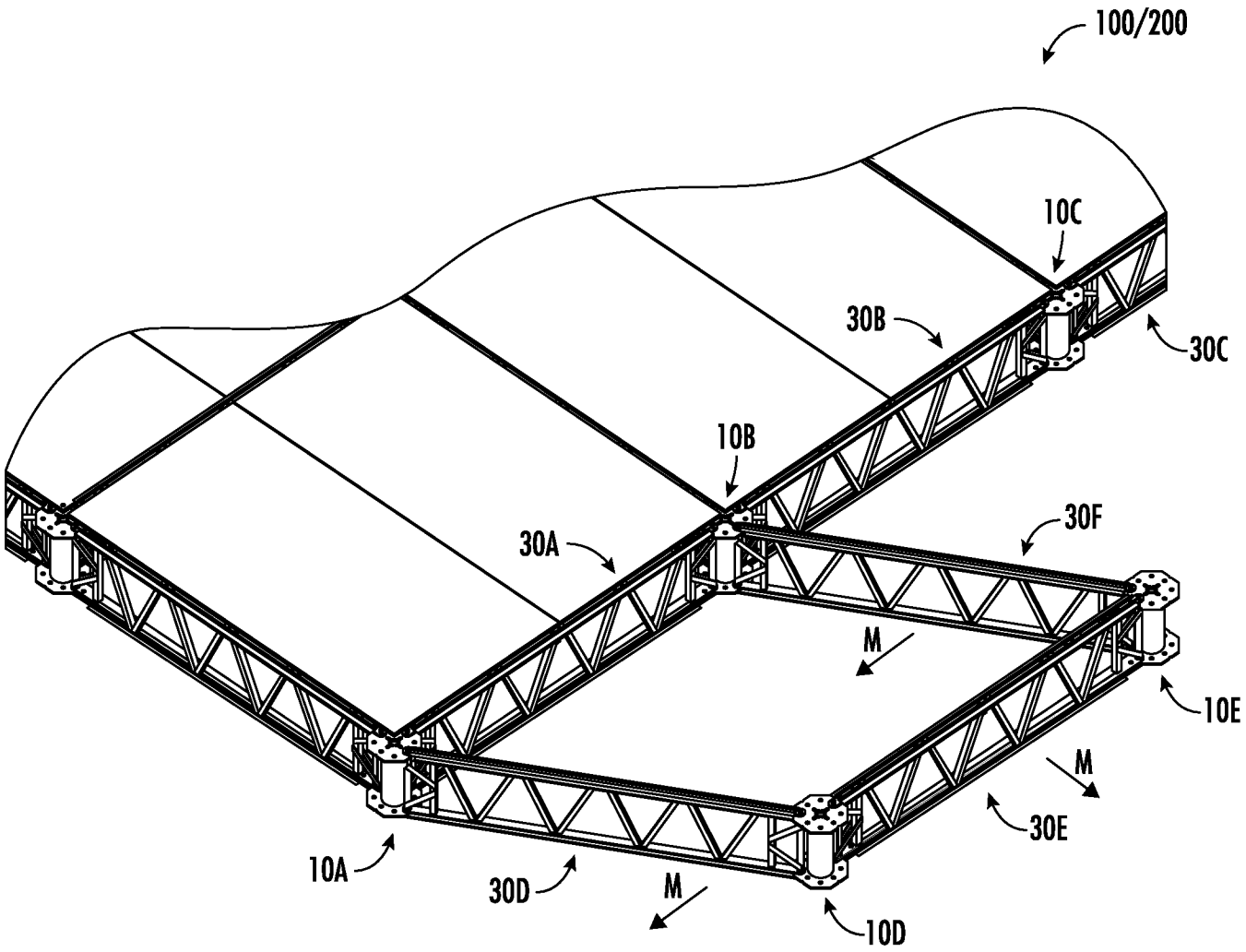
FIG. 17 is a top perspective view of the embodiment in FIG. 16 with the single unit undergoing further articulation, in accordance with embodiments of the present disclosure.
Figure 18:
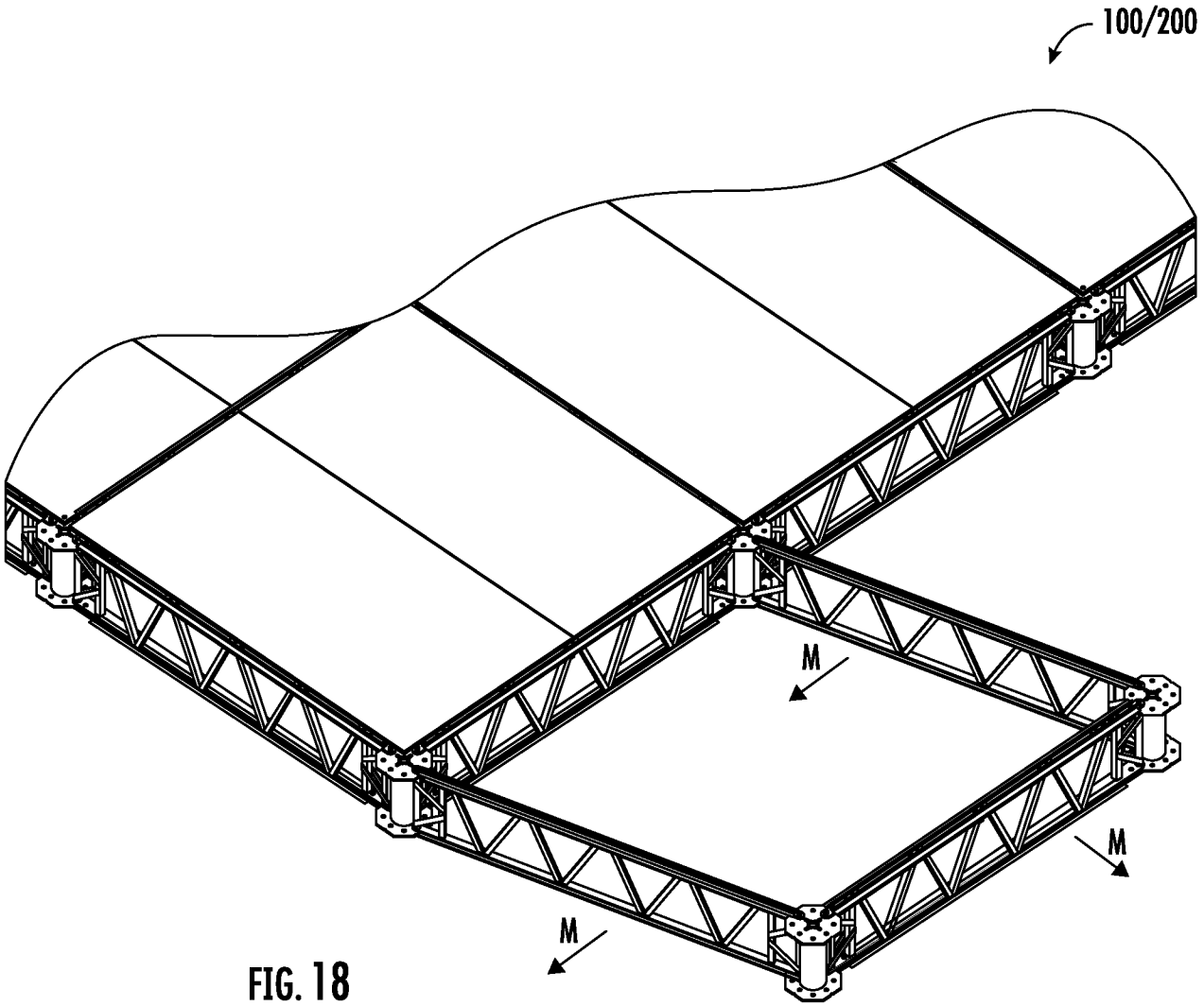
FIG. 18 is a top perspective view of the embodiment in FIG. 17 with the single unit undergoing further articulation, in accordance with embodiments of the present disclosure.

As FIGS. 16 through 18 clearly show via the motion arrows "M", that by a combination of rotation of the new joists 30D, 30E, 30F and new interconnection structures 10D, 10E, that the new section or unit 115 of the modular space frame support system 100 is able to move and rotate into its final requisite location. That is, units of the modular space frame support system 100 articulate into place. Further, the articulation can be initiated and stopped (and even reversed) by an installer(s) while the installer(s) remains on the pre-existing frame units and/or work platform systems. Although not shown, additional supplemental devices to aid in the articulation (e.g., motors, hand tools, mechanical tools, hydraulics, etc.) can be used.

Figure 19:
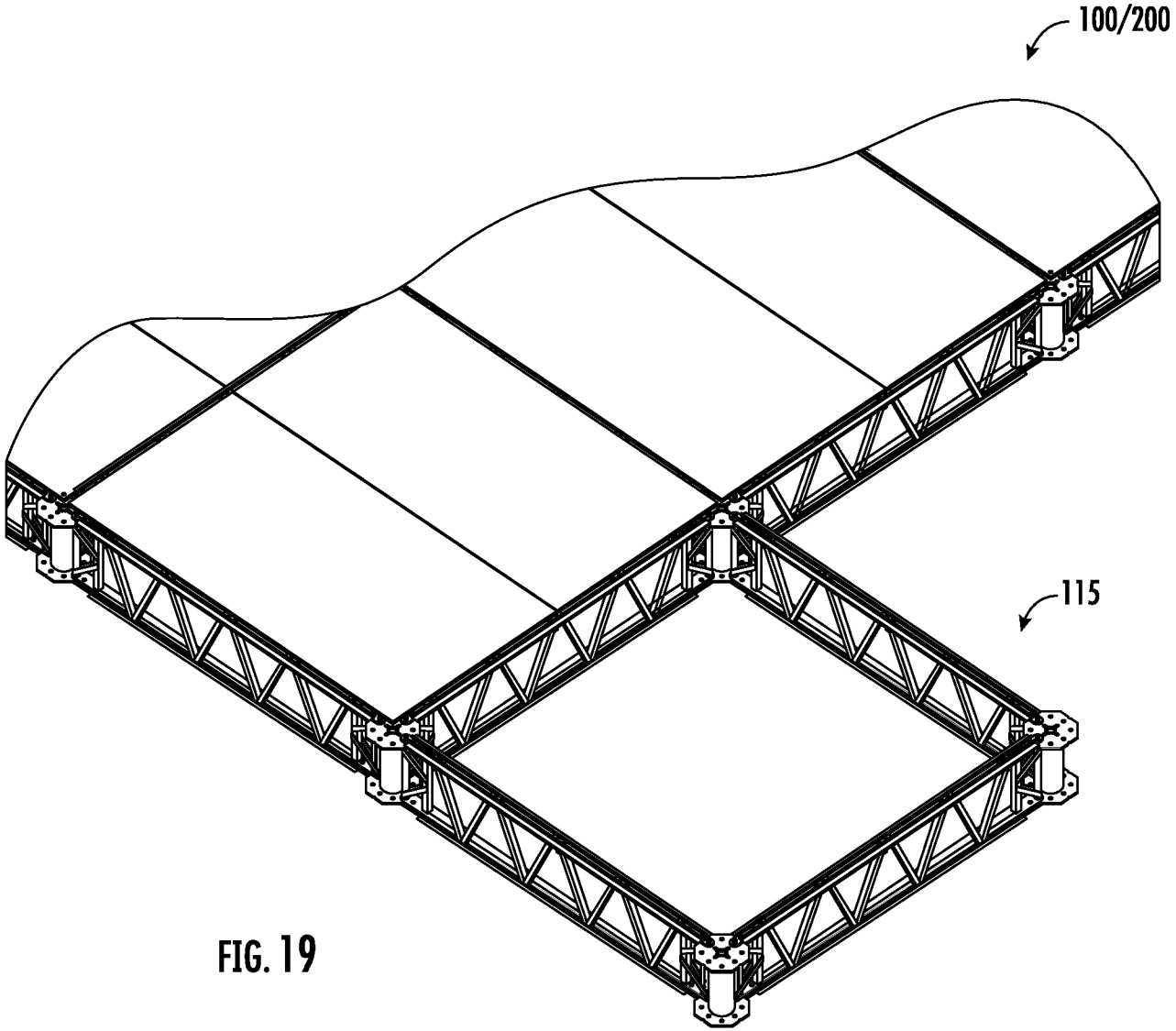
FIG. 19 is a top perspective view of the embodiment in FIG. 15 with the single unit having completed articulation, in accordance with embodiments of the present disclosure.

FIG. 19 shows a new section or units 115 of a modular space frame support system 100 articulated into place, prior to the installation of support platform(s) 50 and other pieces, as discussed supra (See e.g., FIGS. 16A, 16B, 16C, 17, 18, 19A, 19B, 19C, 20). The removal of a portion of the modular space frame support system 100 can essentially be done by reversing the aforementioned steps.

Figure 20A:
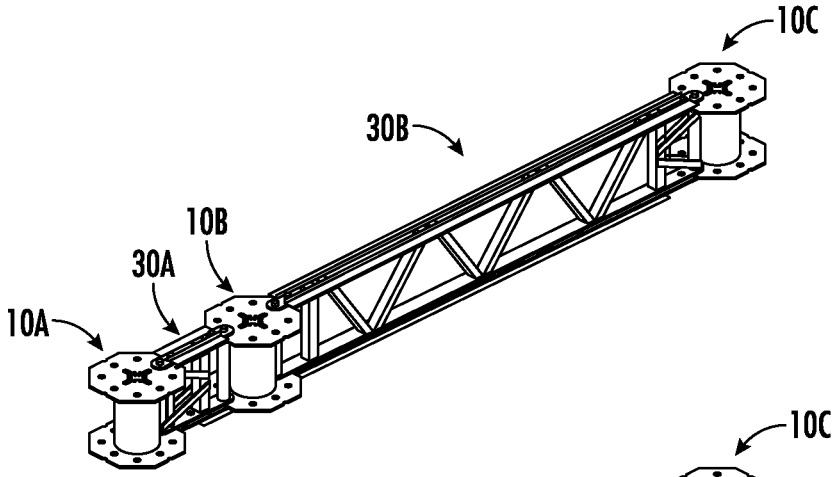
FIG. 20A is a top perspective view of a joist and interconnection structure assembly, in accordance with embodiments of the present disclosure.
Figure 20B:
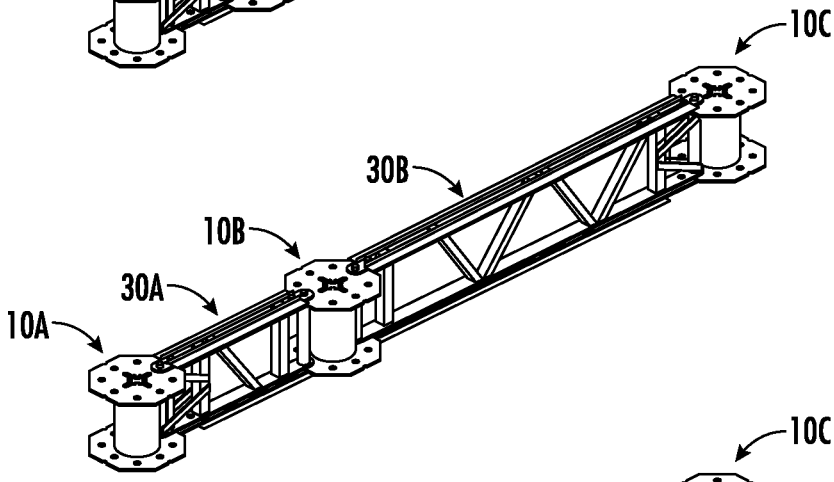
FIG. 20B is a top perspective view of a second embodiment of a joist and interconnection structure assembly, in accordance with embodiments of the present disclosure.
Figure 20C:
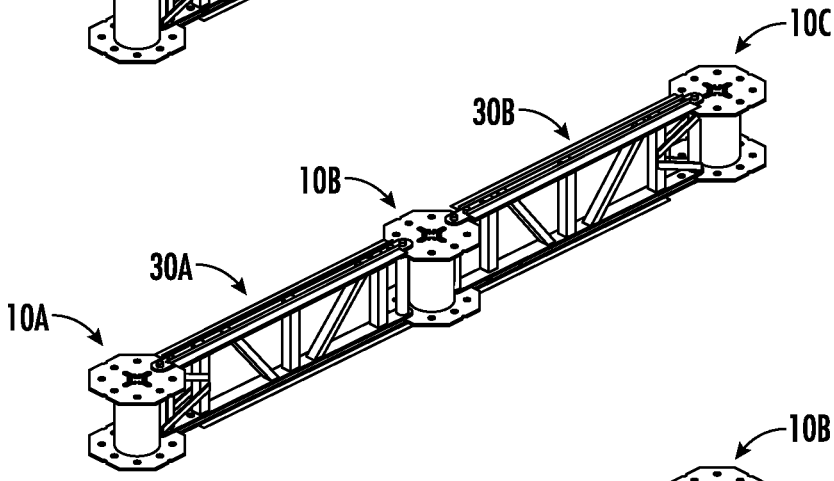
FIG. 20C is a top perspective view of a third embodiment of a joist and interconnection structure assembly, in accordance with embodiments of the present disclosure.
Figure 20D:
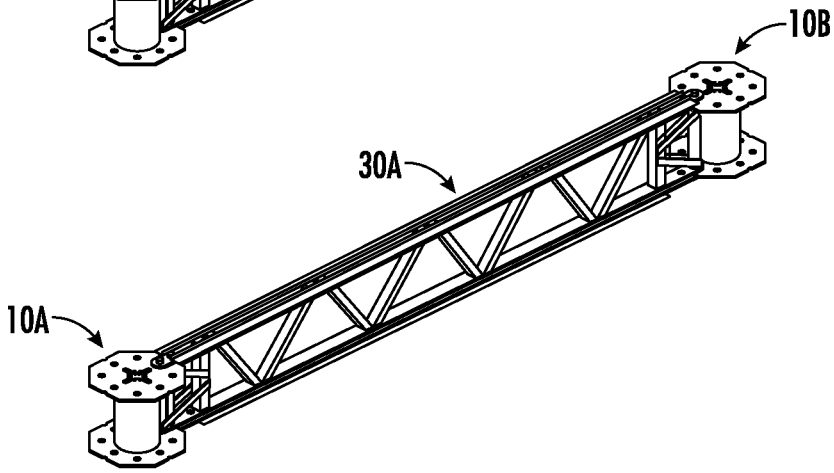
FIG. 20D is a top perspective view of a fourth embodiment of a joist and interconnection structure assembly, in accordance with embodiments of the present disclosure.

While the individual sections or units 115 of the modular space frame support system 100 (and, ultimately, work platform support system 200) described with reference to FIGS. 8-19 are square, that is, each individual section or unit 115 is made of four interconnection structures 10 and four joists 30, as mentioned above, in some embodiments the individual units 115 of the modular space frame support system 100 may take different geometries and shapes. For example, FIGS. 20A, 20B, 20C, and 20D show various embodiments of a joist 30 and interconnection structure 10 configuration. For example, FIG. 20D shows a "standard" length joist 30A (e.g., 8 foot nominal length) with two interconnection structures 10A, 10B. This "standard" length joist 30A could be termed a "6/6 unit". FIG. 20C shows two joists 30A, 30B of equal length connected to interconnection structures 10A, 10B, 10C. The joists 30A, 30B in FIG. 20C, being half the length, each of the length of the joist 30A in FIG. 20D, may be termed a "3/6 unit" in that they are half the length of the aforementioned "6/6 unit". Similarly, two unequal length joists 30A, 30B are depicted in FIG. 20B, and can be termed a "2/6 unit" and a "4/6 unit", respectively. This is because the "2/6 unit" is approximately one third the length of a "standard" "6/6 unit" joist as shown in FIG. 20D, as is the "4/6 unit" is approximately two thirds the length of the "6/6 unit". The same system is shown in FIG. 20A, wherein the first joist 30A is termed a "1/6 unit" and the second joist 30B is termed a "5/6 unit". As stated above, by using different lengths of joist 30, and by extending joists 30 from interconnection structures 10 at different angles, one can obtain a nearly infinite variety of configurations and footprints of the modular space frame support system 100 and resulting work platform system 200. This variety, for example, allows the installer to set up the modular space frame support system 100 and work platform system 200 around various obstacles (e.g., columns, piers, abutments, etc.) and structures. The variety allows the installer to create numerous shapes to the work platform system beyond just a rectangle.

With reference to the teachings herein, including at least FIGS. 7A, 10 and 15-19, it is apparent that at least one of the joists is to be connected with at least one of the interconnection structures using a pin to provide free rotation of the at least one joist with respect to the at least one interconnection structure about the pin. Moreover, it is apparent that the free rotation is restricted by at least one of: i) an additional pin that is to be located proximate a perimeter of the at least one interconnection structure; and ii) at least a portion of a work platform when the platform is positioned with respect to the interconnection structures and the joists in the final position.

Although modular space frame support system and resulting work platform systems, as discussed herein, may be installed, and extended, via the aforementioned articulation capability, it should be apparent that this method of use is not the only method available. For example, in lieu of articulating the various sections or units of modular space frame support system 100 from already installed section of a modular space frame support system 100 or resulting work platform system 200, the installation may be done, essentially, "in the air". That is, the units of the modular space frame support system 100 may erected and connected together "in the air," in a piece-by-piece order via the use of multiple pieces of lifting, or hoisting, equipment. Alternatively, the interconnection structures 10 and joists 30 may be preassembled on the ground, or at a remote location, and then moved and hoisted as a pre-assembled module into the desired location underneath a structure.

Chord

Figure 21A:
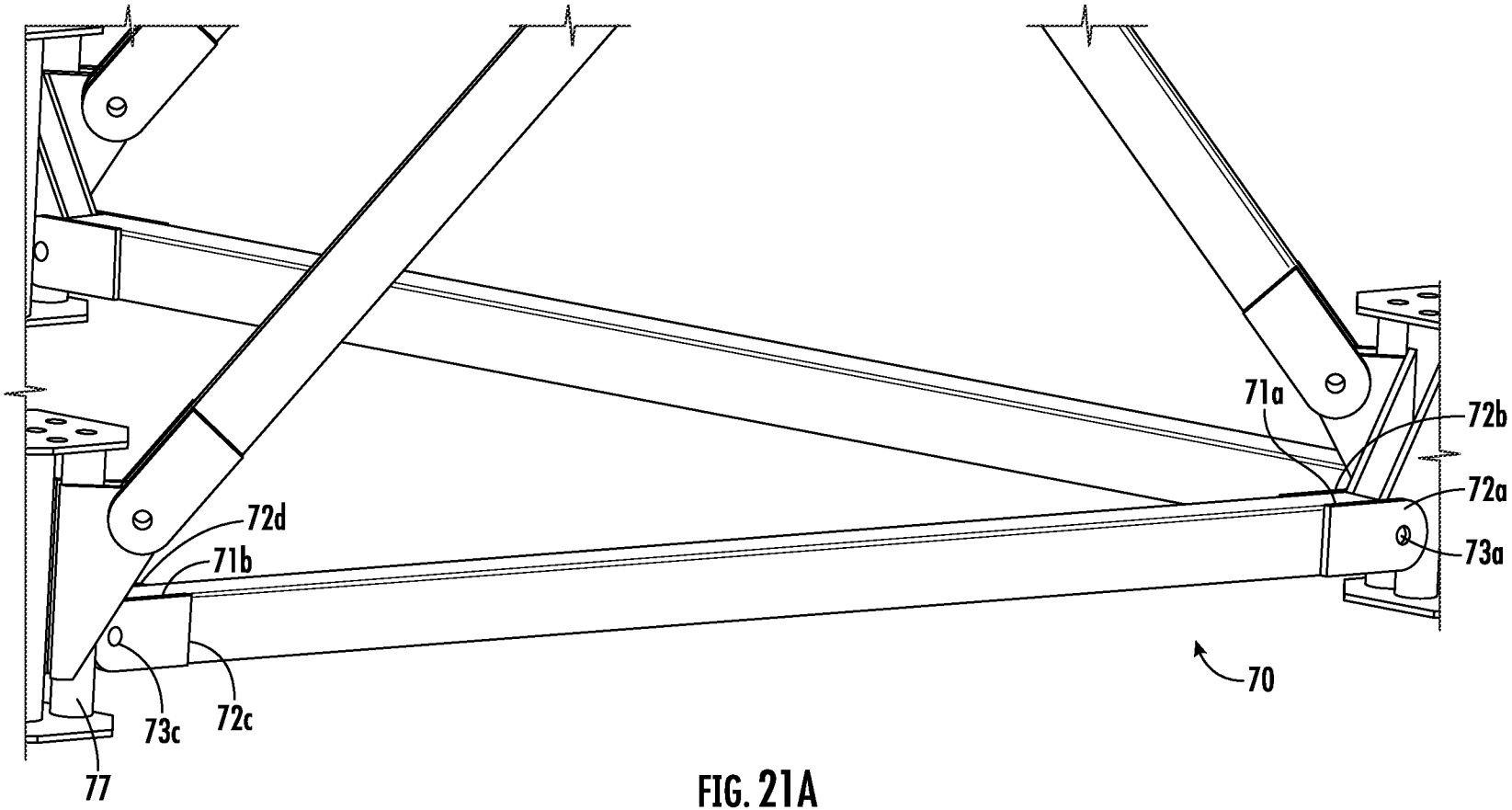
FIG. 21A is shows a chord in use in a modular space frame support system, in accordance with embodiments of the present disclosure.

FIG. 21A depicts a perspective view of an embodiment of a chord 70. The chord 70 is an elongate tubular member adapted for bearing or supporting a load. Chords 70 can be used in the modular space frame support system 100 as diagonal supports or, in some embodiments, in the place of joists in a lower frame 120 of a modular space frame support system 100.

In the embodiment shown, the chord 70 is made of structural tubing. In an embodiment, the chord 70 is a single structural tubing shape; however, in other embodiments, the chord 70 could be made of multiple pieces of structural tubing shapes or other suitable shapes and materials.

Specifically, in the embodiment shown, the chord 70 is a squared tubular structure having two open ends 71*a*, 71*b* configured to be secured directly or indirectly to an interconnection structure 10. In accordance with some embodiments, the chord 70 is configured to secure directly to an interconnection structure 10. However, in other embodiments, the ends 71*a*, 71*b* of the chord 70 include one or more structures adapted to engage an interconnection structure bracket 77, as described in further detail below.

In accordance with one embodiment, affixed to each of the open ends 71*a*, 71*b* are two plates 72*a*, 72*b*, 72*c*, 72*d*. At a given end, the plates are affixed to the outer surface of opposite sides of the squared tubular structure such that the respective plates 72*a*, 72*b* and 72*c*, 72*d* are parallel one another. Each of the plates 72*a*-72*d* extends outward from the respective end 71*a*, 71*b* of the chord parallel with the chord 70. Each plate 72*a*-72*d* further includes an opening 73*a*, 73*b* (not shown), 73*c*, 73*d* (not shown) positioned through the respective plate such that the openings 73*a*, 73*b* (not shown) and 73*c*, 73*d* (not shown) of respective pairs of plates 72*a*, 72*b* and 72*c*, 72*d* are corresponding and coaxial and form a linear passage through the respective plates. As shown with reference to FIG. 22, the respective pairs of openings 73*a*, 73*b* (not shown) and 73*c*, 73*d* (not shown) each receives a pin to secure in the interconnection structure brackets 77.

In the embodiment shown, the plates 72*a*, 72*b*, 72*c*, 72*d* are generally rectangular with one of the short sides being rounded. It is understood that the particular shape and size of the plates 72*a*-72*d*, however, can vary depending on the particular arrangement and components used in forming the modular space frame support system. For example, the plates 72*a*-72*d* can be true rectangles, round, arcuate, or any polygonal shape. Similarly, while in the embodiment shown the openings 73*a*-73*d* are shown centered on the rounded end of the plates 72*a*-72*d*, in other embodiments, the openings 73*a*-73*d* may be offset or otherwise differently positioned.

In another embodiment, the openings may be formed within the chord 70 itself. In such an embodiment, the chord 70 has four openings—two aligned coaxial openings at either end of the chord 70 forming two passages through the entirety of the chord 70. A corresponding interconnection structure bracket would be designed with a projection containing a corresponding opening or openings which either inserts into the hollow center of the chord 70 or forms a cup into which the end of a chord is inserted.

Figure 21B:
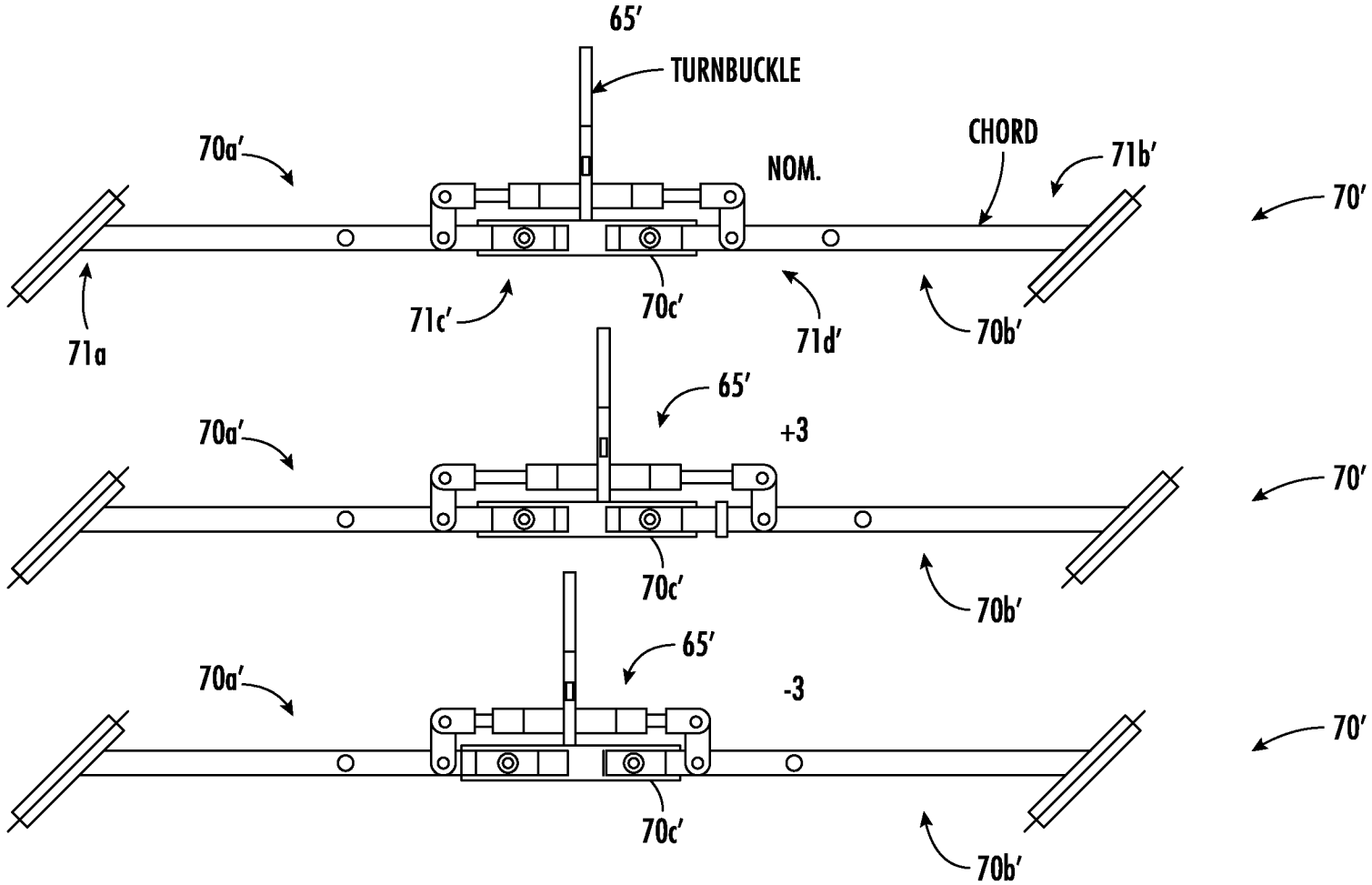
FIG. 21B is a side view of an alternative chord for use with a modular space frame support system, in accordance with the present disclosure.

FIG. 21B depicts a perspective view of an alternative embodiment of a chord 70'. Like chord 70, chord 70' is primarily an elongate tubular member adapted for bearing or supporting a load; however, unlike chord 70, chord 70' is made of multiple discrete sections that allow for the chord 70' to be of variable length. More particularly, in the present exemplary embodiment, chord 70' is provided in two sections 70*a*' and 70*b*' which are each slidably engaged within a connecting portion 70*c*', which can be considered a third section of the chord.

In the embodiment shown, the chord sections 70*a*' and 70*b*' are made of structural tubing. Specifically, in the embodiment shown, the chord sections 70*a*' and 70*b*' and connecting portion 70*c*' are squared tubular structures. Each of chord sections 70*a*' and 70*b*' has a respective end 71*a*' and 71*b*', respectively, which constitute opposed ends of the chord 70' (that is, which are at opposite ends of the chord 70') and which are configured to be secured directly or indirectly to an interconnection structure such as the interconnection structure 10 discussed above (for example, see FIG. 2). In accordance with some embodiments, the chord 70' is configured to be secured directly to an interconnection structure such as the interconnection structure 10. However, in other embodiments, the ends 71*a*' and 71*b*' of the chord sections 70*a*' and 70*b*' include one or more structures that are adapted to permit the respective chord sections 70*a*' and 70*b*' to engage respective interconnection structure brackets 77, such as described with respect to chord 70.

For example, and as described with reference to FIG. 21A, a chord 70' may include two pairs of plates (not shown in FIG. 21B), with a respective pair of plates being affixed to each of its first ends 71*a*' and 71*b*'. In such embodiment, at each given end 71*a*' or 71*b*', the plates (of a respective pair of plates) are respectively affixed to the outer surface of opposite sides of the squared tubular structure forming the respective chord section 70*a*' or 70*b*', such that the respective plates of the pair are arranged so as to extend parallel to one another. As with plates 72*a*-72*d* of chord 70, each plate affixed to a chord 70' would extend outward from a respective one of the ends 71*a*' and 71*b*' of the chord, parallel with the chord 70'. Further, also as with plates 72*a*-72*d*, each plate would further include an opening (not shown in FIG. 21B), positioned through the respective plate, with the openings of the plates of each pair at either end 71*a*' and 71*b*' being coaxially aligned with (or corresponding with) one another so as to form a respective linear passage through the respective plates at the respective end. Given such coaxial alignment, the respective pair of openings of the respective plates at each end 70*a*' or 71*b*' can receive a respective pin to secure the plates and thereby secure the chord 70' with the interconnection structure brackets 77 in the same or substantially the same manner as described with respect to FIGS. 22A, 22B and 22C.

As further described with reference to FIG. 21A, in the embodiment shown, the plates affixed to a chord 70' would be generally rectangular with one of the short sides (e.g., the most outwardly-extending short side) being rounded. It is understood that the particular shape and size of the plates, however, can vary depending on the particular arrangement and components used in forming the modular space frame support system. For example, the plates can be true rectangles, round, arcuate, or any polygonal shape. Similarly, while in the embodiment shown the respective openings are generally centered on the respective rounded ends of the respective plates, in other embodiments, the openings may be offset or otherwise differently positioned.

In another embodiment, the openings may be formed within the chord 70' itself. In such an embodiment, the chord 70' has four openings, namely, first and second pairs of coaxially aligned openings respectively provided at the respective ends 71*a*' and 71*b*' of the chord 70'. With such an arrangement of pairs of coaxially aligned openings, the chord 70' would have first and second passages respectively positioned at the respective ends 71*a*' and 71*b*', where each of the passages would extend through the entirety (full width) of the chord 70'. Given such an arrangement, the chord 70' would be suitable for interconnection with an alternate embodiment of interconnection structure bracket differing from the interconnection bracket 77. Such an alternate embodiment of interconnection structure bracket could for example be designed to include a projection containing a corresponding opening or openings that would either insert into the hollow center of the chord 70' or form a cup into which the end of a chord is inserted. Upon such a corresponding opening or openings of this form of interconnection structure bracket being aligned with the coaxially aligned openings at a respective end 71*a*' and 71*b*' of the chord 70', a pin could again be inserted through all of the aligned openings at the respective end to secure that end with the interconnection structure bracket.

As shown in FIG. 21B, the chord sections 70*a*' and 70*b*' have generally consistent external dimensions along the length of the chord sections 70*a*' and 70*b*', with the first ends 71*a*' and 71*b*' as described above. Additionally, the chord sections 70*a*' and 70*b*' respectively have second (inner) ends 71*c*' and 71*d*', respectively, each of which is configured to be received within the connection portion 70*c*'. In the embodiment shown, the chord sections 70*a*' and 70*b*' have a consistent external dimension along the length of the chord sections 70*a*' and 70*b*', and the connecting section 70*c*' has consistent internal dimensions along the length of the connecting section 70*c*'. However, in further embodiments, the chord sections 70*a*' and 70*b*' may include flanges on the second ends 71*c*' and 71*d*' to make the outer dimensions of the second ends 71*c*' and 71*d*' of the chord sections 70*a*' and 70*b*' larger. Similarly, the connection portion 70*c*' may include two internal flanges at its open ends having internal dimensions just larger than the outer dimensions of the flanges on the chord sections 70*a*' and 70*b*'. This configuration would prevent the chord sections 70*a*' and 70*b*' from disengaging from the connecting section 70*c*' (or reduce the likelihood of such disengagement).

In an embodiment, the chord sections 70*a*' and 70*b*' may each include one or more protuberances 74*a*' (see FIG. 21C) and the connecting section 70*c*' may include one or more corresponding apertures or indentations on the internal surface of the connecting section 74*b*' (not shown). As the chord sections 70*a*' and 70*b*' slidingly engage the connecting section 70*c*', the one or more protuberances 74*a*' engage respective ones of the one or more corresponding apertures/indentations 74*b*' (not shown). The engagement of protuberances 74*a*' and apertures 74*b*' can act as a locking feature and/or provide tactile feedback about the positioning of the chord sections 70*a*' and 70*b*' in the connecting section 70*c*'. Further, although not shown, in some embodiments, the connection section 70*c*' can include multiple (e.g., more than two) apertures/indentations along its length so that each of the respective chord sections 70*a*' and 70*b*' can attain multiple different positions along the connection section 70*c*' depending upon which of the apertures/indentations is engaged by the respective protuberance 74*a*' of the respective chord section.

The chord 70' also includes a linear force-applying device 65'. The linear force-applying device 65' is operably connected to both chord sections 70*a*' and 70*b*' to apply linear force to the chord sections 70*a*' and 70*b*' to cause the chord sections 70*a*' and 70*b*' to move collinearly with one another, either simultaneously or independently, relative to the connecting section 70*c*'. That is, the linear force-applying device 65' is capable, upon actuation, of applying linear force to both chord section 70*a*' and chord section 70*b*' such that the chord sections 70*a*' and 70*b*' move toward or away from one another. The linear force-applying device 65' can cause linear movement of the chord sections 70*a*' and 70*b*' either simultaneous upon actuation or independently.

In an embodiment, the linear force-applying device 65' is a turnbuckle. In an embodiment, the turnbuckle may be a standard turnbuckle, or stretching screw, which causes both chord sections 70*a*' and 70*b*' to move toward or away from each other simultaneously. Such movement of the chord sections 70*a*' and 70*b*' toward or away from one another would also correspond to movement of the respective chord sections inward into, or outward out from, the connecting section 70*c*'. In some such embodiments, and as shown in FIG. 21B, the turnbuckle is a ratcheting turnbuckle. A ratcheting turnbuckle can cause both chord sections 70*a*' and 70*b*' to move toward or away from each other in a simultaneous manner or, alternatively, be configured to move the chord sections 70*a*' and 70*b*' independently of each other. Further in this regard, FIG. 21B is particularly intended to illustrate that the turnbuckle is a ratcheting turnbuckle configured to move the chord sections 70*a*' and 70*b*' independently of each other.

Additionally as shown in FIG. 21B, the linear force-applying device 65' is attached to each of the chord sections 70*a*' and 70*b*' at respective points that are respectively close to the second ends 71*c*' and 71*d*', but that are far enough removed from the second ends 71*c*' and 71*d*' that the connections do not interfere with the ability of the chord sections 70*a*' and 70*b*' to slide within the connecting portion 70*c*'.

Using the linear force-applying device 65', the positions of the chord sections 70*a*' and 70*b*' relative to the connecting section 70*c*' can be adjusted. For example, as shown in FIG. 21B, one or both chord sections 70*a*' and 70*b*' can be moved outward from the connecting section 70*c*', i.e., away from each other, to make the total length of the chord 70' greater. Similarly, one or both chord sections 70*a*' and 70*b*' can be moved into the connecting section 70*c*', i.e., toward each other, to make the total length of the chord 70' less. It will be appreciated that the amount of adjustability is limited by the length of the connecting section 70*c*', the lengths of the chord sections 70*a*' and 70*b*', the particular structure of the linear force-applying device 65', and/or the adjustable range of the linear force-applying device 65'.

Figure 21C:
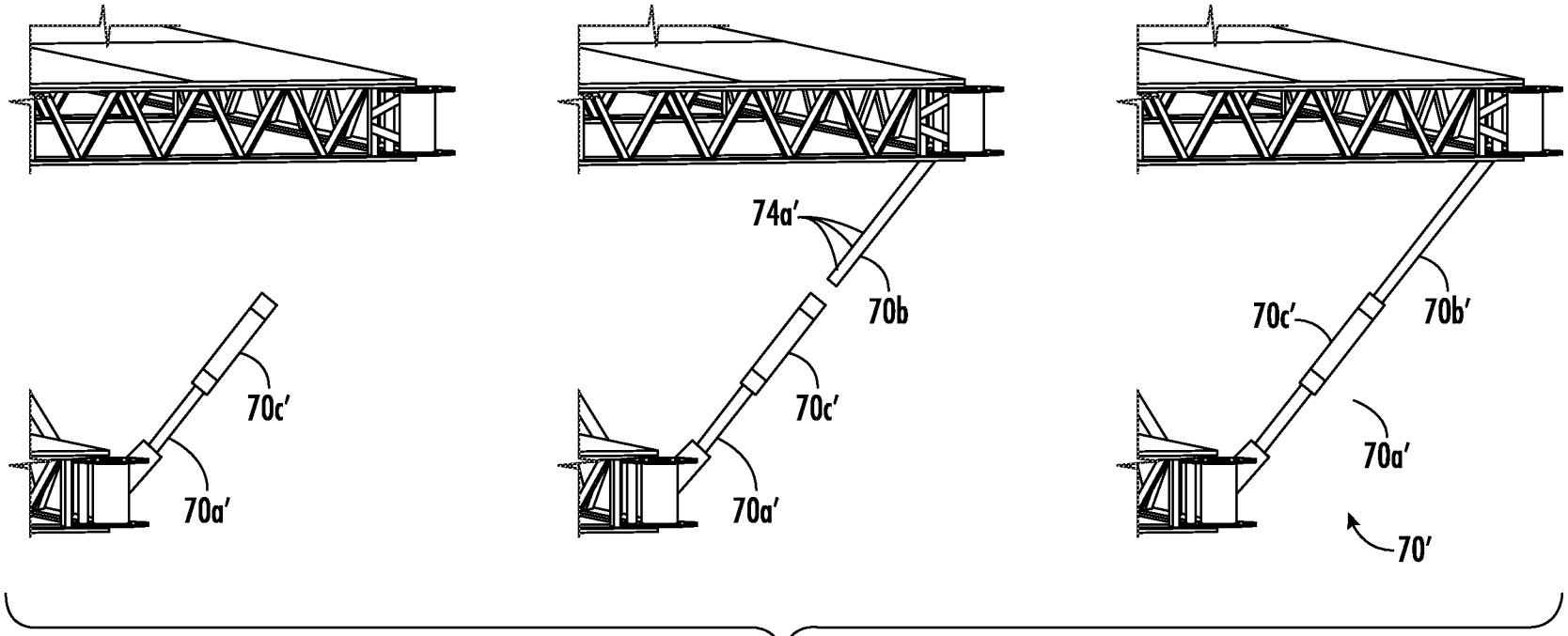
FIG. 21C illustrates an exemplary method for assembling the chord of FIG. 21B.

As will be appreciated and as illustrated at least in part in FIG. 21C, the sliding engagement of the chord sections 70*a*' and 70*b*' with respect to the connecting section 70*c*' provides for an amount of adjustability in the length of the overall chord 70'. The adjustability of the chord 70' is particularly helpful in assembling a modular space frame support system. While it is intended that each component in a modular space frame support system is of a consistent size, shape and configuration in order to achieve proper alignment and securement during assembly, it will be understood that minor variances occur, whether due to the environment, use, wear, or assembly variations. As such, it is helpful to have one or more components which can be adjusted within a range to fit into the desired location.

By way of example, when assembling a cube of given dimensions using interconnection structures and joists and/or chords as described herein, it can be difficult to secure a final linear component (e.g., joist or chord) when the remaining components are already assembled due to a lack of flexibility in the system, etc. When using chord 70', the chord 70' can be made shorter to make it easier to get the chord 70' into position relative to the rest of a modular space frame support system. The chord 70' can then be lengthened while in position in order to provide a proper fit and connect with greater ease.

FIG. 21B particularly illustrates an exemplary chord 70' at three different lengths. In the top-most illustration, the chord 70' is shown in a first position with both chord sections 70*a*' and 70*b*' projecting into the connecting section 70*c*' the same amount with some space between them. That is, there is still the ability to decrease the length of the chord 70' beyond what is shown in the top-most illustration. By comparison, the middle illustration shows the chord 70' in a second position with chord section 70*b*' extending further outward from the connecting section 70*c*'. It will be appreciated, however, that the middle illustration does not show the chord 70*c*' in its longest position, as chord section 70*a*' may also still be moved outward from the connection section 70*c*'. Additionally by comparison, the bottom-most illustration shows the chord 70' in a third position which is its shortest position. Both chord sections 70*a*' and 70*b*' are within the connecting section 70*c*' as much as possible and, in particular, the second ends 70*c*' and 70*d*' of the chord sections 70*a*' and 70*b*' are in contact with one another or substantially adjacent to one another within the connecting section 70*c*'.

In view of the positions shown in FIG. 21C, it will be understood that the length of the chord 70' can be adjusted, i.e., either increased or decreased, depending on the chord's 70' starting length and desired end length. Also, the chord 70' can be installed—for example, the chord sections 70*a*' and 70*b*' and connecting section 70*c*' can be installed in a sequential manner—so that the chord 70' both can be fit into a desired space and ultimately link two interconnection structure brackets such as the interconnection structure brackets 77 or other interconnection structures such as the interconnection structures 10.

As will be appreciated, when assembling a modular space frame support system, one of the chords 70' in at least some embodiments or circumstances can be used in the same manner as one of the chords 70 and installed in the same manner (or by way of the same process) as described in further detail below. Chord 70' may also be held in position with a total length less than the final needed length and then extended to its final needed length while in position. The extending may occur either before any end of the chord 70' is secured to a component of a modular space frame support system or after one of the ends has been secured to a component of a modular space frame support system. That is, in one embodiment, a chord 70' may be held in position at a length less than that needed to connect both ends of the chord 70' to respective components of a modular space frame support system, and the length of the chord 70' can be increased by moving one or both of the chord sections 70*a*' and/or 70*b*' outward from the connecting section 70*c*'. The respective ends 71*a*' and 71*b*' are then connected to the respective components of the modular space frame support system after the chord 70' is extended as desired. In an embodiment, the length of the chord 70' is increased by actuating a linear force-applying device, or more particularly, in some embodiments, a turnbuckle and further a ratcheting turnbuckle.

Further still, and as shown in FIG. 21C, a first chord section 70*a*' and connecting section 70*c*' may be assembled and connected to the modular space frame support system first in a first position (e.g., as shown in the leftmost illustration of FIG. 21C) so that the first chord section 70*a*' and connecting section 70*c*' are not at their longest position, a second chord section 70*b*' can be connected to the modular space frame support system (e.g., as shown in the middle illustration of FIG. 21C), and then the length of the first chord section 70*a*'/connecting section 70*c*' subassembly can be extended to meet and connect with the second chord section 70*b*' to form the complete chord 70' (e.g., as shown in the rightmost illustration of FIG. 21C).

Interconnection Structure Bracket

Figure 22A:
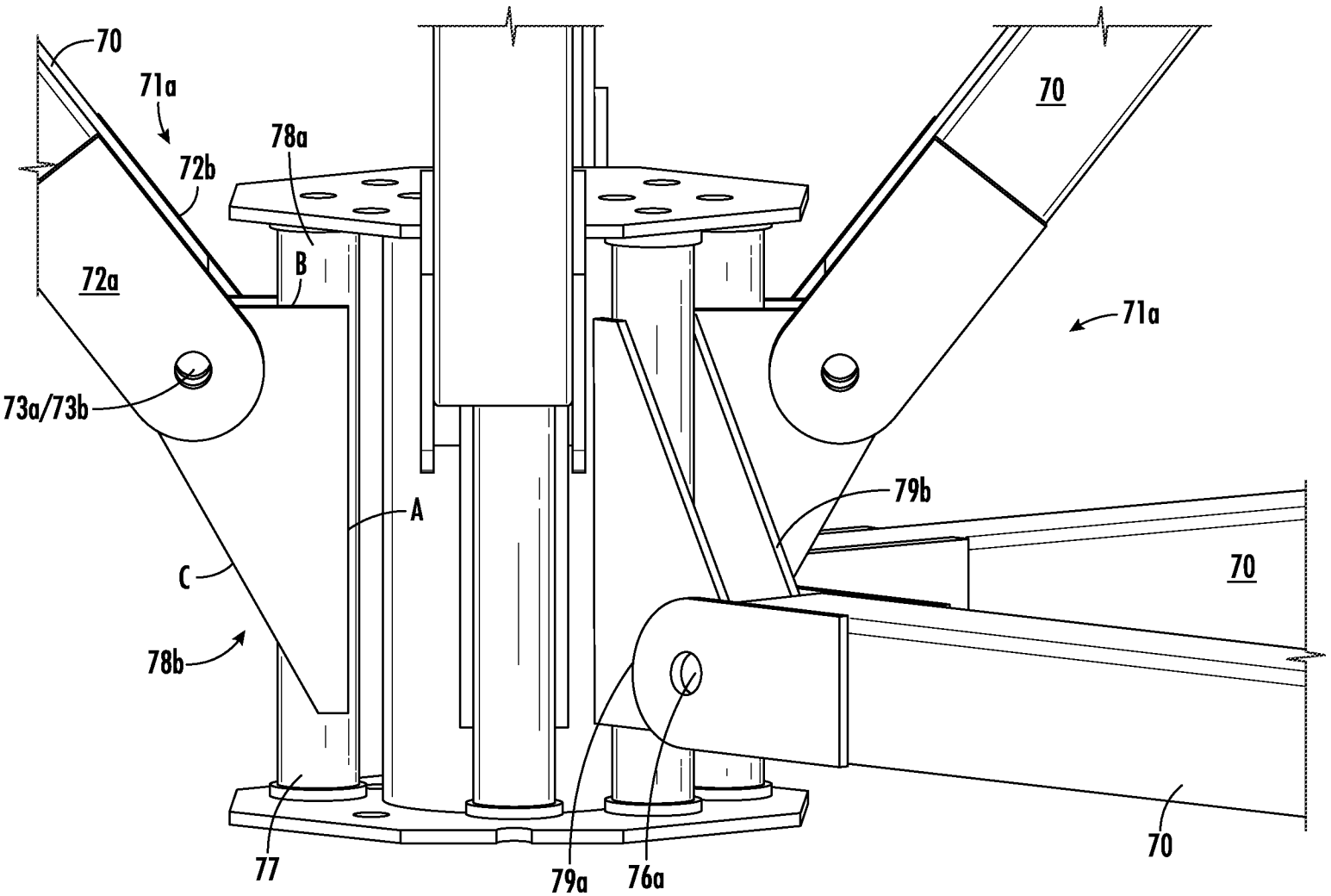
FIG. 22A is a side perspective view of a plurality of chords connected with an interconnection structure using an interconnection structure bracket, in accordance with the present disclosure.
Figure 22B:
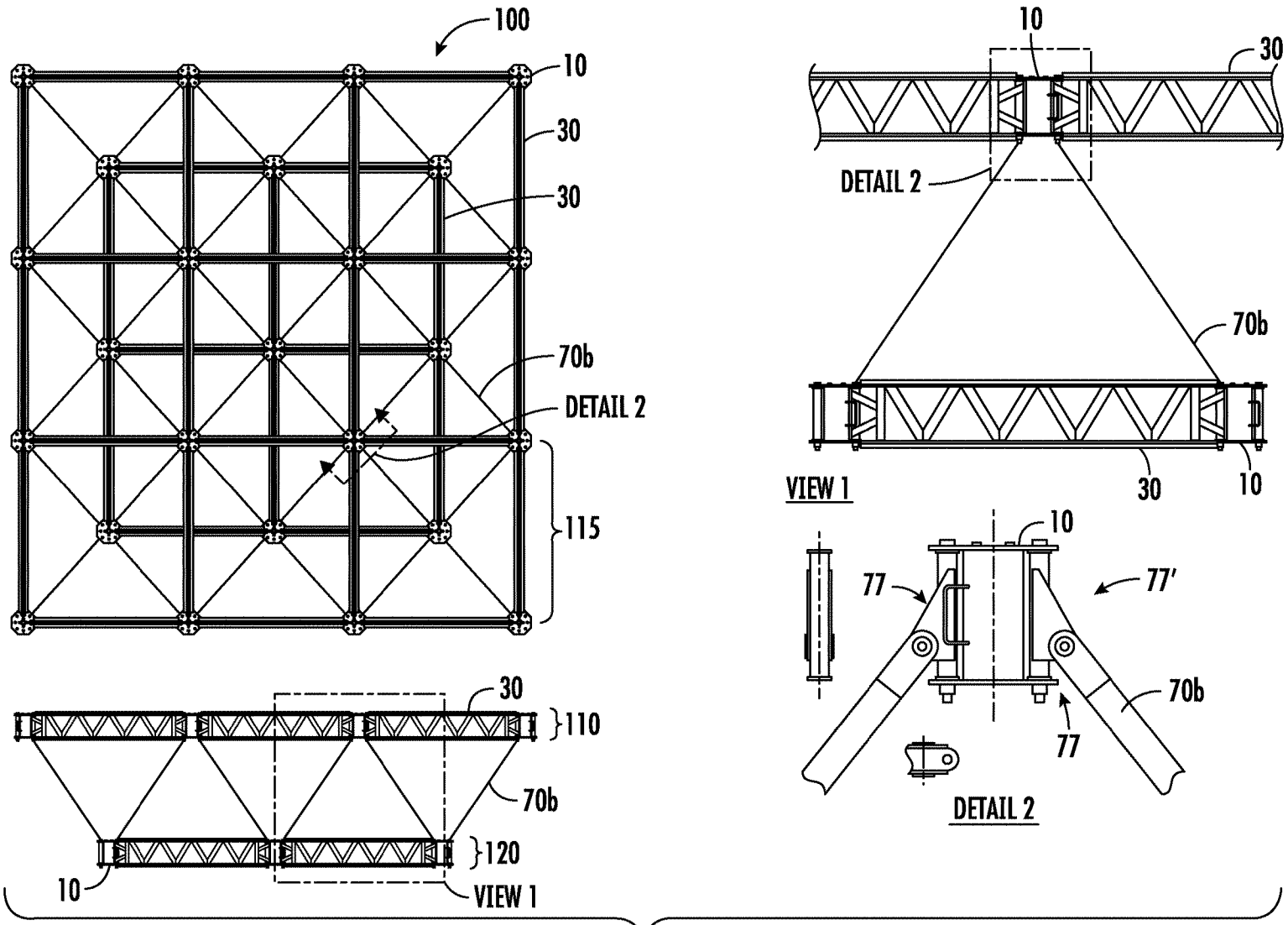
FIG. 22B shows a plan view of an embodiment of a modular space frame support system, a side view of the modular space frame support system shown in the plan view, a detailed call-out of a portion of the side view, and a cross-sectional view of an interconnection structure bracket assembly, in accordance with embodiments of the present disclosure.
Figure 22C:
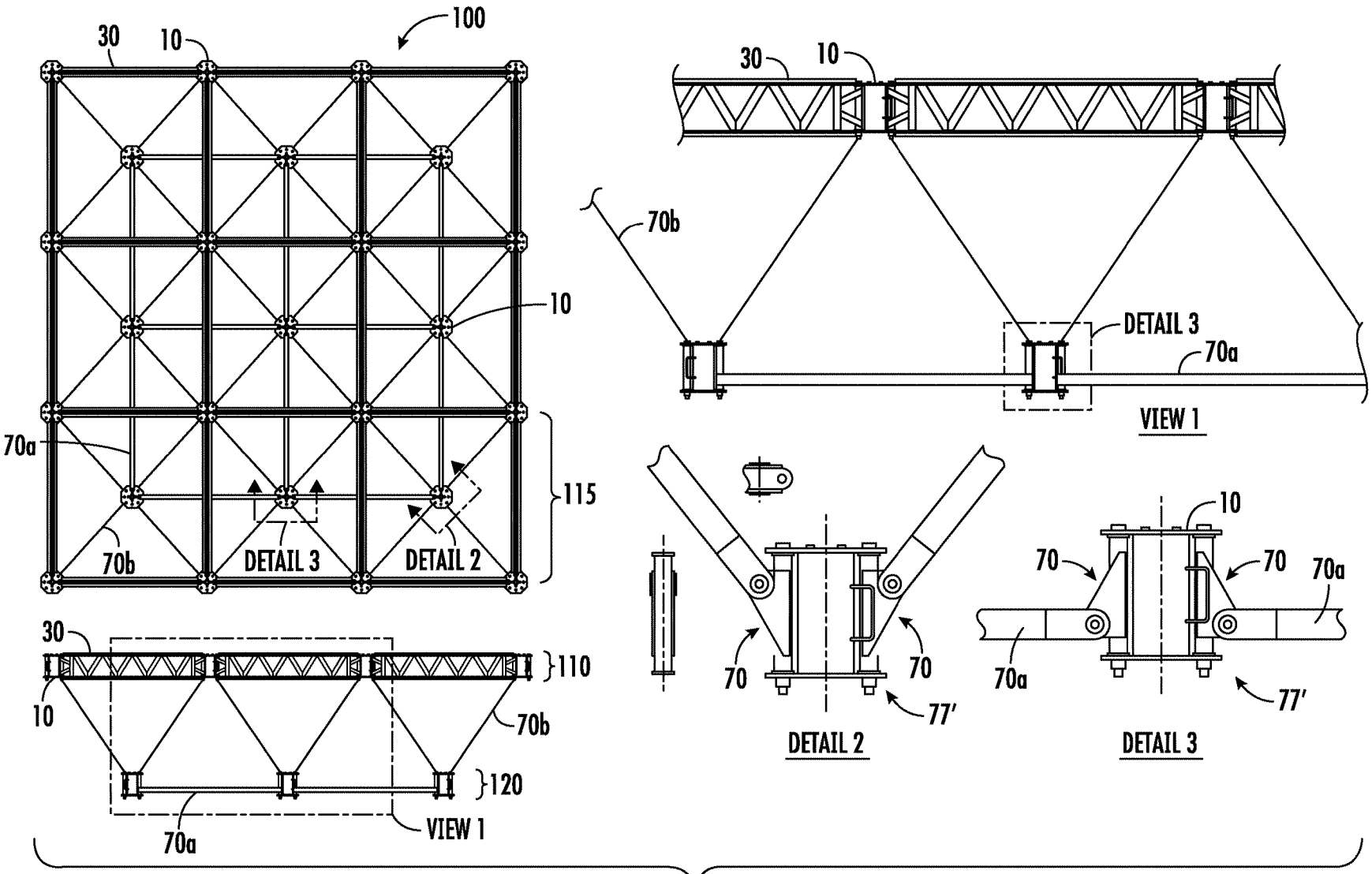
FIG. 22C shows a plan view of a further embodiment of a modular space frame support system, a side view of the modular space fame support system shown in the plan view, a detailed call-out of a portion of the side view, and two cross-sectional views of an interconnection structure bracket assembly, in accordance with embodiments of the present disclosure.

FIG. 22A depicts a side perspective view of the interconnection between a plurality of chords 70 and interconnection structure 10, with FIGS. 22B and 22C showing additional detail of interconnection structure bracket assemblies 77', i.e., the structural combination of an interconnection structure 10 and an interconnection structure bracket 77 as a single component). In particular, FIG. 22B shows a cross-sectional view of an interconnection structure bracket assembly 77' from an upper frame 110 with two interconnection structure brackets 77 attached to the interconnection structure 10 and engaging two diagonal chords 70*b*. FIG. 22C shows two cross-sectional views of interconnection structure bracket assemblies 77', both of which are from interconnection structures of a lower frame 120. The Detail 2 image is a cross-sectional view of an interconnection structure bracket assembly 77' with two interconnection structure brackets 77 attached to the interconnection structure 10 and engaging two diagonal chords 70*b*. The Detail 3 image is a cross-sectional view of an interconnection structure bracket assembly 77' with two interconnection structure brackets 77 attached to the interconnection structure 10 and engaging two horizontal chords 70*a*.

As described above, the ends 71*a*, 71*b* of the chords 70 shown are each configured to engage an interconnection structure bracket 77. In accordance with the embodiments shown, the ends 71*a* of the chords 70 each include two plates 72*a*, 72*b*, each of which includes an opening 73*a*, 73*b* such that the openings 73*a*, 73*b* are corresponding and coaxial to form a linear passage through the plates 72*a*, 72*b*.

The interconnection structure brackets 77 are composed of a hollow tubular section 78*a* having one or more structures 78*b* adapted to engage the end of a chord 70. In the embodiment shown, the hollow tubular section is a right cylinder; however, in further embodiments, the hollow tubular section may have a different shape, such as any prism with a polygonal base.

In accordance with the embodiment shown, the at least one structure 78*b* adapted to engage the end of a chord 70 includes two plates 79*a*, 79*b* configured to engage the end of a chord 70. Specifically, the plates 79*a*, 79*b* each include an opening 76*a*, 76*b* (not shown) such that the openings 76*a*, 76*b* (not shown) are corresponding and coaxial to form a linear passage through the plates 79*a*, 79*b*. When a chord 70 is aligned with respect to the interconnection structure bracket 77, the openings 73*a*, 73*b* in the end plates 72*a*, 72*b* of the chords 70 and openings 76*a*, 76*b* in the plates 79*a*, 79*b* of the interconnection structure bracket 77 align to form a single continuous passage. The chord 70 is then secured to the interconnection structure bracket 77 using a securing structure such as a pin, nut and bolt configuration, wire and pin, etc.

In the embodiments shown, in which the one or more structures 78*b* adapted to engage the end of a chord 70 are plates 79*a*, 79*b*, the plates 79*a*, 79*b* are generally triangular in shape, having a straight edge A generally in line with the hollow tubular section 78*a*. A second straight edge B extends from a first end of the straight edge A at an angle, which in the embodiment shown is a generally perpendicular angle, with a third straight edge C connecting the first straight edge A and second straight edge B. In the particular embodiment shown, the plates 79 are right triangles with the third straight edge C being the hypotenuse. Moreover, in the embodiment shown, straight edge B is the shortest side, and straight edge C is the longest side. Further, the plates 79*a*, 79*b* are not symmetrical in shape along any axis.

In such an embodiment, the openings 76 are positioned in the corner of the plates 79 in proximal to where the second straight edge B and third straight edge C meet. The openings 76 are therefore set away from the hollow tubular structures 78*a*, and, indeed, the interconnection structure 10, and particularly the top element 11 and bottom element 12 of the interconnection structure 10, at a distance.

The particular shape and configuration of the plates 79*a*, 79*b* can vary depending on the particular arrangement of the modular space frame support system and the specific design of the other components used. For example, while the plates 79*a*, 79*b* described with reference to FIG. 22A are triangular, in other embodiments, the plates 79*a*, 79*b* can take different polygonal shapes or even a circular or arcuate shape. In still further embodiments, the openings 76*a*, 76*b* can be positioned at a different spot on the plates 79*a*, 79*b*. In particular, in one alternative embodiment, the plates 79*a*, 79*b* may be symmetrical such that the interconnection structure bracket 77 can be secured to the interconnection structure in either direction with no structural difference.

To secure the interconnection structure bracket 77 to the interconnection structure 10, the hollow tubular section 78*a* is aligned with any two corresponding top and bottom openings 13, 14 of the interconnection structure 10 and a pin is placed therethrough as discussed with reference to the interconnection of a joist 30 with the interconnection structure 10. It will be appreciated that the interconnection structure bracket 77 may be connected to the interconnection structure 10 with either end of the hollow tubular section 78*a* against the top element 11 of the interconnection structure 10, meaning the positioning of the openings 76 relative to the top and bottom elements 11, 12 of the interconnection structure 10 can be varied. In this manner, the chord 70 can be secured to an interconnection structure 10 in a variety of ways and angles. In particular, depending on the orientation of the interconnection structure bracket 77, the chords may be connected to the interconnection structure 10 in a perpendicular fashion, e.g., as shown with respect to chords 70*a*, or in a diagonal fashion, e.g., as shown with respect to chords 70*b*.

In the embodiment shown in FIG. 22A, the interconnection structure 10 is in use on a lower frame 120, meaning that the diagonal chords 70*b* project away from the interconnection structure 10 at an upward angle. In this particular embodiment, when the interconnection structure bracket 77 is secured to the interconnection structure 10 with the openings 76*a*, 76*b* of the plates 79*a*, 79*b* positioned proximal to the top element 11, the interconnection structure brackets 77 are securing the diagonal chords 70*b*. It will be appreciated that, in such an embodiment, the corresponding interconnection structure bracket on an interconnection structure of the upper frame will be positioned oppositely on the interconnection structure. That is, to attach a diagonal chord to an interconnection structure of the upper frame in accordance with the embodiment shown, the interconnection structure bracket will be connected to the interconnection structure of the upper frame such that the openings are proximal to the lower element of the interconnection structure.

Likewise, as shown in FIG. 22A, when securing horizontal chords 70*a* to the interconnection structures 10, the brackets 77 are secured to the interconnection structure 10 such that the openings 76*a*, 76*b* are proximal to the bottom element 12 of the interconnection structure 10. By positioning the interconnection structure brackets 77 such that the openings 76 are at a distance away from the interconnection structure 10, it will be appreciated that shorter chords may be used. Moreover, in the particular arrangement shown in FIG. 22A, in which the brackets 77 secured to an interconnection structure of a lower frame that are used to secure diagonal chords 70*b* are positioned with the openings 76 proximal to the top element 11 and the brackets 77 secured to an interconnection structure of an upper frame that are used to secure diagonal chords 70*b* are positioned with the openings 76 proximal to the bottom element 12, the distance the diagonal chord 70*b* must span is minimized. In some embodiments, depending on the distance between interconnection structures on a given frame, this means that the same chords can be used both as horizontal frame members 70*a* and diagonal chords 70*b*.

As described in more detail below, horizontally positioned chords are used only in lower frames. Interconnection structure brackets 77 are therefore used on the upper frame only to secure diagonal chords 70*b*.

It will be appreciated that the structures 78*b* adapted to secure to a chord may take different shapes or be different structures while maintaining the benefits discussed above with respect to the interconnection structure brackets 77 being positionable in different orientations with respect to the interconnection structure 10. For example, in alternative embodiments, the interconnection structure bracket 77 may include an alternative structure configured to secure the chords and dependent on the specific structure of the ends of the chords. For example, in embodiments in which the chords do not include plates at their ends, the interconnection structure bracket 77 may be configured with a single squared structure configured to either receive the end of the chord, e.g., a cup, or insert into the hollow center of the chord, e.g., a squared projection, either of which may contain one or more openings corresponding to openings in the end of the chord to secure the chord to the interconnection structure bracket.

In the particular embodiment shown, the distance between plates 79*a*, 79*b* of the interconnection structure bracket 77 is less than the distance between the plates 72*a*, 72*b* of the end 71*a* of the chord 70. In this way, the end 71*a* of the chord 70 is slid over the plates 79*a*, 79*b* of the interconnection structure bracket 77. However, in an alternative embodiment, the distance between the plates 79*a*, 79*b* of the interconnection structure bracket 77 may be greater than the distance between the plates 72*a*, 72*b* of the end 71*a* of the chord 70 such that the plates 79*a*, 79*b* of the interconnection structure bracket 77 are on the outside of the interconnection structure 10/chord 70 connection.

While the interconnection structure brackets 77 are described in relation to chords 70, it is understood that chords 70' may also be used alone or in combination with chords 70.

Vertical Support Member

Figure 23:
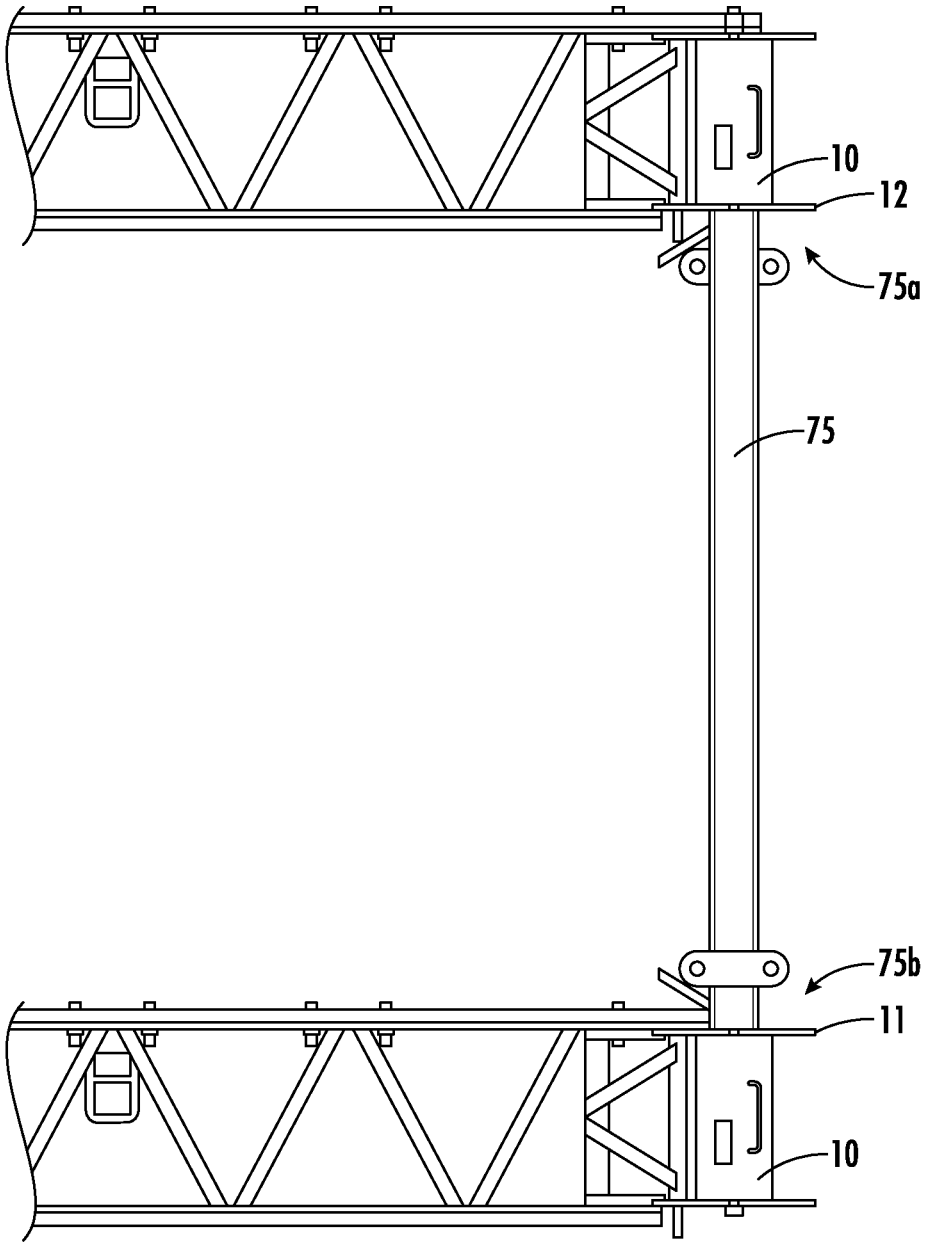
FIG. 23 is a side view of a vertical support member connecting two interconnection structures, in accordance with the present disclosure.

FIG. 23 is a side view of a vertical support member 75 connecting two interconnection structures 10A, 10B. The vertical support member 75 in any elongate structural member having a first end 75*a* configured to engage the bottom element 12 of an interconnection structure 10 and a second end 75*b* configured to engage the top element 11 of an interconnection structure 10. In some embodiments, the second end 75*b* may be specifically configured to engage the center opening 16 of the top element 11.

Modular Space Frame Support System and Work Platform Systems

Figure 26A:
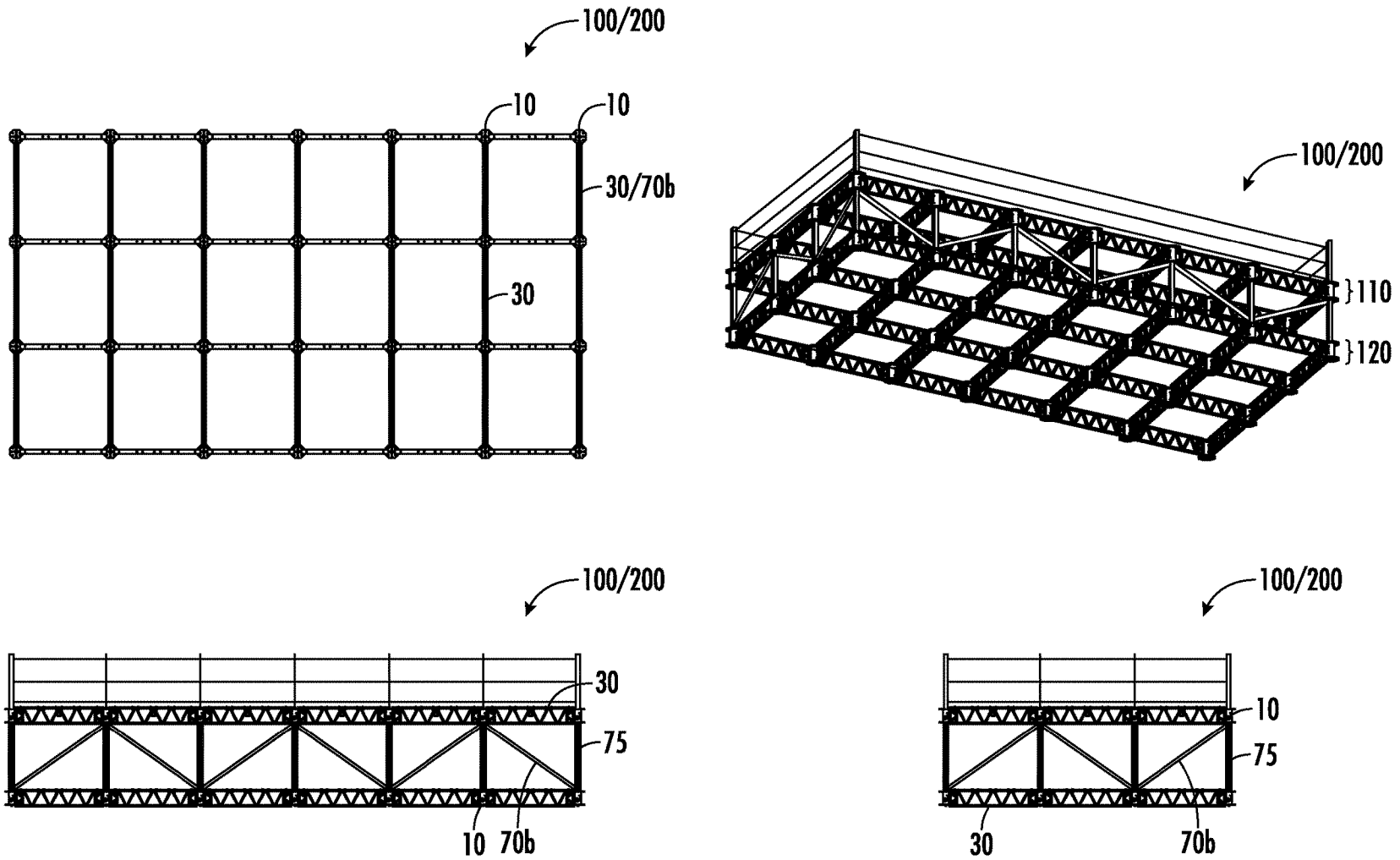
FIG. 26A shows a plan view, isometric view and two section views of another embodiment of a modular space frame support system and resulting work platform system, in accordance with embodiments of the present disclosure.
Figure 26B:
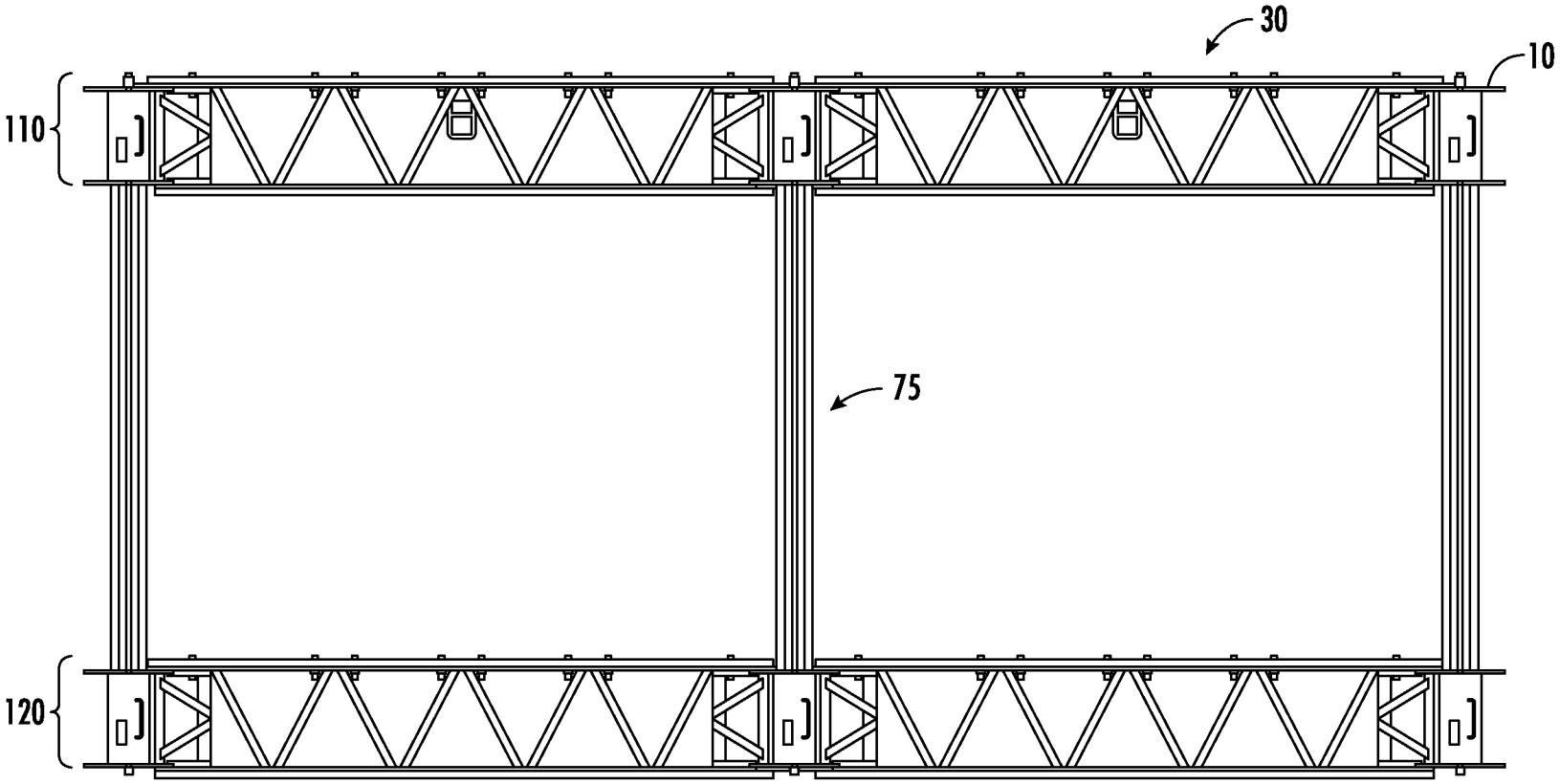
FIG. 26B is a side view of a portion of the structure shown in FIG. 26A with the diagonal chords omitted for clarity, in accordance with embodiments of the present disclosure.
Figure 26C:
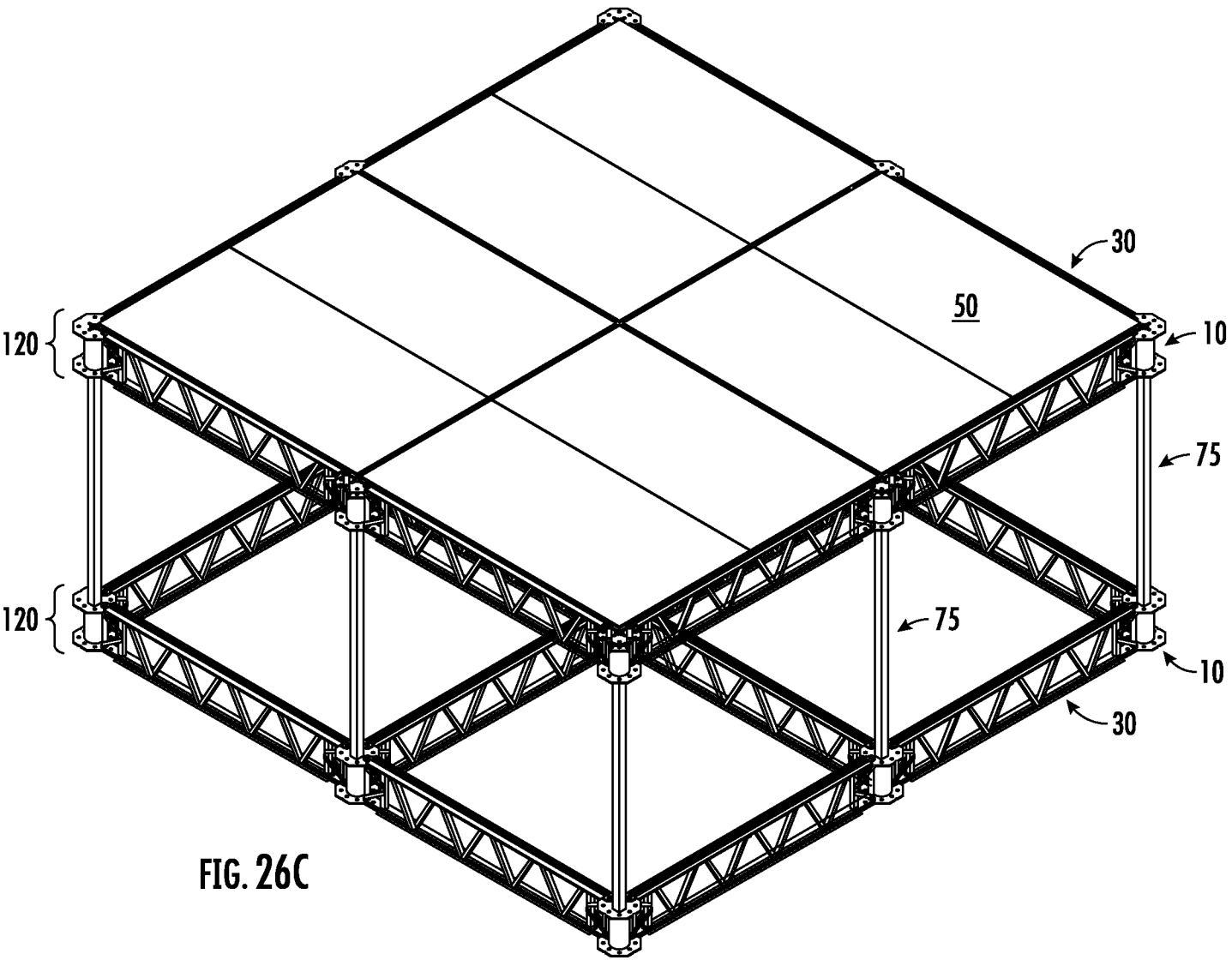
FIG. 26C is an isometric view of a portion of the structure shown in FIG. 26A with the lower work platforms removed and the diagonal chords omitted for clarity, in accordance with embodiments of the present disclosure.
Figure 26D:
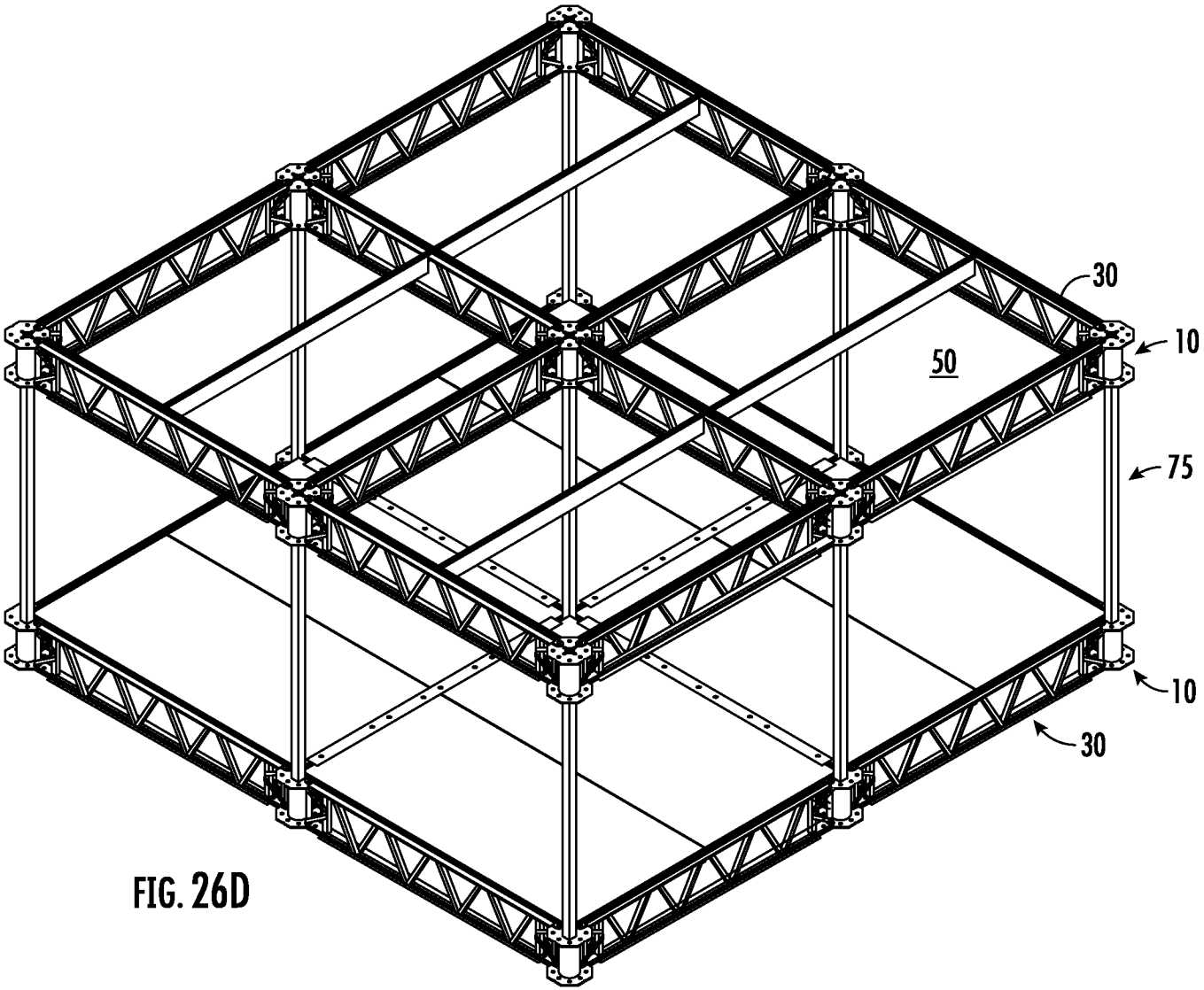
FIG. 26D is another isometric view of a portion of the structure shown in FIG. 26A with the lower work platforms in position and the diagonal chords omitted for clarity, in accordance with embodiments of the present disclosure.
Figure 26E:
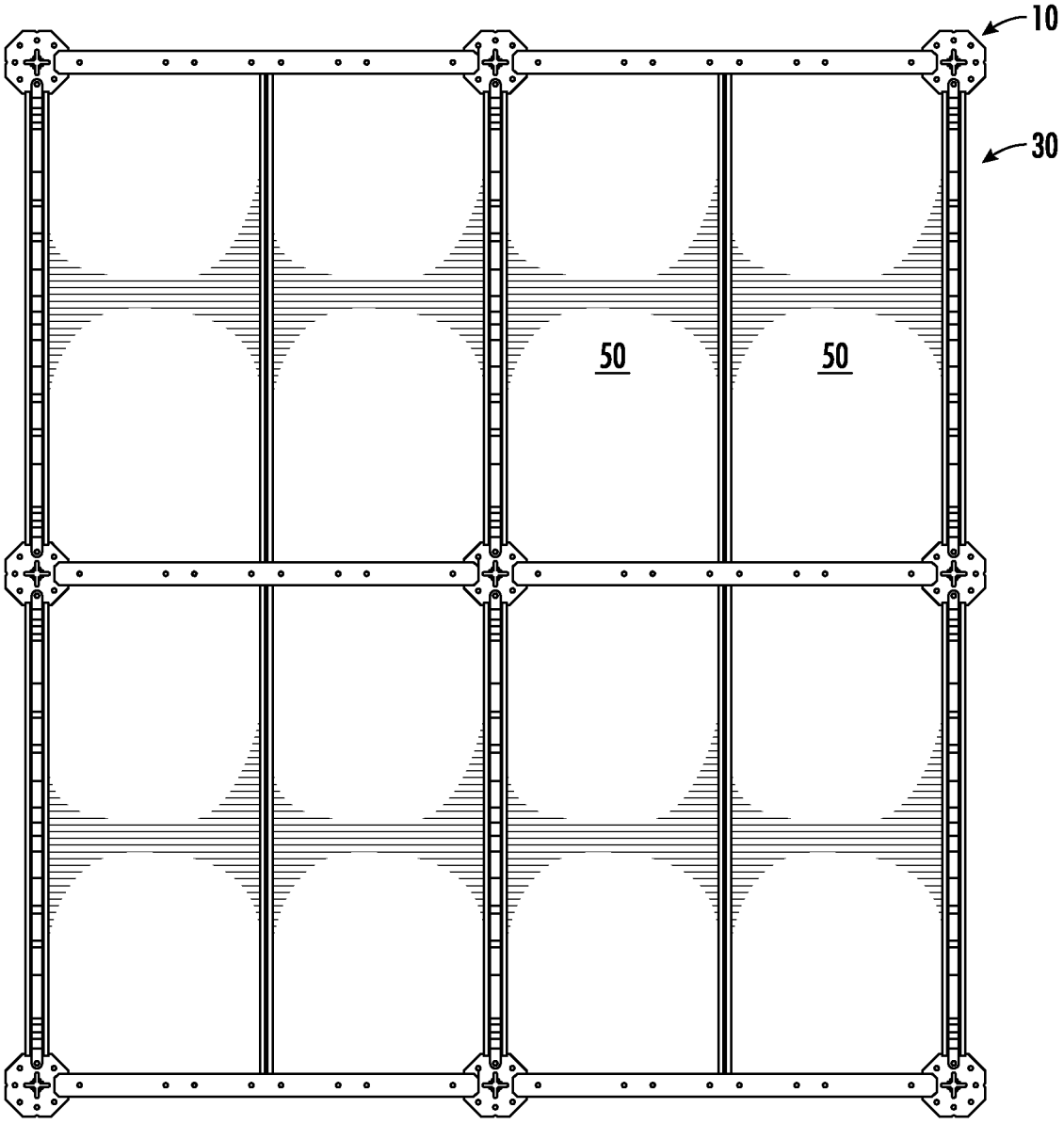
FIG. 26E is a top view of a portion of the structure shown in FIG. 26A with the upper work platforms in translucent and diagonal chords omitted for clarity, in accordance with embodiments of the present disclosure.
Figure 26F:
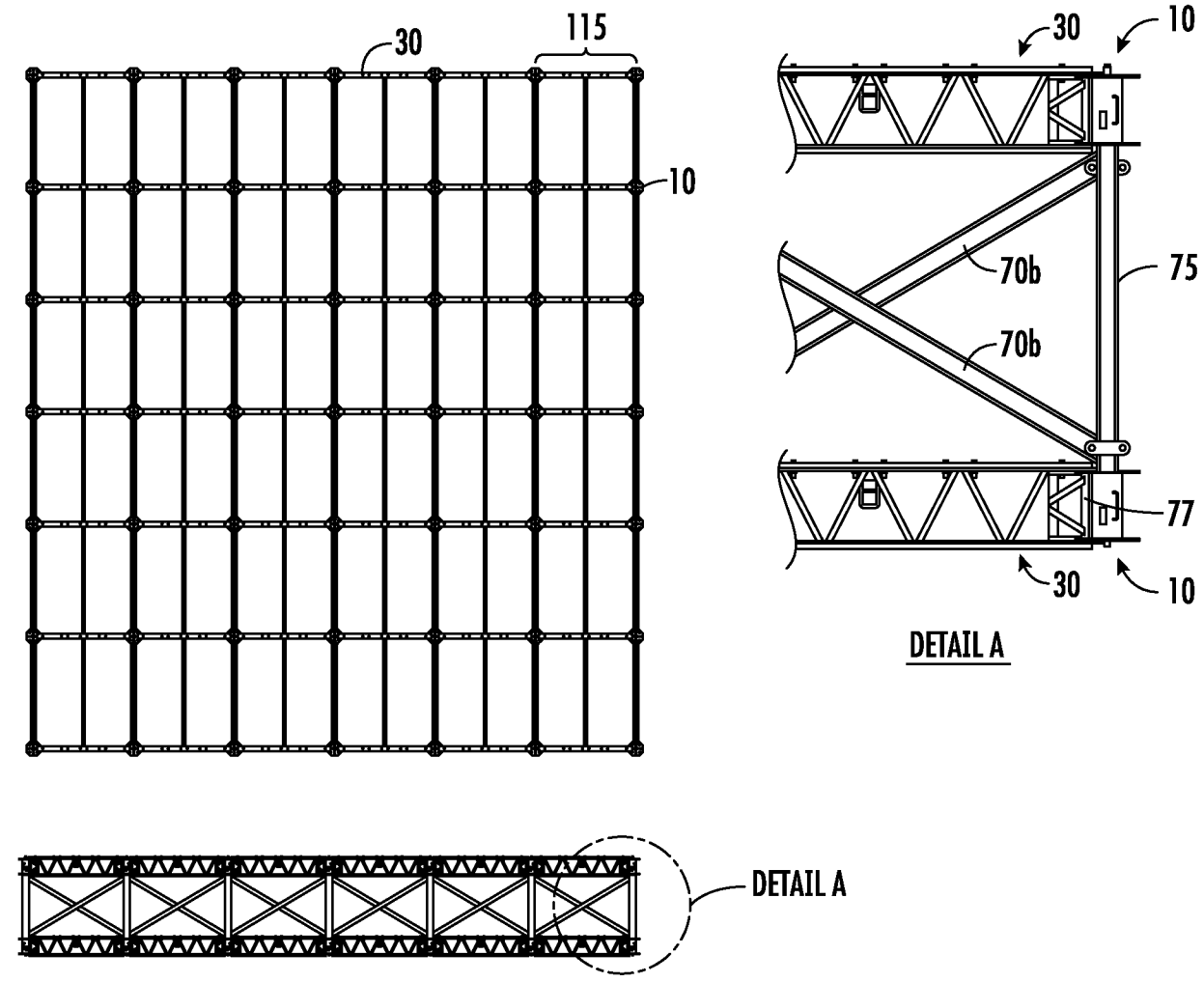
FIG. 26F shows a top view, side view and detailed side view of a portion of the structure shown in FIG. 26A, in accordance with embodiments of the present disclosure.
Figure 27A:
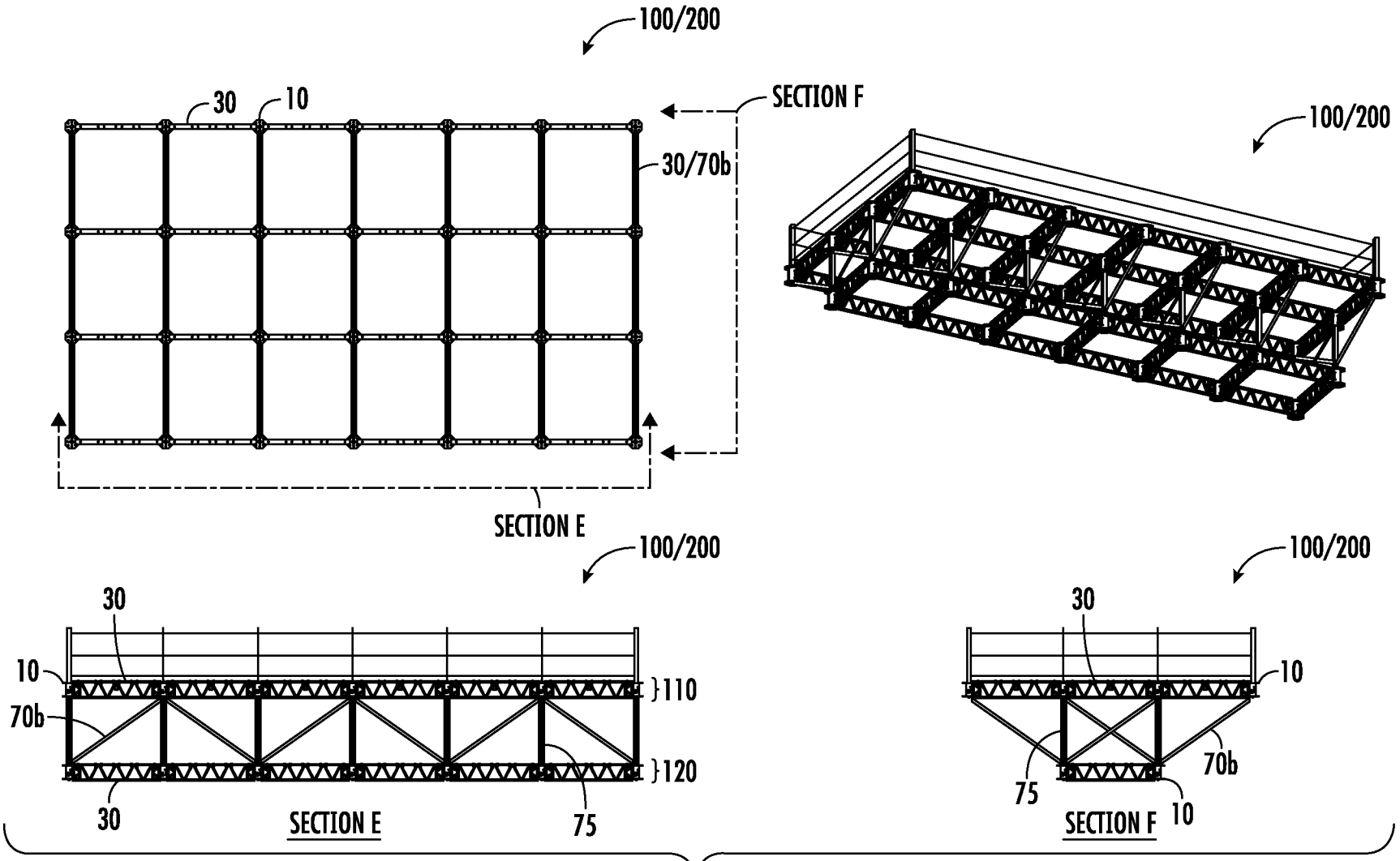
FIG. 27A shows a plan view, isometric view and two section views of another embodiment of a modular space frame support system and resulting work platform system, in accordance with embodiments of the present disclosure.
Figure 27B:
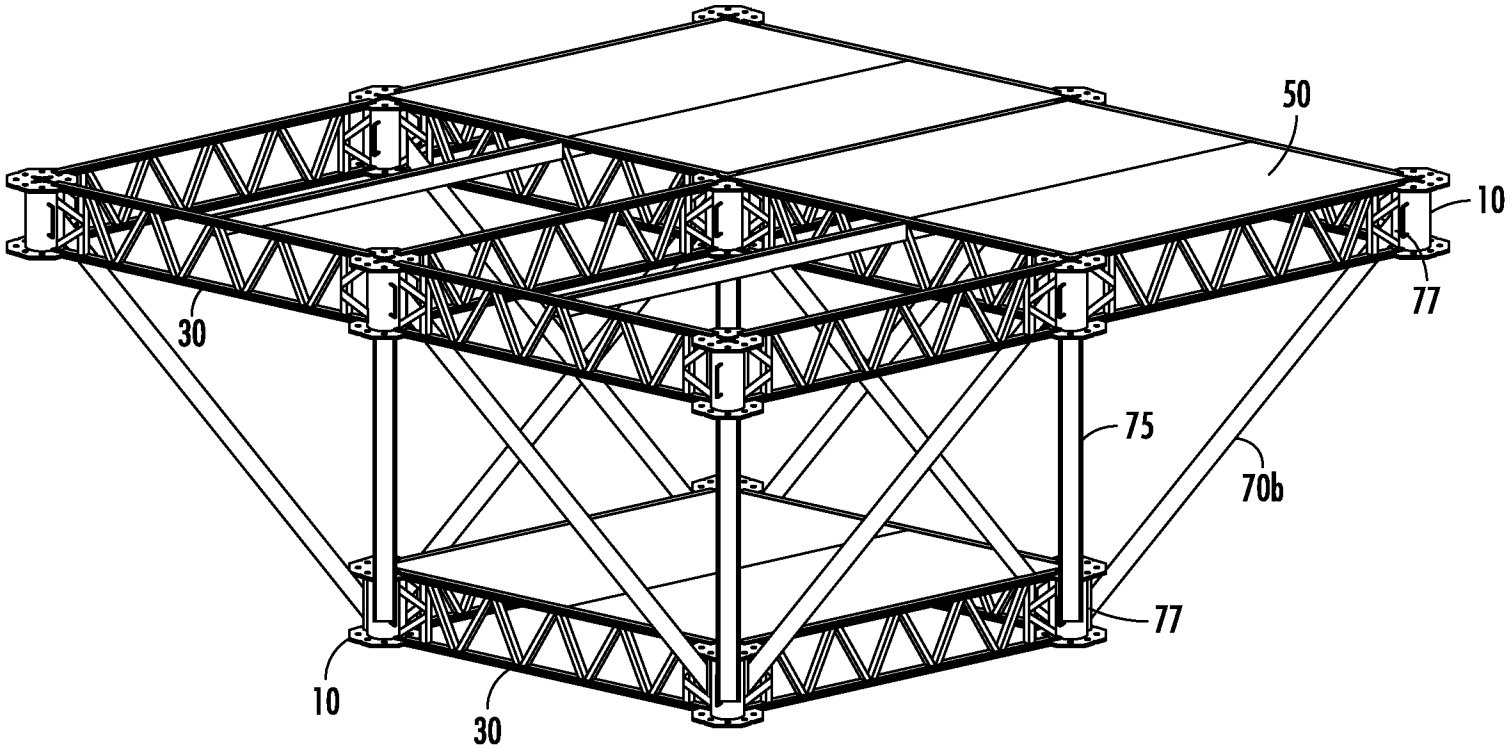
FIG. 27B is an isometric view of the structure shown in FIG. 27B with only a single lower frame unit and four upper frame units for clarity, in accordance with embodiments of the present disclosure.
Figure 27C:
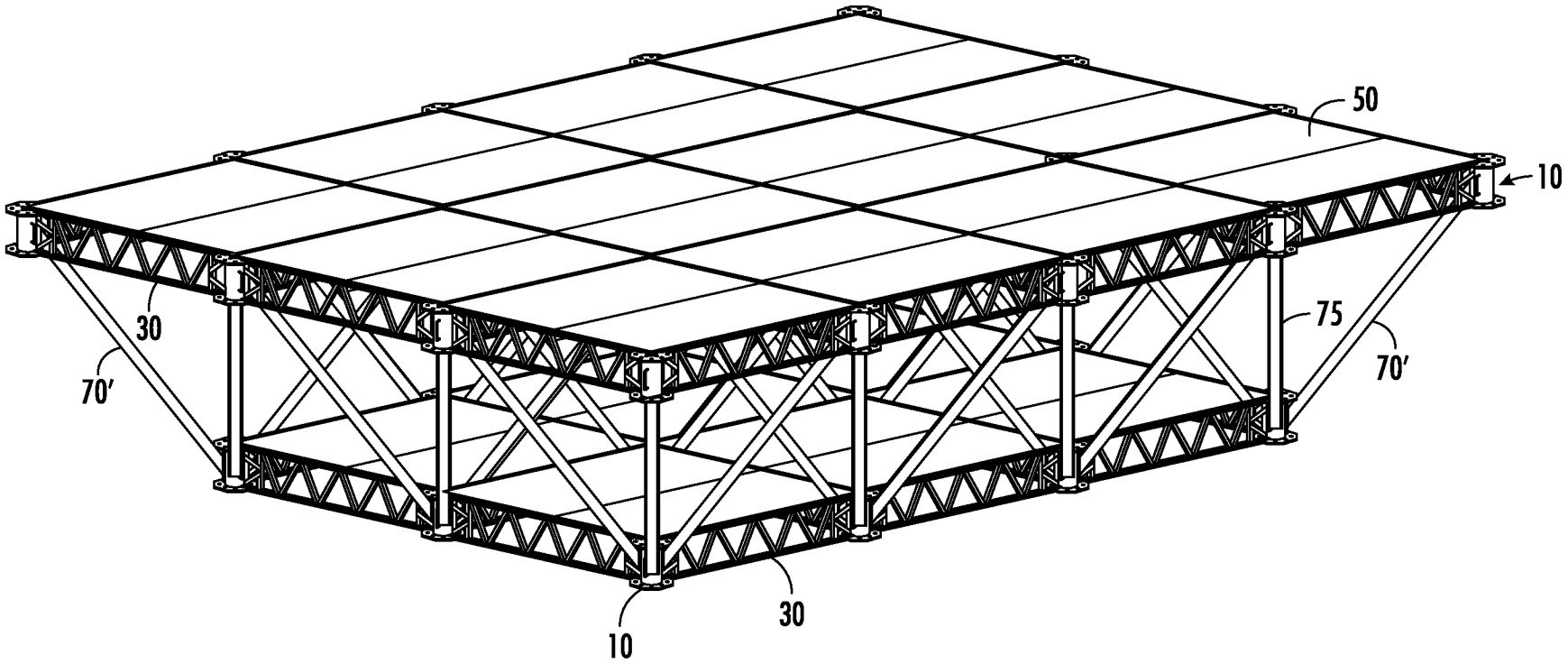
FIG. 27C is an isometric view similar to FIG. 27B using several of the chords of FIGS. 21B and 21C as diagonally-extending chords, in accordance with embodiments of the present disclosure.
Figure 28:
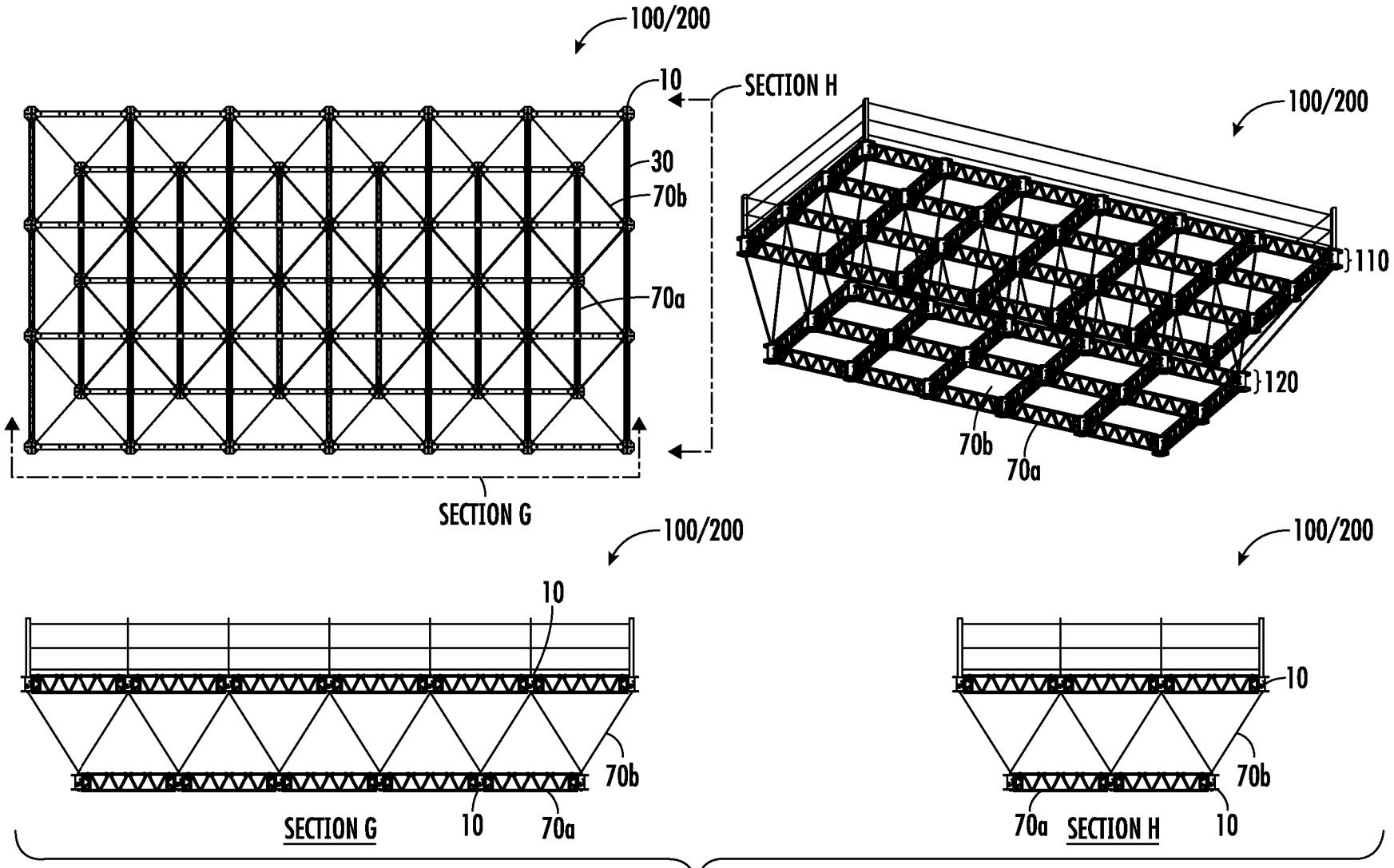
FIG. 28 shows a plan view, isometric view and two section views of another embodiment of a modular space frame support system and resulting work platform system, in accordance with embodiments of the present disclosure.

FIGS. 24A-28 show different exemplary embodiments of modular space frame support system 100 and the resultant work platform systems 200 formed using the modular space frame support systems. Each modular space frame support system 100, and, ultimately, work platform system 200, includes an upper frame 110 and a lower frame 120 connected by at least a plurality of diagonally-positioned chords 70*b*/70'. Moreover, each upper frame 110 of the modular space frame support system 100 of FIGS. 24A-28 is made of a plurality of joists 30 and interconnection structures 10. The lower frame 120, however, in the embodiments shown in FIGS. 24A-27C differs from the lower frame 120 of the embodiment shown in FIG. 28. That is, the lower frame 120 of the embodiments shown in FIGS. 24A-27C is composed of a plurality of joists 30 and interconnection structures 10 in a similar fashion to the respective upper frames 110. In contrast, the lower frame 120 of the embodiment shown in FIG. 28 is composed of a plurality of horizontally-positioned chords 70*a* and interconnection structures 10. In another embodiment, chords 70' may also be used as horizontally-positioned chords.

The building of a frame, generally, whether an upper frame or lower frame, using joists and interconnection structures is discussed in detail above. It will be appreciated that, due to the design of the interconnection structure brackets 77, the chords 70/70' and interconnection structures 10 are articulatable as joists 30 and interconnection structures 10 are, but not readily able to articulate in a cantilevered manner like the joists 30 and interconnection structure 10. A lower frame 120 therefore cannot be articulated into position as described above with reference to FIGS. 15-19, but may, in some instances, be built off an existing structure, such as an existing level of a modular space frame support system 100. In other embodiments, a lower frame 120 may be built "in-the-air" off of an existing upper frame 110. However, in other embodiments, a modular space frame support system 100 containing a lower frame 120 made of horizontal chords 70*a* (or, in an embodiment, 70') and interconnection structures 10 can be built on the ground and hoisted into position either in entirety or piece-by-piece.

Returning to FIGS. 24A-28, shown are, in essence, five different exemplary variations or embodiments of modular space frame support system 100 and the resultant work platform systems 200. In particular, the embodiments shown in FIGS. 24A-27C both the upper frame 110 and lower frame 120 are formed using interconnection structures 10 and joists 30, with chords 70/70' used only as diagonal members 70*b*. In contrast, the embodiment shown in FIG. 28 uses horizontal chords 70*a* and interconnection structures 10 for the lower frame 120 in addition to using chords 70/70' as diagonal members 70*b*. That is, chords 70/70' are both diagonally members 70*b* and horizontal frame members 70*a*. Further, with respect to FIGS. 24A-27C, the arrangement of the lower frame 120 with respect to the upper frame 110 differs. In the embodiments shown in FIGS. 24A-25, the interconnection structures 10 of the lower frames 120 are offset relative to the interconnection structures 10 of the upper frames 110 while in the embodiments shown in FIGS. 26A-27C the interconnection structures 10 of the upper frame 110 and lower frame 120 are positioned directly in line. That is, the interconnection structures 10 of the upper frame 110 of the embodiments shown in FIGS. 26A-27C are directly above the interconnection structure 10 of the lower frame 120.

The embodiment shown in FIGS. 27A-27B differ from the embodiment shown in FIG. 27C only in that the diagonal chords used in FIG. 27C are chords 70', while the chords used in FIGS. 27A-27B are chords 70. However, it will be appreciated that any of the chords 70, 70*a* and 70*b* depicted in any of the FIGS. 24A-28 may be replaced with chords 70'.

Figure 24A:
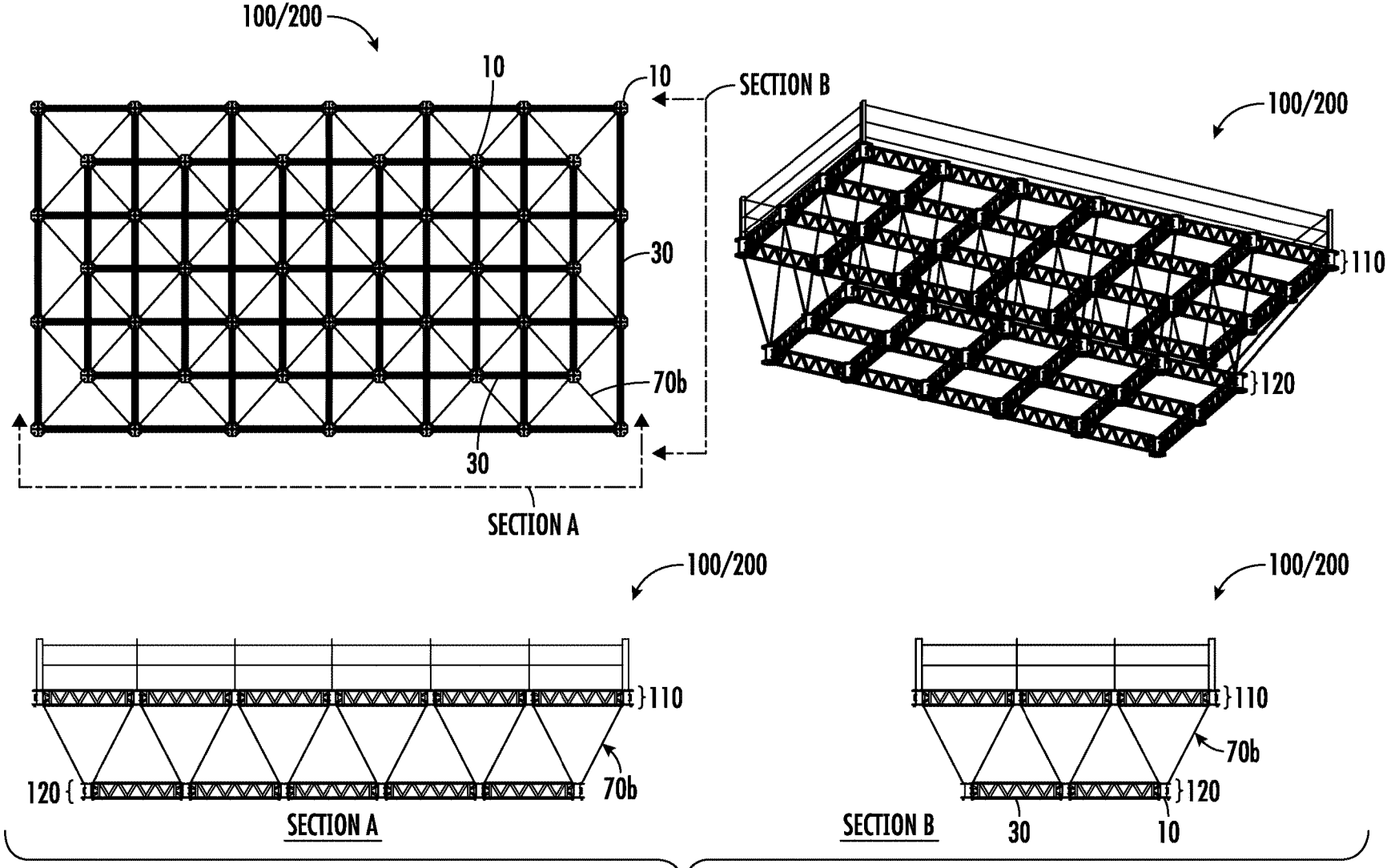
FIG. 24A shows a plan view, isometric view and two section views of an embodiment of a modular space frame support system and resulting work platform system, in accordance with embodiments of the present disclosure.
Figure 24B:
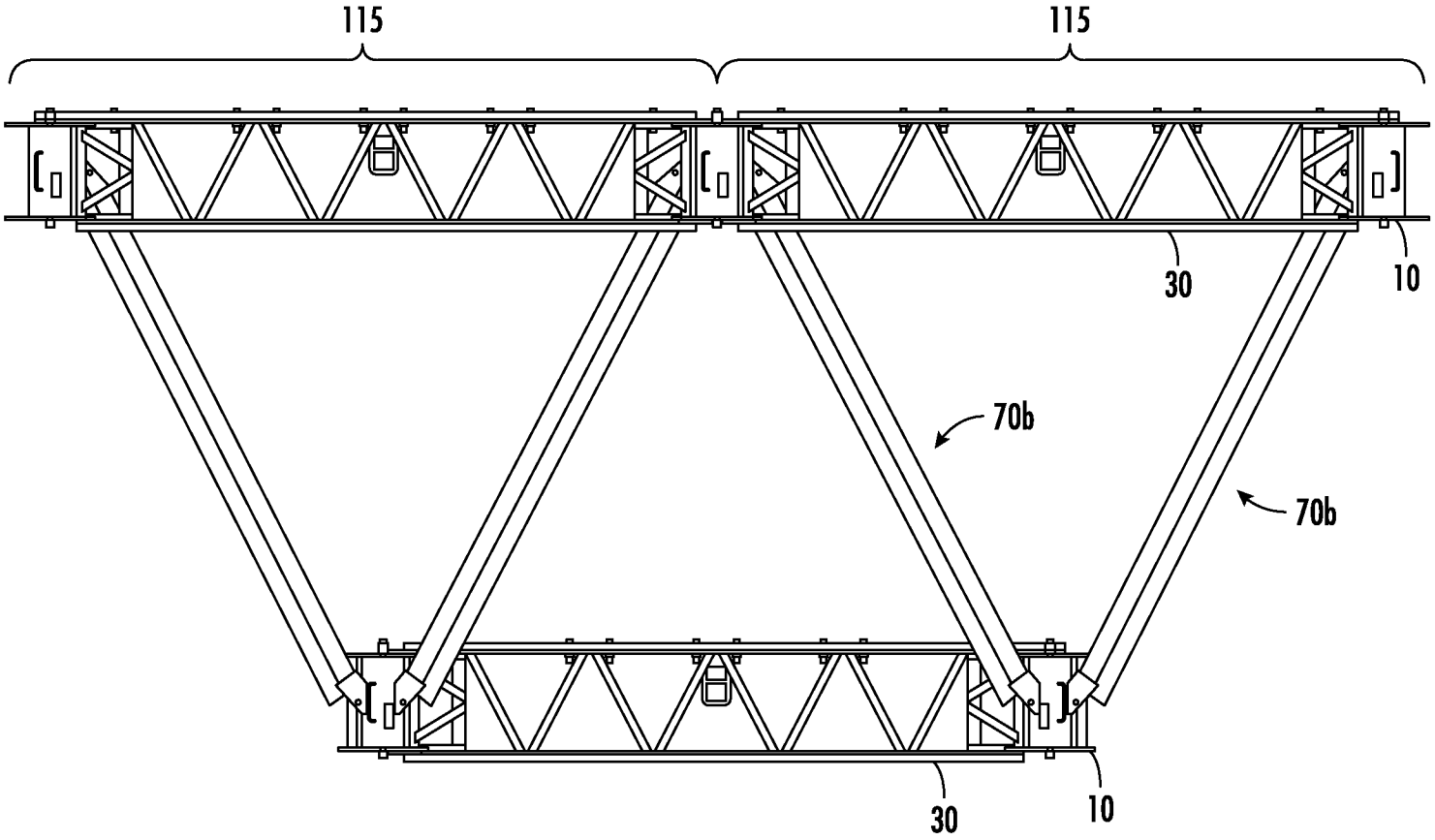
FIG. 24B is a side view of a portion of the structure shown in FIG. 24A, in accordance with embodiments of the present disclosure.
Figure 24C:
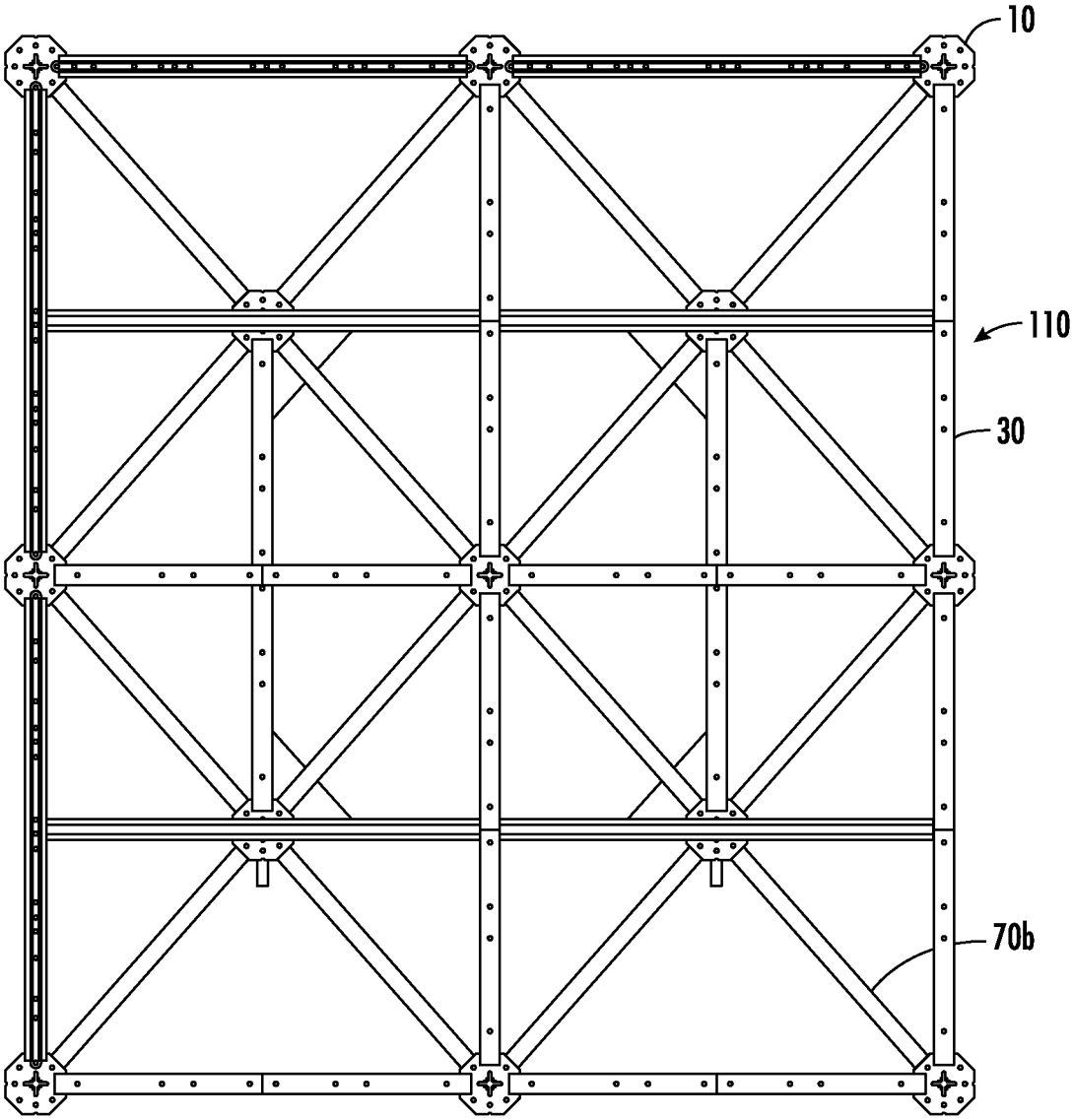
FIG. 24C is a top view of a portion of the structure shown in FIG. 24A with the upper work platforms shown translucent, in accordance with embodiments of the present disclosure.
Figure 24D:
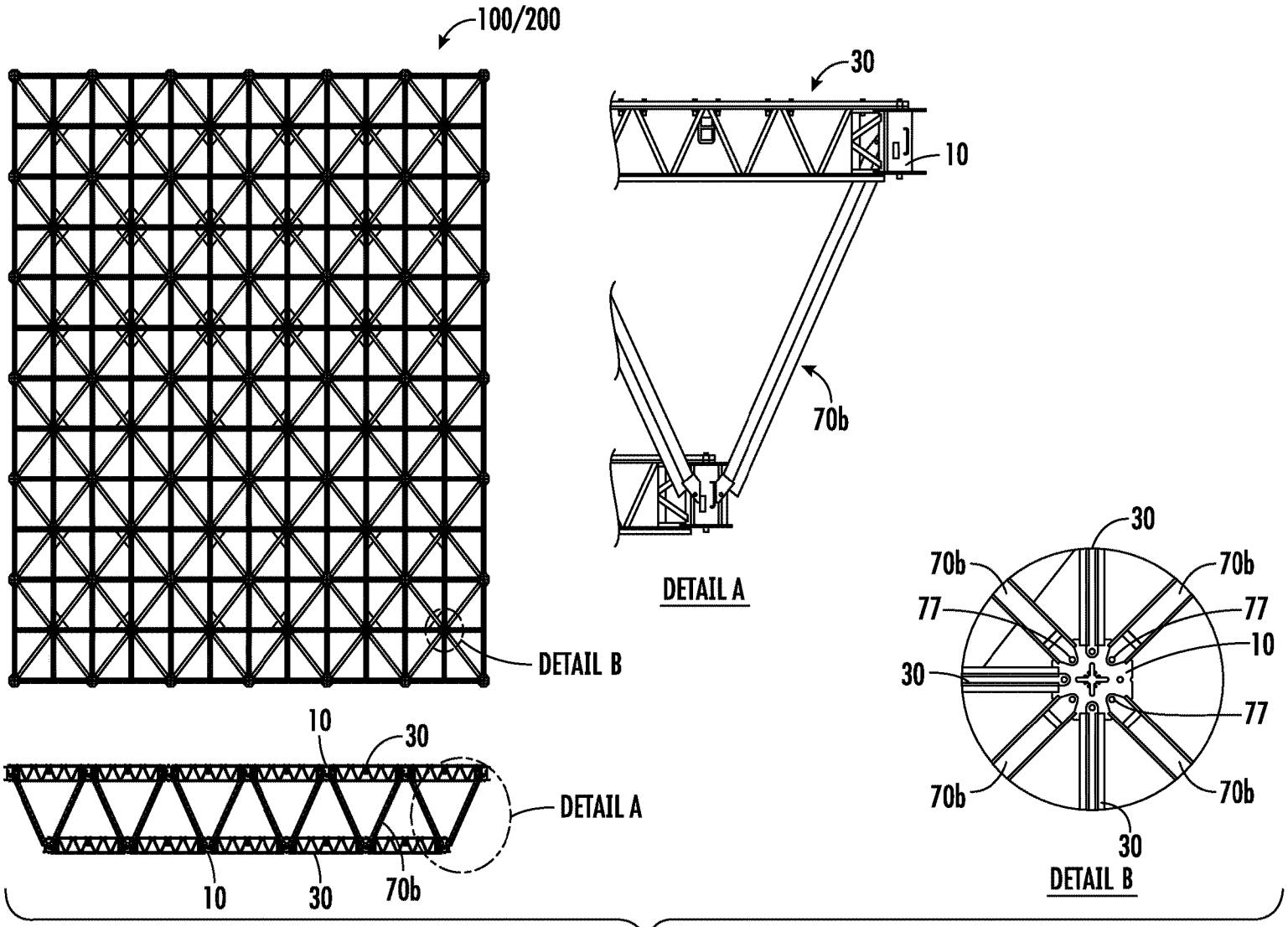
FIG. 24D shows a top view, detailed top view, side view, and detailed side view of a portion of the structure shown in FIG. 24A, in accordance with embodiments of the present disclosure.
Figure 25:
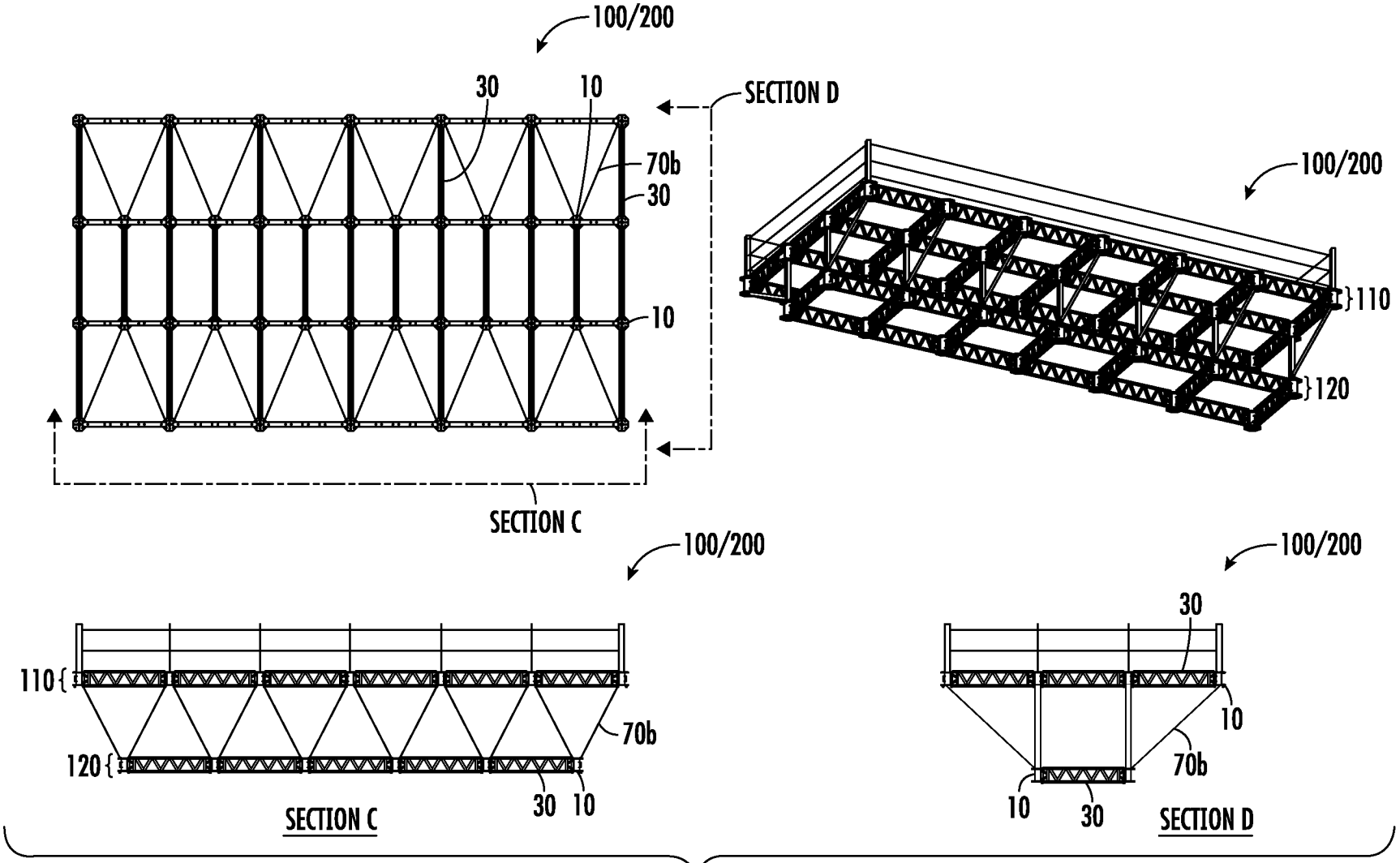
FIG. 25 shows a plan view, isometric view and two section views of another embodiment of a modular space frame support system and resulting work platform system, in accordance with embodiments of the present disclosure.

With respect to the embodiments shown in particular in FIGS. 24A-24D and FIG. 25, in which both the upper frame 110 and lower frame 120 are made using interconnection structures 10 and joists 30 and the interconnection structures of the upper frame 110 and lower frame 120 are offset from one another, the embodiments of FIG. 24A and FIG. 25 differ in the size of the upper frames 110 and lower frames 120 and arrangement of diagonal chords 70*b*. Specifically, in the embodiment shown in FIG. 24A, the lower frame 120 is positioned such that a given interconnection structure 10 of the lower frame 120 is positioned immediately below the center of a given unit 115 of the upper frame 110. In contrast, in the embodiment shown in FIG. 25, the lower frame 120 is positioned such that a given interconnection structure 10 of the lower frame 120 is positioned immediately below the center of a joist 30 of the upper frame 110.

In particular, in accordance with an embodiment of the present disclosure, and as shown in FIGS. 24A-24D, a work platform system 200 is shown with an upper frame 110 having 18 individual sections or units 115 arranged in a 3×6 configuration. The lower frame 120 is composed of 10 individual sections or units 115 arranged in a 2×5 configuration with a given interconnection structure 10 of the lower frame 120 positioned directly below the center of a work platform 50 of the upper frame 110. In other words, the lower frame 120 results is smaller than the upper frame 110 such that the upper frame 110 overhangs the lower frame 120 on all sides. Notwithstanding the particular shape and arrangement of the modular space frame support system 100 and resultant work platform system 200 shown in FIG. 24A, it is understood that the modular space frame support system 100 and resultant work platform system 200 can take a number of shapes, sizes and configurations with the interconnection structures 10 of the lower frame 120 still positioned directly below the center of a work platform 50 of the upper frame 110.

FIGS. 24B-24D illustrate a portion of the modular space frame support system 100 and resultant work platform system 200 consistent with the embodiment shown in FIG. 24A, i.e., a modular space frame support system 100 in which the interconnection structures 10 of the lower frame 120 are positioned directly below the center of a respective work platform 50 of the upper frame 110. In such an embodiment, each interconnection structure 10 of the lower frame 120 is interconnected with four diagonal chords 70*b* and at least two joists 30. In the upper frame 110, each interior interconnection structure 10 is interconnected with four diagonal chords 70*b* and four joists 30, each corner interconnection structure 10 is interconnected with only a single diagonal chord 70*b* and two joists 30, and each side edge interconnection structure 10 is interconnected with two diagonal chords 70*b* and three joists 30.

In contrast, in the embodiment shown in FIG. 25, the lower frame 120 is composed of five individual sections or units 115 in a linear arrangement and the upper frame 110 is composed of 18 individual sections or units 115 in a 3×6 arrangement. As a result, each of the interconnection structures 10 of the lower frame 120 is interconnected with two diagonal chords 70*b* and at least two joists 30, while the interconnection structures 10 of the upper frame 110 are interconnected with zero, one or two diagonal chords 70*b* and at least two joists 30, depending on the location of the interconnection structure 10. In that regard, one of skill in the art will appreciate that the interconnection structures 10 of the lower frame 120 may be interconnected with more than two diagonal chords 70*b* and the interconnection structures 10 of the upper frame 110 may be interconnected with up to four diagonal chords 70*b* if the upper frame 110 and lower frame 120 where widened.

With respect to the embodiments shown in particular in FIGS. 26A-26F and FIGS. 27A-27C, in which both the upper frame 110 and lower frame 120 are made using interconnection structures 10 and joists 30 and the interconnection structures of the upper frame 110 and lower frame 120 are directly aligned with one another, the embodiments of FIG. 26A and FIG. 27A differ in the size of the upper frames 110 and lower frames 120 and arrangement of diagonal chords 70*b*/70'. Specifically, in the embodiment shown in FIG. 26A, the lower frame 120 is the same size as the upper frame 110. In contrast, in the embodiment shown in FIG. 27A, the lower frame 120 is smaller than the upper frame 110 in at least one direction.

In particular, in accordance with an embodiment of the present disclosure, and as shown in FIGS. 26A-26F, a work platform system 200 is shown with an upper frame 110 having 18 individual sections or units 115 arranged in a 3×6 configuration. The lower frame 120 is likewise composed of 18 individual sections or units 115 arranged in a 3×6 configuration such that the interconnection structures 10 of the lower frame 120 are directly underneath a corresponding interconnection structure 10 of the upper frame 110 and the upper frame 110 does not overhang the lower frame 120. Notwithstanding the particular shape and arrangement of the modular space frame support system 100 and resultant work platform system 200 shown in FIG. 26A, it is understood that the modular space frame support system 100 and resultant work platform system 200 can take a number of shapes, sizes and configurations with the interconnection structures 10 of the lower frame 120 still positioned directly below the center of a work platform 50 of the upper frame 110.

FIGS. 26B-26F illustrate a portion of the modular space frame support system 100 and resultant work platform system 200 consistent with the embodiment shown in FIG. 26A, i.e., a modular space frame support system 100 in which the interconnection structures 10 of the lower frame 120 are positioned directly below corresponding interconnection structures 10 of the upper frame 110 and the upper frame 110 does not overhang the lower frame 120. In such an embodiment, each interconnection structure 10 of the lower frame 120 is interconnected to the interconnection structure 10 of the upper frame 110 directly above it by way of a vertical support member 75. The arrangement of diagonal chords 70*b* between the upper frame 110 and lower frame 120 may vary depending on the particular end use of the modular space frame support system 100, but generally, each interconnection structure 10 of the upper frame 110 and lower frame 120 can be interconnected with at least two diagonal chords 10 and at least two joists 30, that is, each corner interconnection structure 10 is interconnected with two joists 30, each outer side interconnection structure 10 is interconnected with three joists 30, and each inner interconnection structure 10 is interconnected with four joists 30.

In contrast, in the embodiment shown in FIGS. 27A-27C, the lower frame 120 is composed of six individual sections or units 115. As illustrated in FIG. 27A, the six individual sections or units 115 are arranged in a linear arrangement and as illustrated in FIG. 27C, the six individual sections or units 115 are arranged in a 2×3 rectangle. In the embodiment shown in FIG. 27A, the upper frame 110 is composed of 18 individual sections or units 115 in a 3×6 arrangement, with the lower frame 120 positioned directly below the middle row of sections or units 115 of the upper frame 110. In the embodiment shown in FIG. 27C, the upper frame is composed of 12 individual sections or units 115 in a 3×4 arrangement, with the lower frame 120 positioned directly below the upper frame 110. As a result, in each embodiment shown, each of the interconnection structures 10 of the lower frame 120 is positioned directly below a respective interconnection structure 10 of the upper frame 110 and interconnects with such respective interconnection structure by way of a vertical support member 75. The arrangement of diagonal chords 70*b*/70' between the upper frame 110 and lower frame 120 may vary depending on the end use of the modular space frame support system 100, but generally, each interconnection structure of the lower frame 120 is interconnected with at least two diagonal chords 70*b*/70' and either two or three joists 30, and each interconnection structure of the upper frame 110 is interconnected with at least one diagonal chord 70*b*/70' and at least two joists 30, that is, each corner interconnection structure 10 is interconnected with two joists 30, each outer side interconnection structure 10 is interconnected with three joists 30, and each inner interconnection structure 10 is interconnected with four joists 30.

In contrast to the embodiments shown in FIGS. 24A-27C, in which both the upper frame 110 and lower frame 120 are constructed using interconnection structures 10 and joists 30, in the embodiment shown in FIG. 28 the lower frame 120 is constructed using only interconnection structures 10 and horizontal chords 70*a*. In such an embodiment, it will be appreciated that work platforms 50 are not secured to the lower frame 120 and a resulting work platform system 200 constructed using the modular space frame support system 100 of the embodiment shown in FIG. 28 will be a single-level work platform system.

In the particular embodiment shown in FIG. 28, the upper frame 110 is composed of 18 individual sections or units 115 made of the interconnection of joists 30 and interconnection structures 10. The lower frame 120 is composed of 10 individual sections or units 115 made of the interconnection of chords 70*a* and interconnection structures 10. The interconnection structures 10 of the upper frame 110 and lower frame 120 are again offset from one another such that no interconnection structure 10 of the lower frame 120 is directly aligned with an interconnection structure 10 of the upper frame 110.

Figure 29:
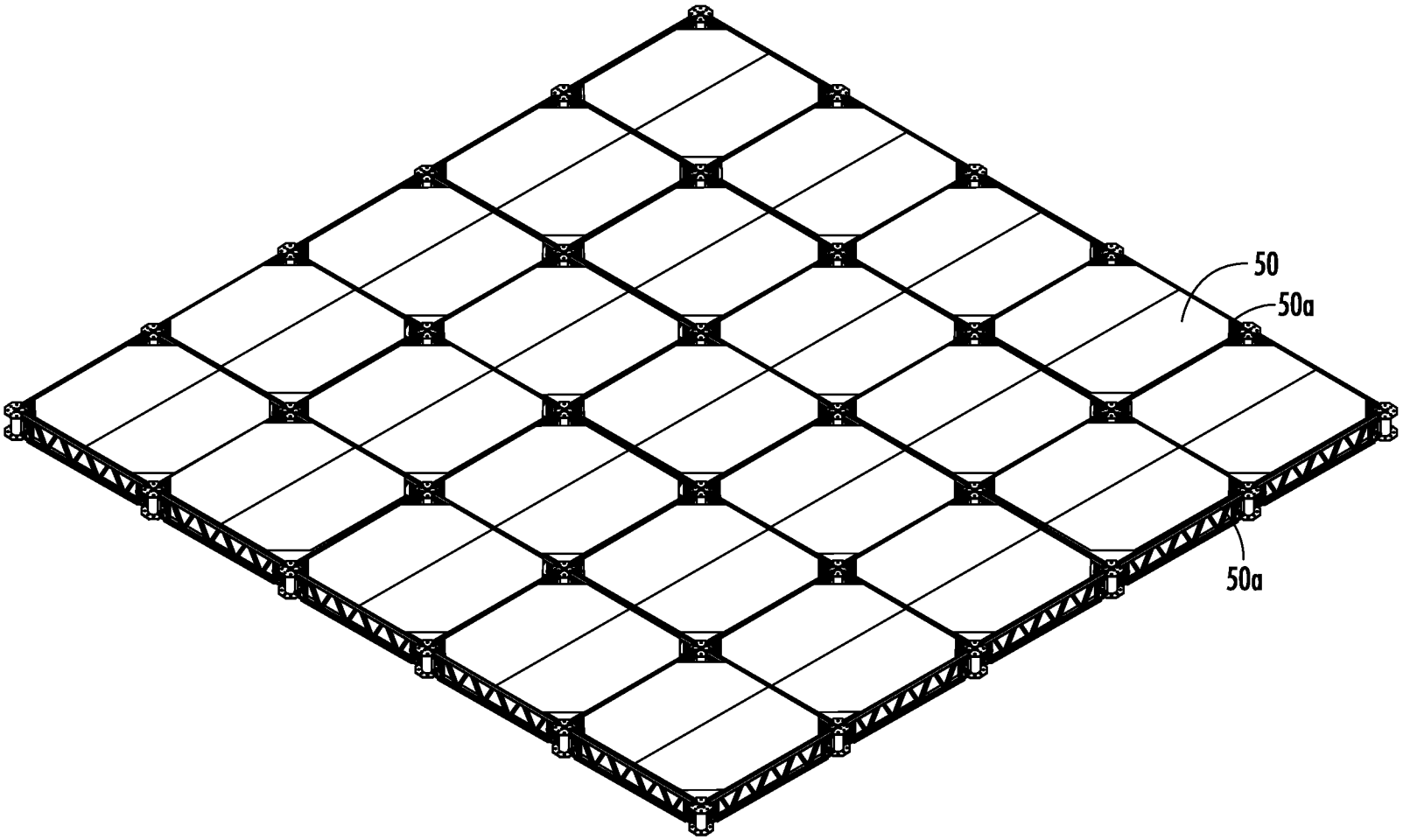
FIG. 29 is an isometric view of a lower frame of a modular space frame support system with work platforms installed, in accordance with embodiments of the present disclosure.

It will be appreciated that, while the upper frame 110 will contain work platform(s) 50 when the modular space frame support system 100 is intended to be used as a work platform system 200, in some embodiments, the lower frame 120, when made using interconnection structures 10 and joists 30, may also include work platform(s) 50 to form a platform on which a worker may be supported. In such embodiments, as shown in FIG. 29, the work platform(s) 50 may have a cutout portion 50*a* at or about the interconnection structures 10 to provide clearance for diagonal chords to attach to the interconnection structures 10 as shown, for example, in FIG. 27B.

While the modular space frame support systems 100 described herein are described in relation to chords 70, it is understood that one or more chords 70' may be used.

Additional Components

Figure 30C:
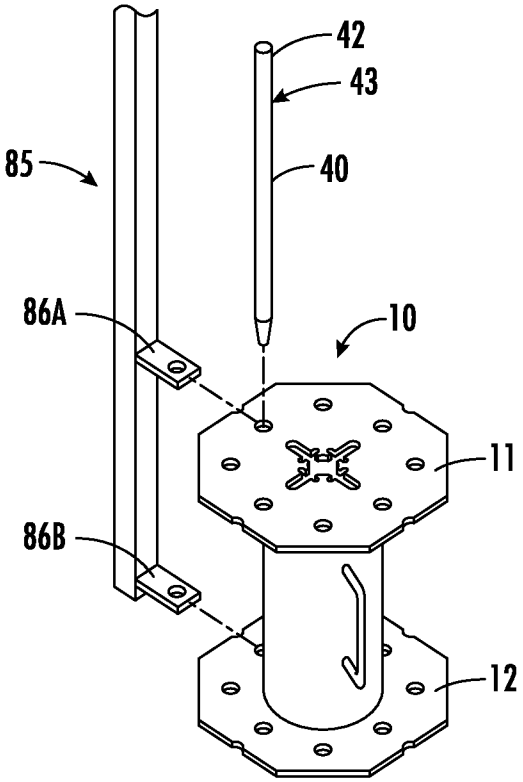
FIG. 30C is an exploded view of FIG. 30B, in accordance with the present disclosure.
Figure 30B:
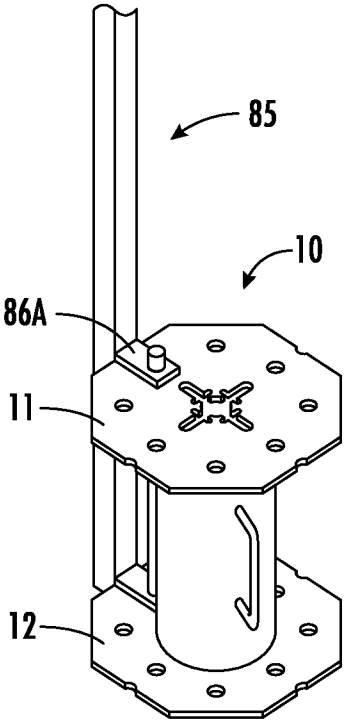
FIG. 30B is a close-up of FIG. 30A, in accordance with the present disclosure.
Figure 30A:
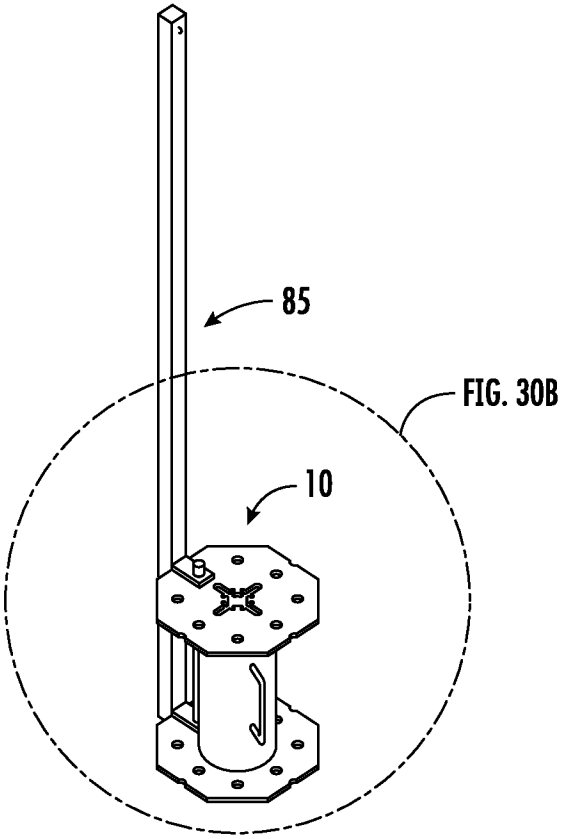
FIG. 30A is a top perspective view of an interconnection between an interconnection structure and a railing standard, in accordance with the present disclosure.

In some embodiments, a railing can be connected to an upper frame 110 and/or lower frame 120 of a work platform system 200, such as shown in FIGS. 30A-31C. In particular, FIGS. 30A through 31C show various connection details as to how a railing system can be attached to an upper frame 110 or lower frame 120 as described herein. FIGS. 30A, 30B and 30C show the interconnection between a railing standard 85 and the interconnection structure 10. The railing standard 85 is typically elongate and includes a first flange 86A, and a second flange 86B extending therefrom for connection to the interconnection structure 10. The first flange 86A has a hole in it, as does the second flange 86B. By leading the pin 40 through the upper flange 86A, then through holes 13 in the top element 11 down through the lower flange 86B, and then through the holes 14 in the bottom element 12 an installer is able to attach the railing standard 85 to the interconnection structure 10 of the modular space frame support system 100. The pin 40 can include various devices, such as roll pins 42 and a holding loop 43. In this manner, a plurality of railing standards 85 may be attached to a plurality of interconnection structures 10, creating a railing system around a work platform system 200.

Figure 31C:
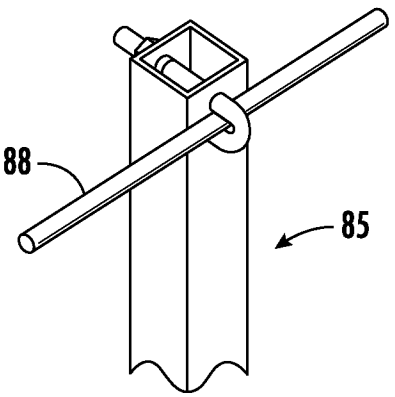
FIG. 31C is a close up top perspective view of an interconnection between a railing standard and railing, in accordance with the present disclosure.
Figure 31B:
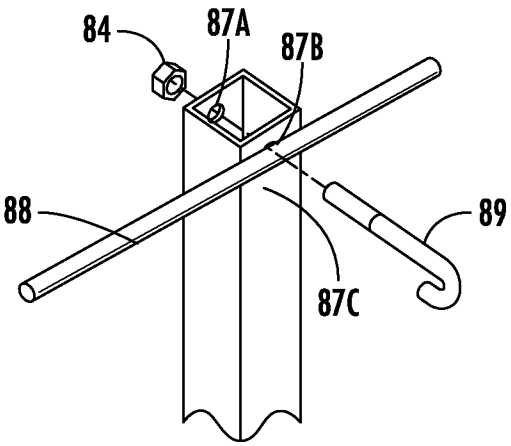
FIG. 31B is an exploded view of FIG. 31C, in accordance with the present disclosure.
Figure 31A:
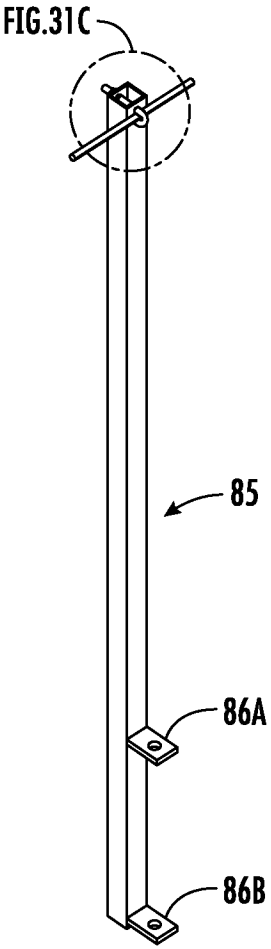
FIG. 31A is a top perspective view of a railing standard and railing, in accordance with the present disclosure.

FIGS. 31A, 31B, and 31C depict various views of a railing standard 85 and its interconnection with a railing 88. The railing 88 can be a variety of materials, such as chain, cable, line, and the like. For example, the railing 88 may be galvanized aircraft cable. The railing standard 85 includes a plurality of holes 87. As the exploded view in FIG. 31B shows, a J-bolt 89 may be used with a nut 84 to attach the railing 88 to the railing standard 85. In an embodiment, an additional railing 88 may be added at the midpoint of the railing standard 85. In other embodiments, the railing standards 85 can also be used to erect a work enclosure system. For example, tarps, sheeting, or the like could be attached to the railing standards 85 to enclose the work area for painting, demolition, asbestos or lead paint abatement, and similar activities where the workers do not want any escape of fumes, paint, hazardous materials, debris, etc. from the work area.

In one particular embodiment, a modular space frame support system 100 comprises an upper frame and a lower frame. The upper frame comprises at least a first interconnection structure connected in fixed relation to a second interconnection structure using a first joist; a second joist connectable to the first interconnection structure, wherein, when connected, the second joist is pivotable relative to the first joist from a first position or collapsed position to an extended or final position; a third joist connectable to the second interconnection structure, wherein, when connected, the third joist is pivotable relative to the first joist from a first position or collapsed position to an extended or final position; a third interconnection structure connected in fixed relation to the second joist; a fourth interconnection structure connected in fixed relation to the third joist; and a fourth joist connecting the third interconnection structure and the fourth interconnection structure. In an embodiment, at least one of the first, second, third and fourth joists is connectable with at least one of the respective interconnection structures using a pin. In an embodiment, the pivoting of at least one of the second or third joists is restricted by at least a portion of a work platform when the work platform is positioned with respect to the first and second interconnection structures and the first, second and third joists in the extended or final position. The lower frame also comprises at least a first, second, third and fourth interconnection structure and at least a first, second, third and fourth joist, connected as described with reference to the upper frame.

The upper frame and lower frame are connected to one another by at least one of a diagonal chord and a vertical support. In an embodiment, the upper frame is connected to the lower frame by a plurality of diagonal chords, each of which is secured at one end to an interconnection structure of the upper frame and at a second end to an interconnection structure of the lower frame. In an embodiment, the diagonal chords are connected to the interconnection structures using an interconnection structure bracket. In an embodiment, the upper frame and lower frame are connected to one another using both at least one diagonal chord and at least one vertical support.

In an embodiment, the modular space frame support system is a two-level structure.

In an embodiment, the modular space frame support system is a two-level structure having at least one level configured as a work platform. In another embodiment, both levels are work platforms.

In an embodiment, the modular space frame support system has a section of greater than 1 foot, or greater than 3 feet, or greater than or equal to 5 feet. In an embodiment, the modular space frame support system has a section of from greater than 1 foot, or greater than 3 feet, or greater than or equal to 5 feet, to 6 feet, or 7 feet, or 8 feet, or 9 feet, or 10 feet.

In an embodiment, the modular space frame support system has a span capacity of greater than 20 feet, or greater than 50 feet, or greater than 60 feet, or greater than 70 feet, or greater than 80 feet to 100 feet.

In an embodiment, the modular space frame support system has a dead load capacity of greater than 2 pounds per square foot, or greater than 3 pounds per square foot, or greater than 5 pounds per square foot to 7 pounds per square foot.

Method of Erecting a Modular Space Frame Support System

When erecting a modular space frame support system and forming a resulting work platform system as disclosed herein, it is possible to assemble the entire modular space frame support system (and resulting work platform system) on the ground and hoist the system into position to suspend from an overhead structure or otherwise secure to an existing structure, e.g., an existing portion of a support frame or work platform system, building, or other structure. However, as discussed above herein, the specific design of the interconnection structures 10 and joists 30 permits for free articulation of the interconnection structures 10 and joists 30 and provides for assembly of frame sections or units 115 in the air off of an existing structure, such as discussed in detail with reference to FIGS. 15-19.

Figure 32A:
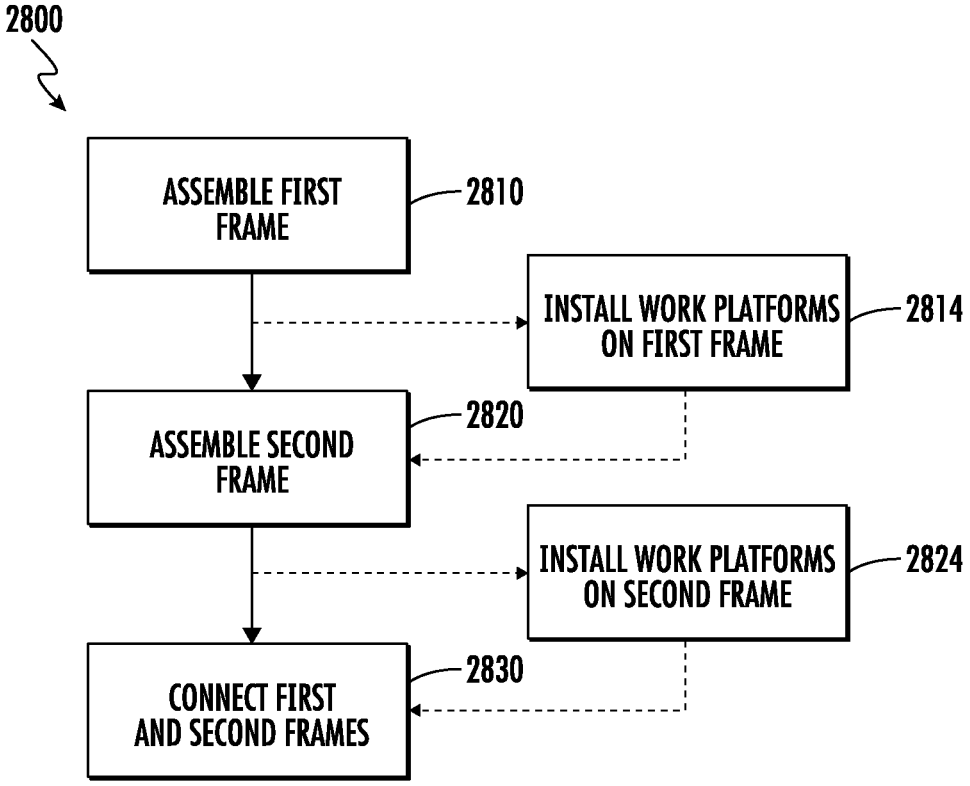
FIG. 32A is a flow chart of an exemplary assembly method for a modular space frame support system, in accordance with embodiments of the present disclosure.

FIG. 32A is a flow chart illustrating a general method 2800 for assembling/erecting a modular space frame support system (and, ultimately, work platform system). In general, when erecting a modular space frame support system as disclosed herein, a first frame comprising a plurality of interconnection structures and joists is assembled (2810). In some embodiments, this first frame can be assembled on the ground. In other embodiments, this first frame can be assembled in the air, as described in detail above. A second frame is then assembled (2820) either above or below the first frame, depending on the construction of the second frame, and connected with the first frame by way of one or more diagonal chords and/or vertical supports. In an embodiment in which the second frame is composed of a plurality of interconnection structures and chords, the second frame will be the lower frame and the first frame will be the upper frame. In an embodiment in which the second frame is composed of a plurality of interconnection structures and joists, the second frame can be either the upper or lower frame. As described in further detail below, however, when the modular space frame support system is assembled in the air, with both the upper frame and lower frame composed of a plurality of interconnection structures and joists, the first frame assembled is the lower frame and the second frame assembled is the upper frame.

When chords are used in the assembly of a second frame, i.e., chord are used as horizontal chords, the second frame cannot be articulated and cantilevered into place, as discussed in further detail above. The components of a second frame when made using chords in place of joists must therefore be assembled component by component and in position. In one embodiment, therefore, the chords are in accordance with chords 70 and secured to interconnection structures by simply securing a first end of the chord to a first interconnection structure and then securing a second end of the chord to a second interconnection structures.

In another embodiment in which chords 70' are used in place of joists in assembling a second frame, the chords 70' may be secured to interconnection structures step-wise as discussed in detail above. In another embodiment, a chord 70' is provided in a first position having a length less than the final length needed. Once the chord 70' is in position, the chord sections 70*a*' and 70*b*' are extended to form a chord 70' having the length needed and the ends are secured to the respective interconnection structures. Further still, in an embodiment in which chords 70' are used in place of joists in assembling a second frame, a chord subassembly composed of a first chord section 70*a*' and a connecting portion 70*c*' is secured to a first interconnection structure. The chord subassembly is provided in a first position corresponding to a length less than the greatest length obtainable with the chord subassembly. A second chord section 70*b*' is connected to a second interconnection structure. The chord subassembly is then extended until it is connectable to the second chord section 70*b*' and the completed chord 70' is then formed.

In some embodiments, and particularly those in which the modular space frame support system will be used as a work platform system, work platforms may be installed on the first and/or second frames, depending on the particular construction of the first and second frames (2814, 2824). As described above, work platforms are generally installed only on frames constructed from interconnection structures and joists. In other words, frames made using interconnection structures and chords do not support work platforms.

The first and second frames are then secured to one another (2830). To secure the first and second frames with respect to one another, at least one diagonal chord, vertical support or combination thereof is secured at a first end to the first frame and at a second end to the second frame. In an embodiment, when one or more diagonal chords is used, the diagonal chord/s are secured to interconnection structures of the upper frame and lower frame by way of an interconnection structure bracket.

The specific way in which diagonal chords are secured to the first and second frames will vary based on the design of the chord, i.e., either chord 70 or chord 70'. When a chord 70 is used, the chord 70 is simply secured at a first end to a first interconnection structure on either the first frame or the second frame, and the second end is then secured to a second interconnection structure on the other of the first frame or second frame. When a chord 70' is used, the chord 70' may be held in position with a length less than that required and lengthened once in position to secure a first end to a first interconnection structure of either the first frame or the second frame and a second end to a second interconnection structure of the other of the first frame or the second frame. Alternatively, a chord subassembly composed of a first chord section and a connecting section may be secured to a first interconnection structure on either the first frame or the second frame in a position such that the length of the chord subassembly is less than its maximum length, and a second chord section is secured to a second interconnection structure on the other of the first frame or second frame. The chord subassembly is then extended or lengthen to meet with and connect to the second chord section.

Figure 32B:
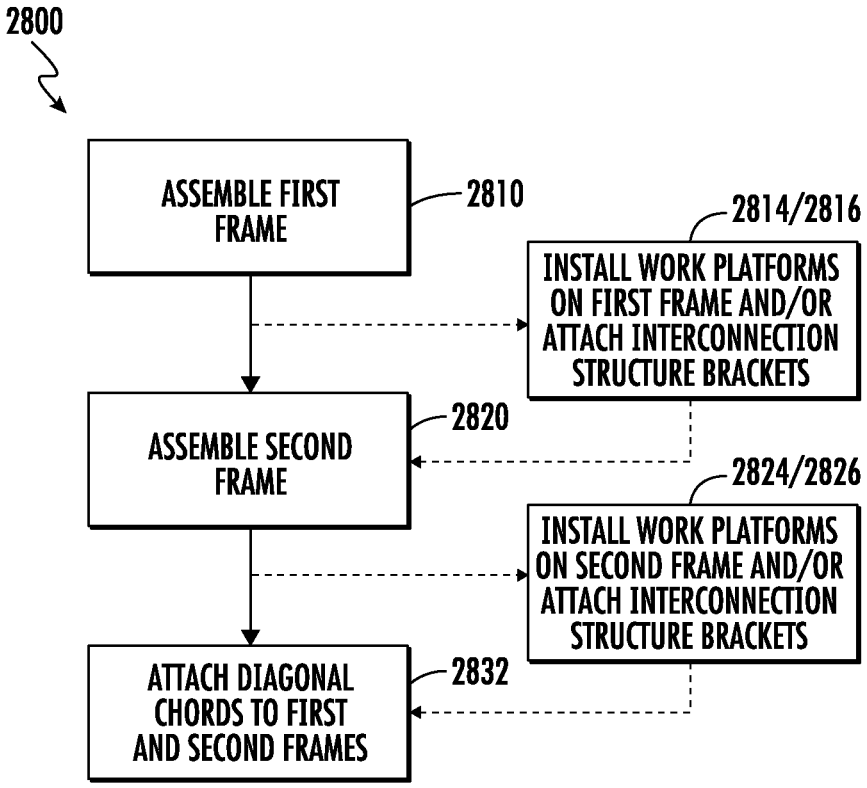
FIG. 32B is a flow chart of another exemplary assembly method for a modular space frame support system, in accordance with embodiments of the present disclosure.
Figure 32C:
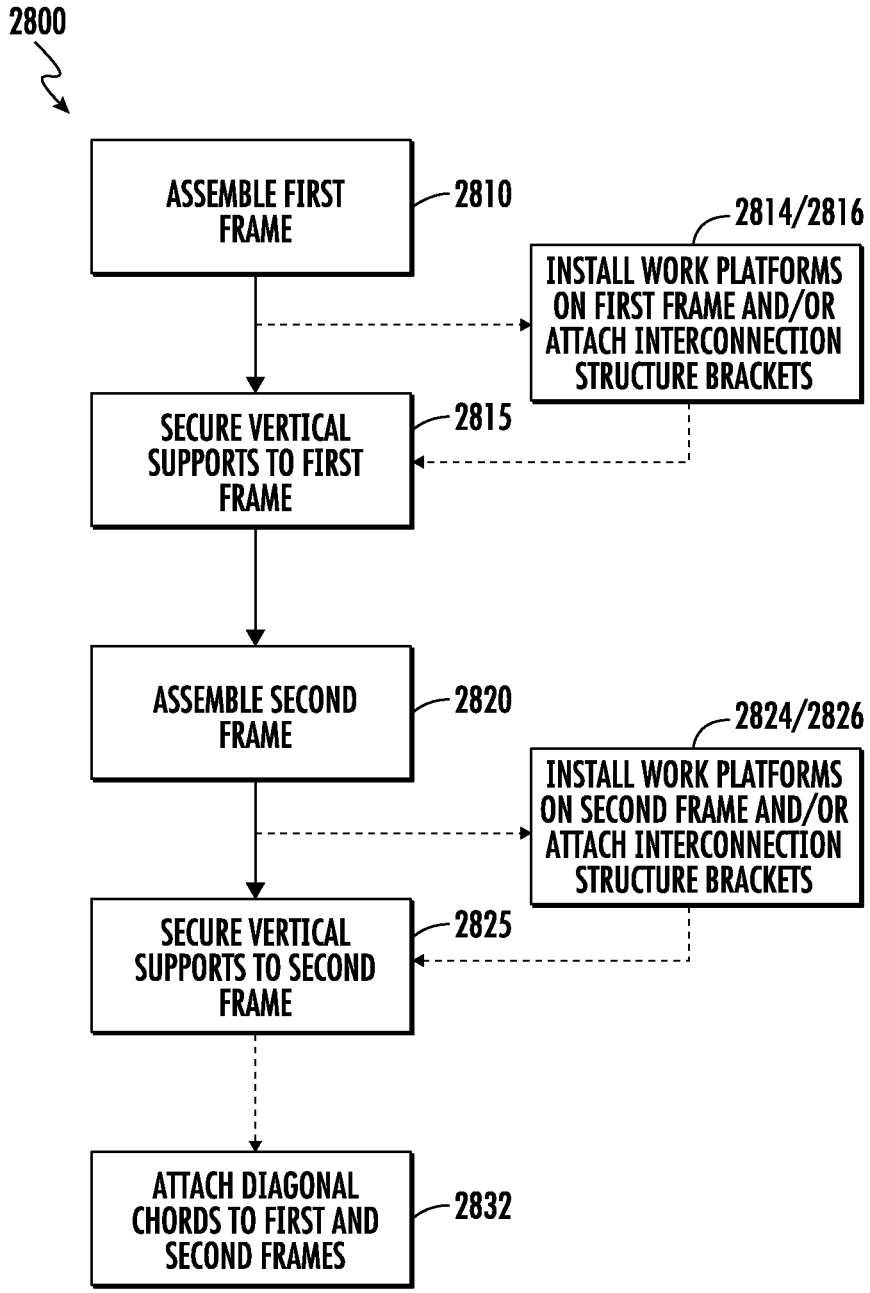
FIG. 32C is a flow chart of another exemplary assembly method for a modular space frame support system, in accordance with embodiments of the present disclosure.

Again, it will be appreciated that the particular structure of the first and second frames can influence the steps in assembling/erecting a modular space frame support system. For example, FIGS. 32B and 32C are flow diagrams illustrated the generalized method for assembling/erecting a modular space frame support system when the type of connection between the first and second frames changes. That is, the method shown in FIG. 32B uses diagonal chords only to connect the first and second platforms, while the method shown in FIG. 32C uses vertical supports to connect the first and second platforms.

In the particular embodiment shown in FIG. 32B, a first frame is assembled (2810), the a second frame is assembled (2820) and the diagonal chords are attached between the first and second frames (2832). In an embodiment, the step of attaching diagonal chords between the first and second frames is according to any of the exemplary methods described above with relation to chord 70 and chord 70'.

Optionally, after the first frame is assembled, work platforms can be installed on the first frame (2814) and interconnection structure brackets can be installed on the interconnection structures of the first frame (2816) if such brackets are being used to secure the diagonal chords. Similarly, after the second frame is assembled, work platforms can optionally be installed on the second frame (2824) and interconnection structure brackets can be installed on the interconnection structures of the second frame (2826).

The method of FIG. 28C, in which vertical supports are used, differs in that a first end of the vertical supports is connected to the interconnection structures of the first frame (2815) after assembly of the first frame (2810) and a second end of the vertical supports is connected to the interconnection structures of the second frame (2825) after assembly of the second frame (2820). As shown, the steps of installing work platforms on the first frame (2814), attaching interconnection structure brackets to the interconnection structures of the first frame (2816), installing work platforms on the second frame (2824), attaching interconnection structure brackets to the interconnection structures of the second frame (2826) and attaching diagonal chords to the first and second frames (2832) are optional steps.

Again, it will be understood that the chords used as diagonal chords to secure a first frame and a second frame may be in accordance with any embodiment or combination of embodiments described herein.

In an embodiment a diagonal chord is in accordance with chord 70. When a chord 70 is used, the chord 70 is simply secured at a first end to a first interconnection structure on either the first frame or the second frame, and the second end is then secured to a second interconnection structure on the other of the first frame or second frame.

In an embodiment, a diagonal chord is in accordance with chord 70. When a chord 70' is used, the chord 70' may be held in position with a length less than that required and lengthened once in position to secure a first end to a first interconnection structure of either the first frame or the second frame and a second end to a second interconnection structure of the other of the first frame or the second frame. Alternatively, a chord subassembly composed of a first chord section and a connecting section may be secured to a first interconnection structure on either the first frame or the second frame in a position such that the length of the chord subassembly is less than its maximum length, and a second chord section is secured to a second interconnection structure on the other of the first frame or second frame. The chord subassembly is then extended or lengthen to meet with and connect to the second chord section.

It will be appreciated that, while the steps of installing work platforms on the first and second frames (2814, 2824) and attaching interconnection structure brackets to interconnection structures of the first and second frames (2816, 2826) occur between the assembly of the respective first and second platforms (2810, 2820) and the securing of the vertical supports to the respective first and second platforms (2815, 2825), the installing of work platforms (2814, 2824) and attaching of interconnection structure brackets (2816, 2826) can also occur after the vertical posts are secured in place (2815, 2825).

In a particular embodiment, and with reference to FIGS. 32D and 32E, a work platform system 200 having both an upper frame 110 and lower frame 120 composed of interconnection structures 10 and joists 30 (no chords) is assembled as follows.

In a first step 2810, the lower frame 120 is assembled as described with reference to FIGS. 15-19 and (optionally) secured with suspension connectors (2812) as described in more detail following. Depending on the particular arrangement of the upper and lower frames 110, 120, e.g., whether the interconnection structures will be offset or aligned with one another, after the first frame is assembled, a plurality of interconnection structure brackets may be attached to the interconnection structures of the lower frame (2816) and/or a plurality of vertical supports attached to interconnection structures of the lower frame (2815).

In a particular embodiment, work platforms are also installed on the first (lower) frame (2814) so that the lower frame 120 can be used as a platform for erecting the upper frame. In such an embodiment, using the lower frame 120 as a work platform system, the upper frame 110 is built (2820) above the lower frame 120 as described with reference to FIGS. 15-19, and, as described in further detail below, secured with suspension connectors (2822).

Figure 32D:
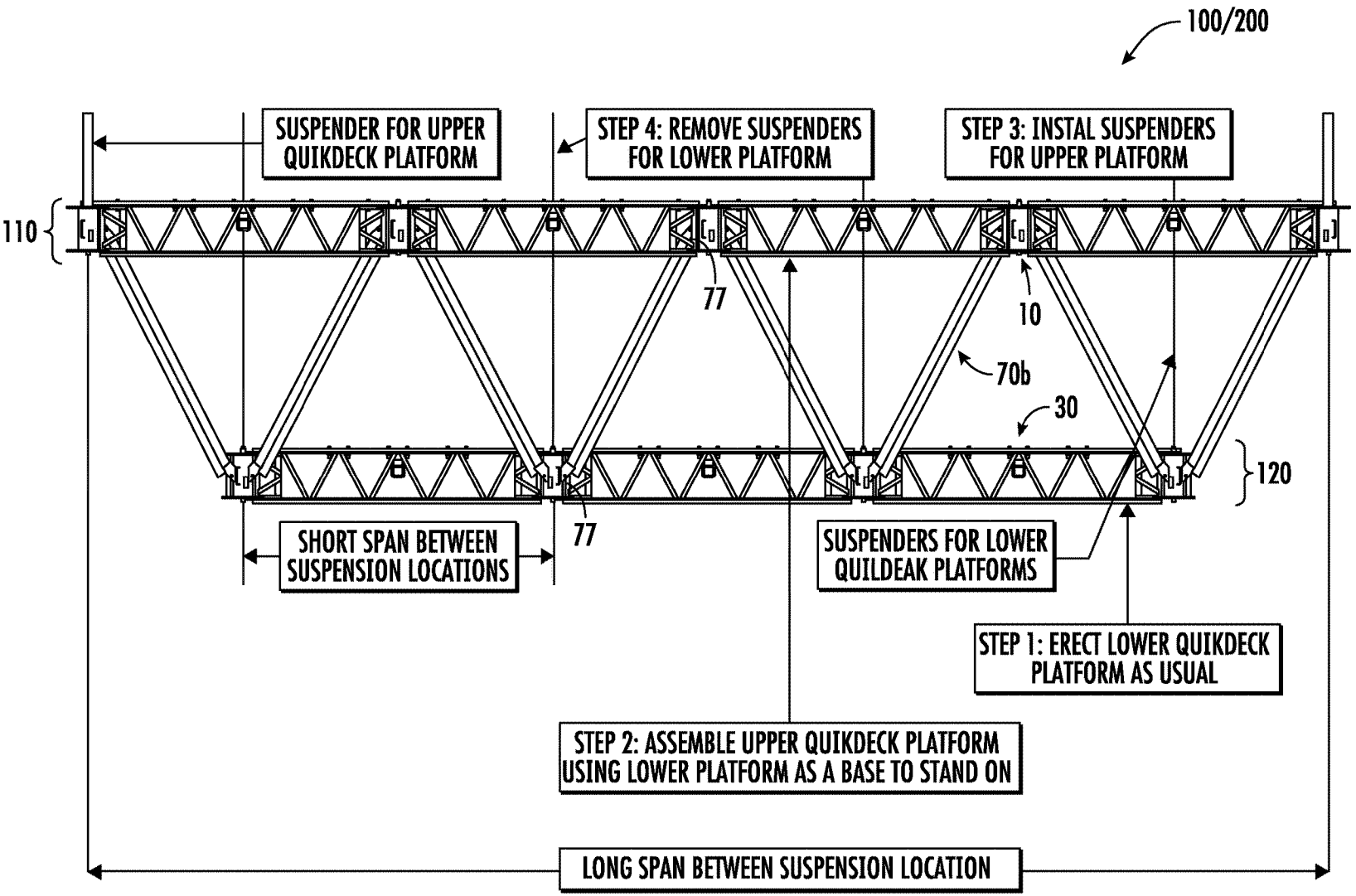
FIG. 32D is a schematic detailing an exemplary assembly method for a modular space frame support system and work platform system in accordance with embodiments of the present disclosure.
Figure 32E:
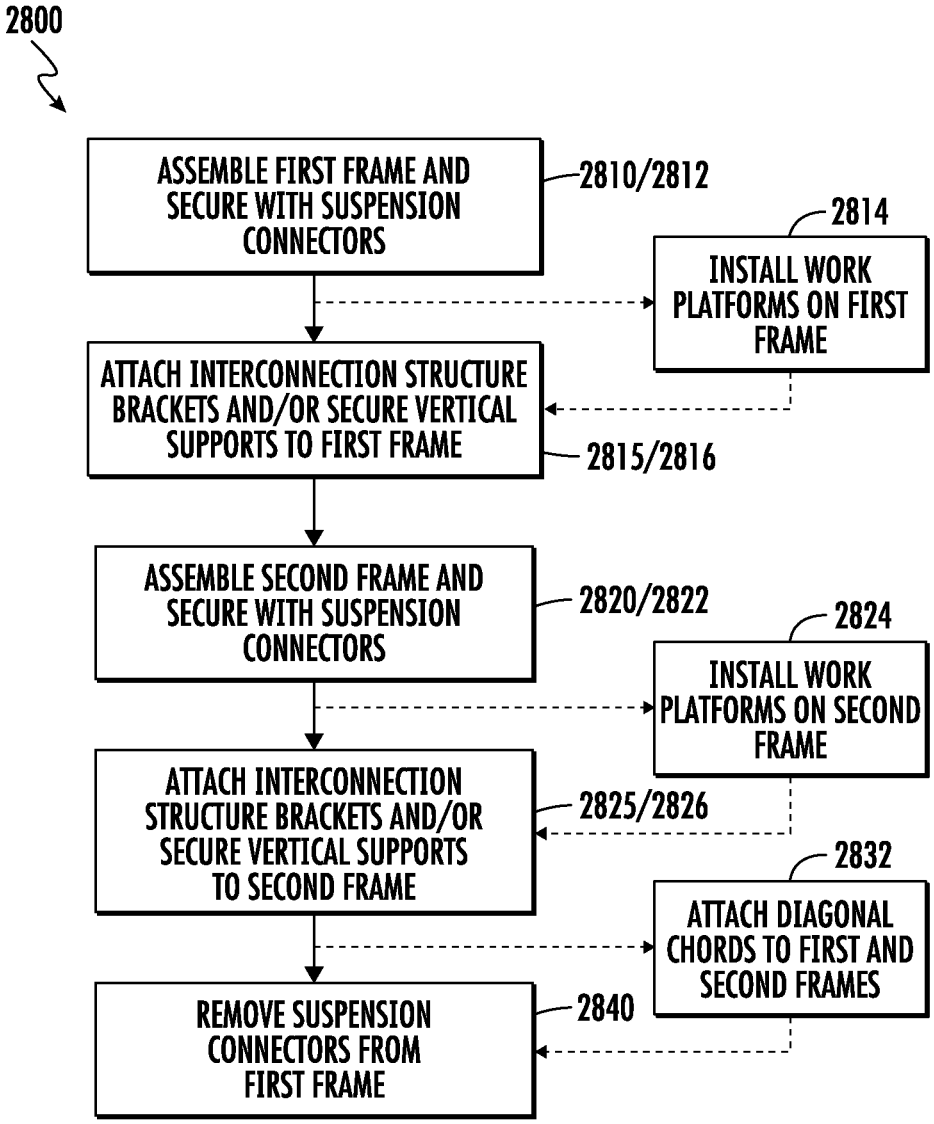
FIG. 32E is a flow chart of an exemplary assembly method for a modular space frame support system consistent with the schematic of FIG. 32D, in accordance with embodiments of the present disclosure.

In the embodiment shown in FIG. 32D, the interconnection structures 10 of the upper frame 110 and lower frame 120 are offset from one another; however, as described in further detail above, one of skill in the art will appreciate that the interconnection structures 10 of the upper frame 110 and lower frame 120 may have different spacing, e.g., the interconnection structures 10 of the upper frame 110 can be aligned directly above the interconnection structures 10 of the lower frame 120, or the interconnection structures 10 of the lower frame 120 can be aligned directly under a joist 30 of the upper frame 110.

In an embodiment, if needed, one or more suspension connectors can be used to secure the lower frame 120 to a structure, such as an overhead structure like a bridge, prior to the upper frame 110 being assembled. Similarly, one or more suspension connectors can be sued to secure the upper frame 110, once assembled, to the structure. Once the upper frame 110 is built and secured to a structure using one or more suspension connectors, if desired, the suspension connectors from the lower frame 120 can be removed. Similarly, when a modular space frame support system has a lower frame composed of interconnection structures 10 and chords 70/70*a* rather than joists 30, the upper frame may be likewise secured to a structure using one or more suspension connectors.

Figure 33:
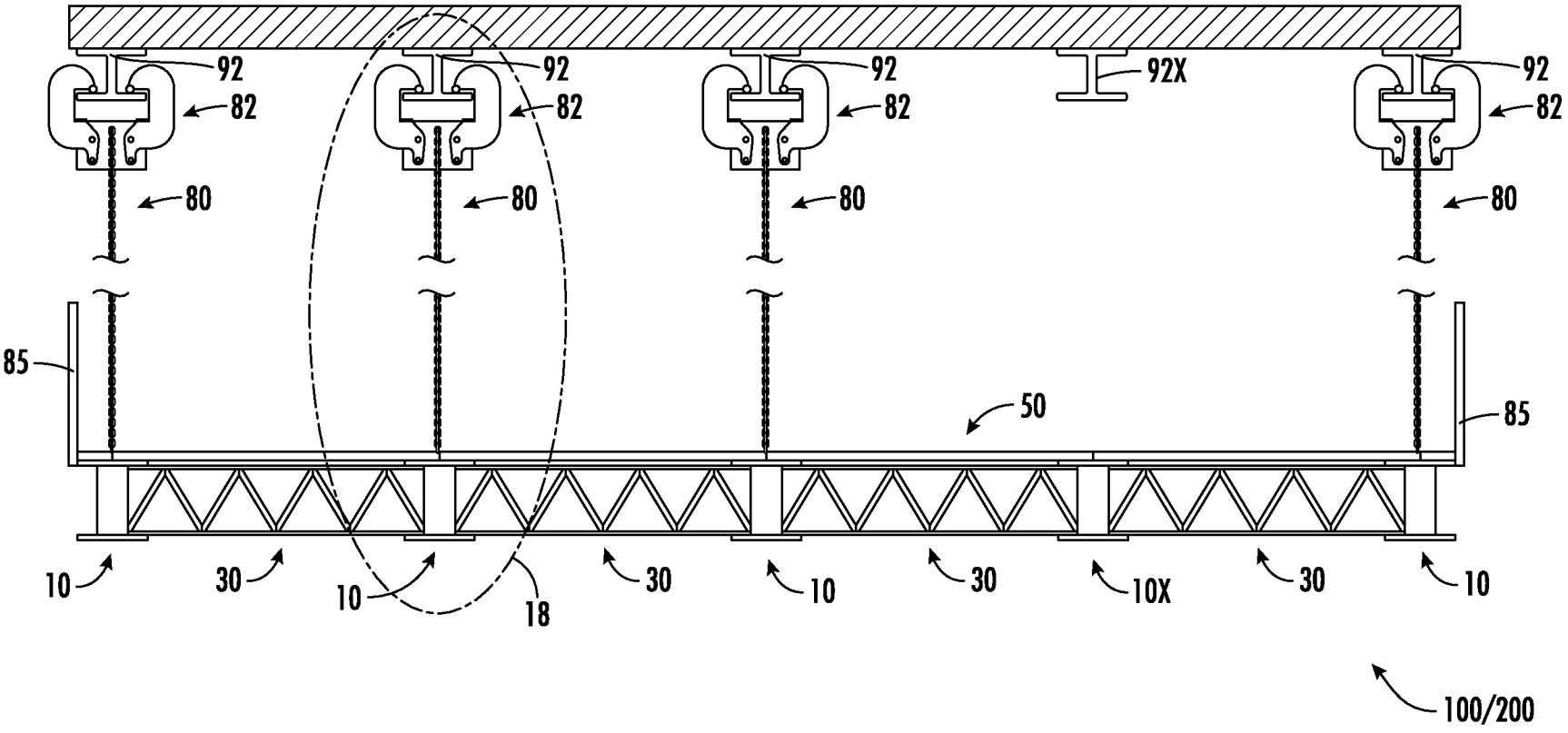
FIG. 33 is a sectional elevation view of a single level of a modular space frame support system configured as a work platform system attached to a structure, in accordance with the present disclosure.
Figure 34A:
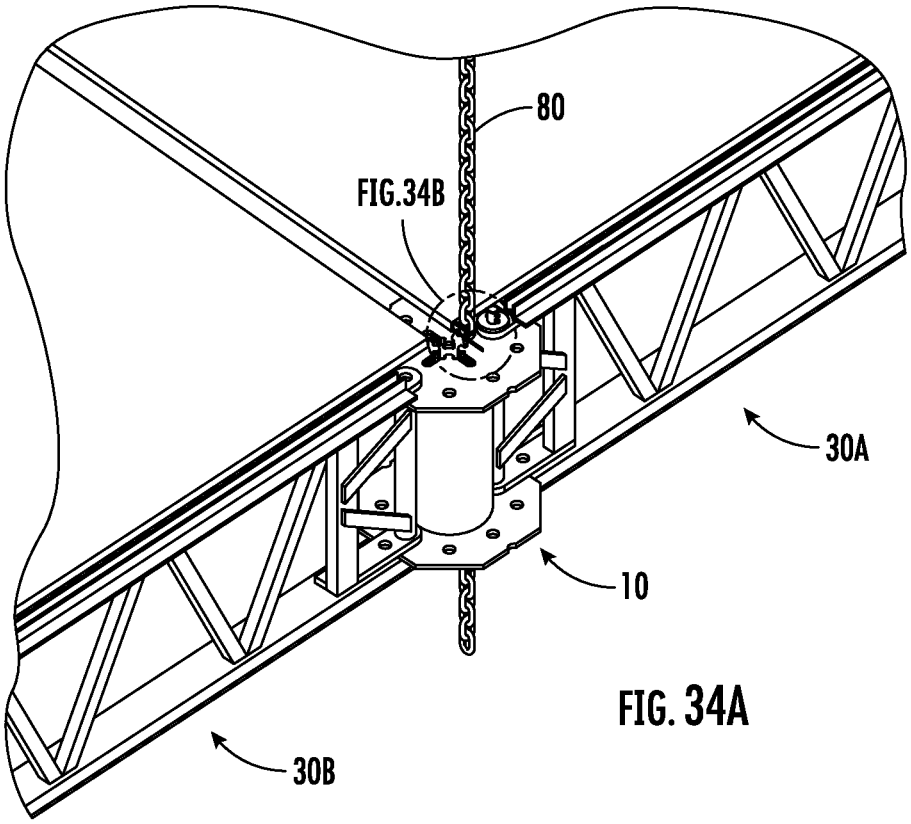
FIG. 34A is a top perspective view of an interface between an interconnection structure and a suspension connector, in accordance with the present disclosure.
Figure 34B:
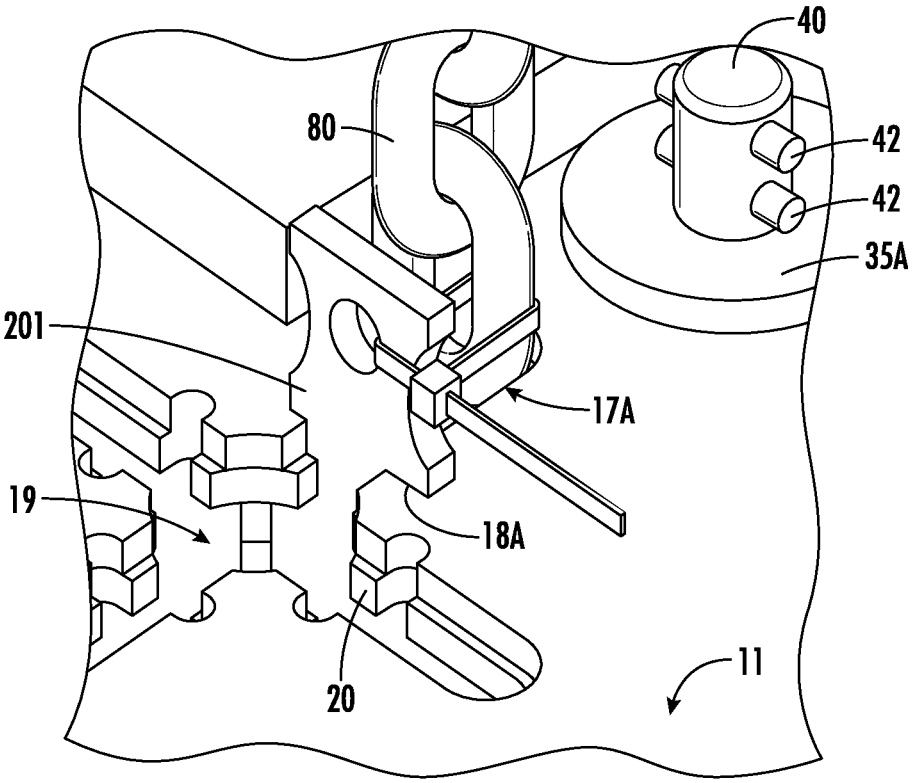
FIG. 34B is a close-up the interface shown in FIG. 34A, in accordance with the present disclosure.
Figure 35A:
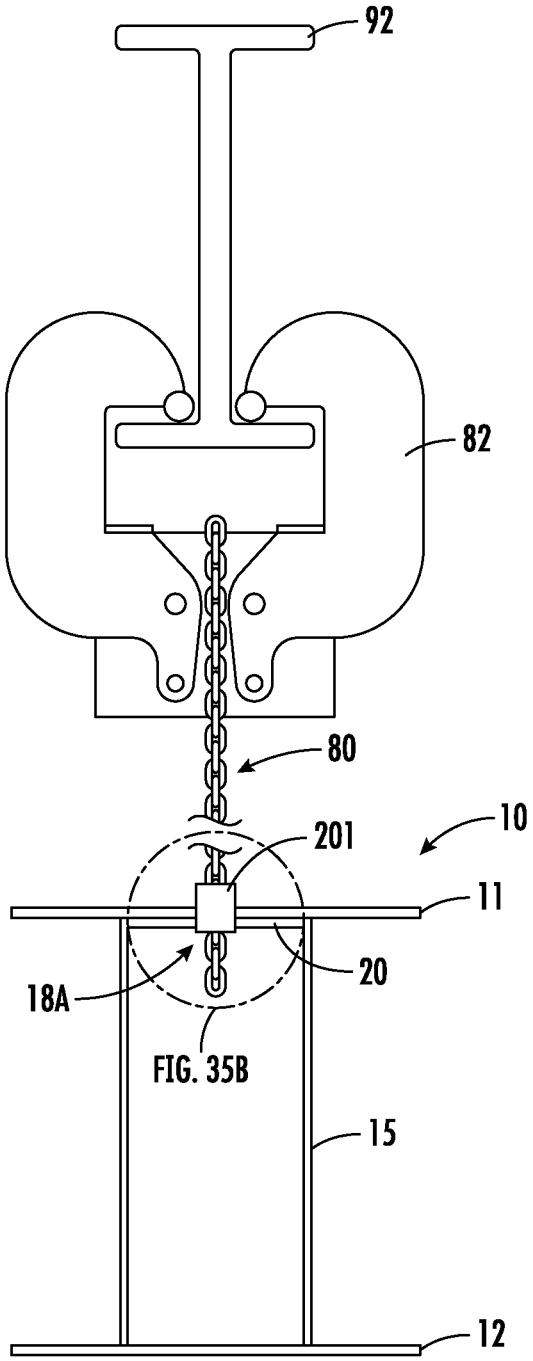
FIG. 35A is a sectional elevation view of an interconnection structure, suspension connector, and structure attachment device, in accordance with the present disclosure.
Figure 35B:
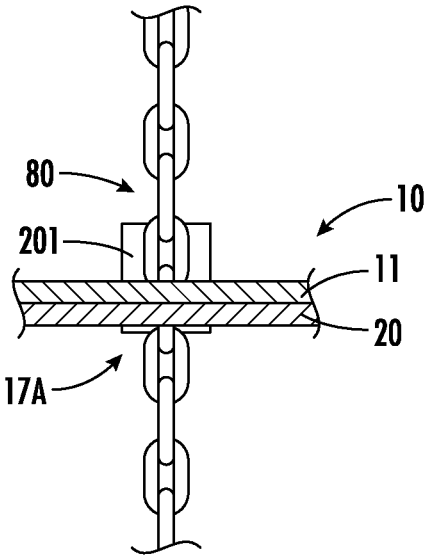
FIG. 35B is a close-up sectional elevation view the interconnection between the interconnection structure and suspension connector, in accordance with the present disclosure.
Figure 36A:
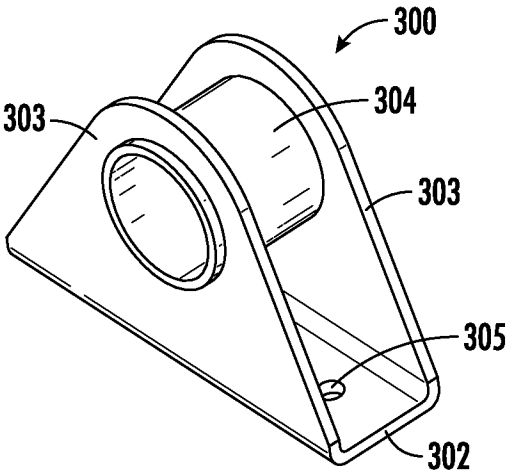
FIG. 36A is a top, perspective view of an auxiliary suspender mounting bracket, in accordance with the present disclosure.
Figure 36C:
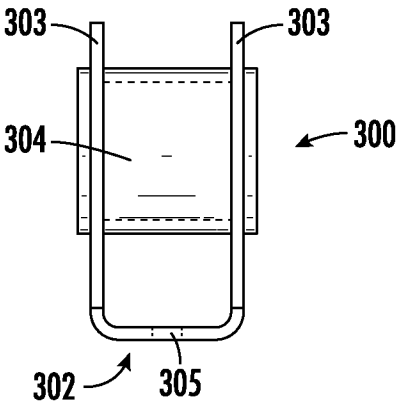
FIG. 36C is a front elevation view of an auxiliary suspender mounting bracket, in accordance with the present disclosure.
Figure 36B:
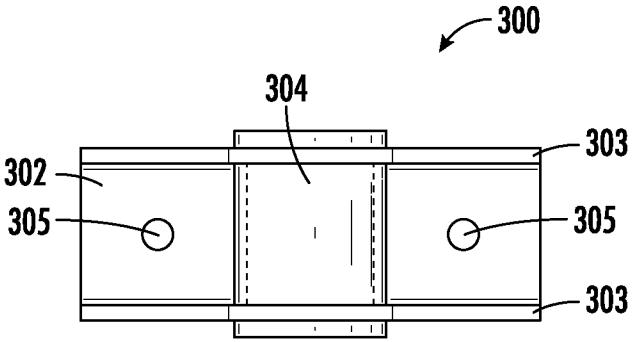
FIG. 36B is a plan view of an auxiliary suspender mounting bracket, in accordance with the present disclosure.
Figure 36D:
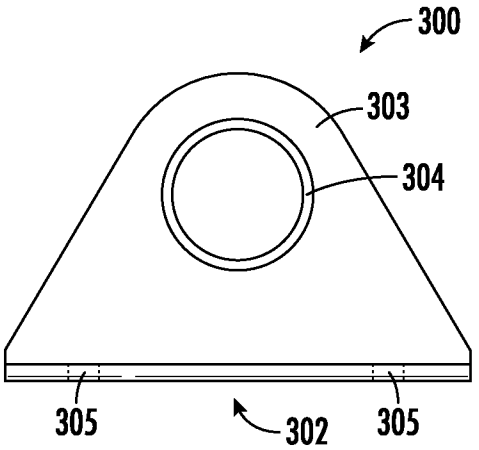
FIG. 36D is a side elevation view of an auxiliary suspender mounting bracket, in accordance with the present disclosure.

FIG. 33 shows an exemplary upper frame 110 or lower frame 120, depending, secured to a structure 90 using suspension connectors 80. The structure 90 in this embodiment is a bridge 90. On the underside of the bridge 90 are a plurality of beams 92. A series of suspension connectors 80, in this embodiment high strength chains, are attached to several of the beams 92 via structure attachment device 82, in this embodiment standard beam clamps. At the perimeter of the upper frame 110 or lower frame 120 (depending) are a plurality of railing standards 85, thereby creating a railing system around the upper frame 110 or lower frame 120. The plurality of chains 80 are attached to various interconnection structures 10 thereby providing structural connection to the bridge 90. In this manner, a modular space frame support system can be fully suspended from a suitable structure 90. Note that each interconnection structure 10 does not necessarily require a suspension connector 80 to be connected to the structure 90. For example, there is no suspension connector 80 connecting interconnection structure 10X to beam 92X. This may be because interconnection structure 10A does not line up underneath beam 92X, or other suitable suspension point, and thus, using a chain 80 in that location is either not possible, or not desirable.

The suspension connector 80 may be any suitable support mechanism that can support the modular space frame support system 100, resulting work platform system 200, and all its ancillary dead loads, plus any intended live load that is placed upon the work platform system 200. The suspension connector 80 may be a high-strength chain, cable, or the like. For example, one suitable suspension connector 80 is ⅜", grade 100, heat-treated alloy chain. The suspension connector 80 is attached to a beam clamp 82 which is further attached to a plurality of elements 92 on the underside of a structure 90. The structure 90 may be a bridge, viaduct, ceiling structure of a building, or the like. Similarly, the elements 92 which the suspension connector 80 are attached to may be beams, joists, or any other suitable structural element of the structure 90. Instead of beam clamps 82, other suitable structure attachment devices 82 may be used.

FIGS. 34A, 34B, 35A, 35B all depict various views of the interconnection between the suspension connector 80 (e.g., chain, cable, etc.) and the interconnection structure 10. In the embodiment shown, a free end of the chain 80 (i.e., end distal to structure 90) is placed through the center opening area 19 of the top element 11 of the interconnection structure 10. The chain 80 is then slid over and in to one of the four slots 17 (e.g., 17A). Once the chain 80 is place within slot 17A, a chain retainer pin 201 is placed in the adjacent transverse slot 18A so that the chain 80 kept retained in the distal end of slot 17A. The chain 80 and slot 17A are sized and configured so that upon proper placement of the keeper pin 201 with in the transverse slot 18A, the chain 80 is effectively locked to the interconnection structure 10 and is unable to slip, vertically or horizontally, from its position in 17A. This locking system effectively fixes the interconnection structure 10 to the chain 80.

An alternative device for connecting a suspension connector 80 to an upper frame 110 or lower frame 120 of a modular space frame support system 100 is a an auxiliary suspender mounting bracket 300. The auxiliary mounting bracket 300 is typically used when a particular interconnection structure 10 cannot be accessed for connection with a suspension connector 80. As the various FIGS. 36A, 36B, 36C, and 36D depict, one embodiment of the auxiliary suspender mounting bracket 300 includes two opposing and parallel flanges 303. Spanning the flanges 303 is an interconnecting tube 304 and a base plate 302. Through the base plate 302 are a plurality of mounting holes 305. The auxiliary suspender mounting bracket 300 can be used in lieu of, or in addition to, the interconnection structure 10 for a suspension point. The bracket 300 allows a suspension connector 80 to be connected to the modular space frame support system 100 at locations other than an interconnection structure 10.

Figure 37:
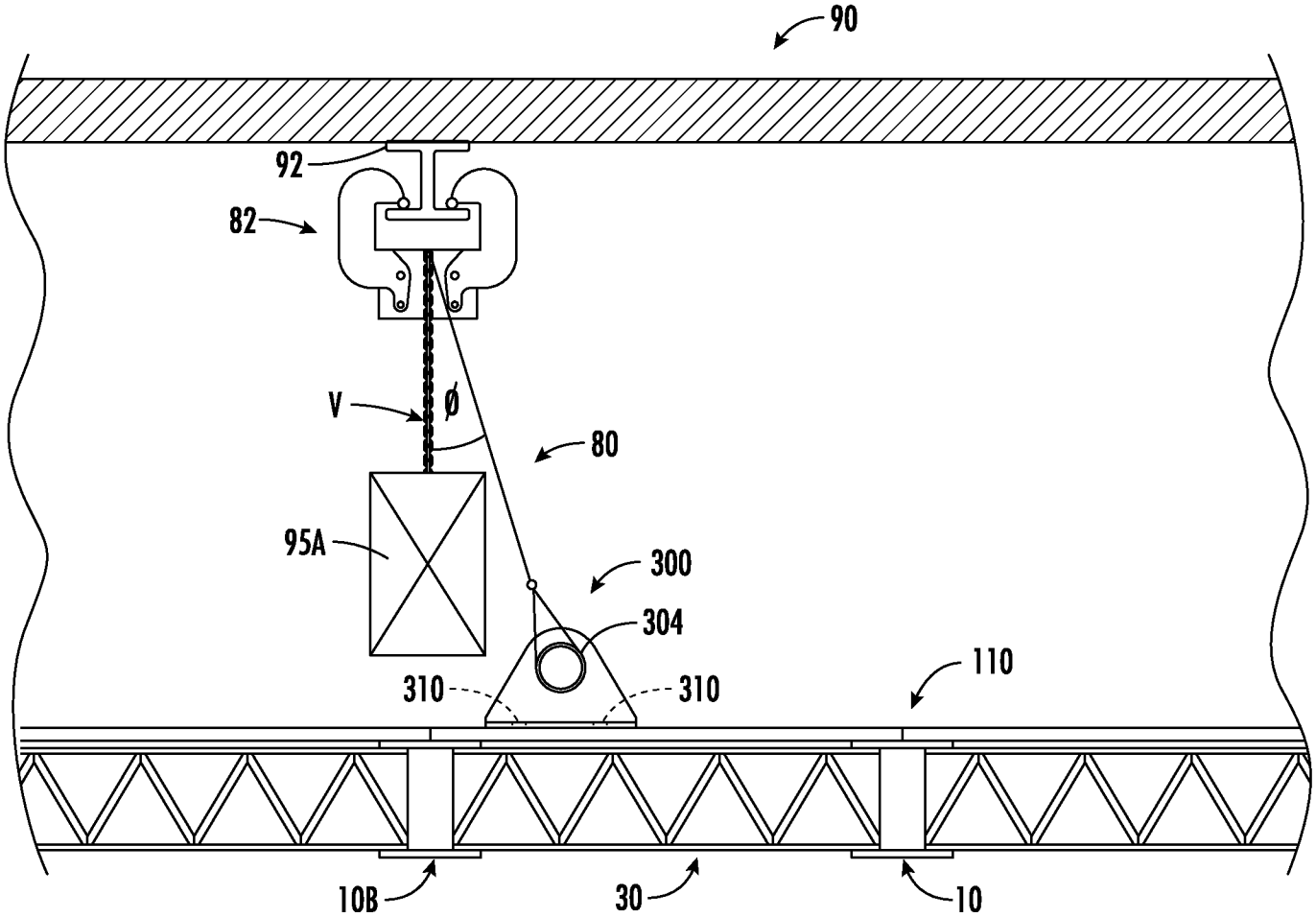
FIG. 37 is an elevation sectional view showing suspension of a work platform system from a structure via an auxiliary suspender mounting bracket, in accordance with the present disclosure.

For example, FIG. 37 depicts a scenario that may be encountered when building a modular space frame support system. Note that FIG. 37 is not drawn to scale. One or more obstructions 95A may be located on the underside of the structure 90, or between the structure 90 and the modular space frame support system 100. These obstruction(s) 95A may be man-made, or natural. For example, the obstructions 95A may be concrete beams, box-beams, inadequately sized framework, ductwork, lighting, finished surfaces, and the like. The obstructions 95A are such that a particular interconnection structure 10B is not practical, or possible, as a connecting point for the modular space frame support system 100 to a suspension connector 80. In this case, one or more auxiliary suspender mounting brackets 300 may be attached to a joist 30. High strength bolts (not shown) may be passed through the mounting holes 305 and then through holes on an upper element 32 and connected to bolts below the upper element 32. The suspension connector 80 (e.g., chain) may be connected, via a beam clamp 82, to a beam 92 that is on the underside of the structure 90.

As shown in FIG. 37, obstruction 95B is directly vertically over interconnection structure 10B, thereby rendering interconnection structure 10B inadequate for a suspension point. Thus, a bracket 300 can be attached to a joist 30 adjacent to interconnection structure 10B, thereby allowing a suspension connector 80 to get proper attachment to a nearby beam 92. The angle, Φ, between the suspension connector 80 and vertical, denoted by V, allows for the suspension connector 80 to be either non-vertical, or slightly off of vertical.

In an embodiment, one or more diagonal chords and/or vertical supports is used to secure the upper frame 110 and lower frame 120 to one another and provide additional structural support. Referring again to FIGS. 32D and 32E, after the lower and upper (first and second) frames are assembled, interconnection structures brackets can be attached to the interconnection structures of the upper (second) frame (2826) and/or the vertical supports (if used) attached to the interconnection structures of the upper (second) frame (2825).

In an embodiment when one or more diagonal chords are used, an interconnection structure bracket is secured to an interconnection structure on the upper frame 110 and an adjacent interconnection structure on the lower frame 120. In an embodiment, the diagonal chord is then connected at a first end to one of the interconnection structure brackets and at a second end to the other of the interconnection structure brackets. In another embodiment, the at least a portion of a chord is held in place and the length of the chord is increased while in position before the chord is fully secured at both its ends. In some embodiments, the positioning at least a portion of a chord comprises positioning the whole chord. In further embodiments, such as shown in FIG. 21C, the positioning at least a portion of a chord comprises positioning at least a first chord section.

In a particular embodiment, the method of securing a diagonal chord includes securing a chord subassembly comprising a first chord section and a connecting section to a first component of one of the upper frame and lower frame, such as a first interconnection structure, securing a second chord section to second component of the other of the upper frame and lower frame, such as a second interconnection structure, and extending the length of the chord subassembly to connect with the second chord section.

In an embodiment when one or more vertical supports is used, the vertical supports can be secured to corresponding interconnection structures after both the upper frame 110 and lower frame 120 are assembled. In other embodiments in which one or more vertical supports are used, it may be helpful to have the lower frame 120 assembled first. The first ends of the one or more vertical supports can then be secured in place in interconnection structures 10 of the lower frame 120 and the second ends of the one or more vertical supports can be secured to the corresponding interconnection structures of the upper frame 110 as the upper frame 110 is assembled.

One or more work platforms can be installed on the upper frame 110 (2824) to form a work platform system 200 from a modular space frame support system 100.

Once the upper and lower frames are fully assembled, the suspension connectors of the first (lower) frame can be removed (2840).

It should be appreciated that the modular space frame support system (and resulting work platform system) described herein are only intended as examples and the present disclosure is intended to encompass numerous variations of the above-described modular space frame support system and work platform system, components thereof, and/or methods of assembly. For example, while the modular space frame support system and work platform system described herein include two levels 110, 120, in other embodiments, there can be other numbers of levels.

The particular shapes of the different structures of a given modular space frame support system and work platform system can also vary depending on the use of the modular space frame support system and, if used as a work platform system, the size, shape and location of a structure being accessed using the work platform system. For example, depending on the embodiment, the various levels of the modular space frame support system and work platform system can take on any of a variety of rectangular, triangular, or other polygonal shapes (further for example, the octagonal, hexagonal, etc.) or even possibly shapes other than polygonal shapes, and further, the individual units or sections of a modular space frame support system and, ultimately, work platform system likewise can take on any variety of rectangular, triangular, or other polygonal shapes.

The materials out of which the modular space frame support system and work platform system can be formed can vary depending on the embodiment. For example, suitable materials for components of such modular space frame support systems and work platform systems include, but are not limited to, metal (e.g., steel, aluminum, etc.), wood, plastic, composite, or other suitable material. Also, such components can be made of items that are solid, corrugated, grated, smooth, or of other suitable configurations. For example, work platforms 50 of such work platform systems can be made of wood sheeting, plywood, roof decking material, metal on a frame, grating, steel sheeting, and the like, among other things. Also, it should be appreciated that a variety of types of linkages can be employed in supporting the levels of the modular space frame support system and work platform system relative to the other levels and/or relative to another support structure.

As referenced above, in at least some embodiments, a multi-level modular space frame support system and multi-level work platform system are advantageous in that, because the frame units are formed from multiple discrete components such as the interconnection structures, joists, chords and associated work platforms, worker(s) can modify or add to existing portions of the modular space frame support system and work platform system while physically supported upon an existing, installed section or unit of a modular space frame support system or work platform system. In at least some embodiments, worker(s) in such circumstance can extend, relocate, or remove components of the modular space frame support system and work platform system using only hand tools, and no mechanical tools, hoists, cranes, or other equipment is required to add to, or subtract from, existing units of the modular space frame support system or work platform system. In at least some embodiments, installation of a modular space frame support system and work platform system can be done, essentially, "in the air." That is, the modular space frame support system and work platform system can be erected and connected "in the air" in a piece-by-piece order via the use of multiple pieces of lifting, or hoisting, equipment. That said, in alternate embodiments, it is possible also that one or more of the interconnection structures, joists, chords, and/or other components will be preassembled on the ground, or at a remote location, and then moved and hoisted as a pre-assembled module into the desired location.

Although not discussed above, in other embodiments, other types of components can also be included in a modular space frame support system and work platform system. For example, in some embodiments, tarps or sheeting or the like can be attached to railings or an upper or lower frame to enclose an area for various purposes.

Similarly, while the modular space frame support system and resulting work platform system can incorporate additional structural assemblies, such as, for example, supported scaffolding and other similar structures. Moreover, in some embodiments, additional frameworks or work platforms may be suspended from a level of a modular space frame support system.

Therefore, although certain embodiments of the present disclosure have been shown and described in detail above, it should be understood that numerous changes and modifications can be made without departing from the scope of the appended claims. Among other things, it should be appreciated that the scope of the present disclosure is not limited to the number of constituting components, the materials thereof, the shapes thereof, the relative arrangement thereof, etc., as described above, but rather the above disclosures are simply provided as example embodiments.

The modular space frame support system and resulting work platform system are now described with reference to the following non-limiting embodiments.

E1: A method of assembling a work platform system comprises:

assembling a first frame comprising a plurality of interconnection structures and a plurality of joists;

at least one of (i) providing at plurality of interconnection structure brackets and attaching at least one interconnection structure bracket to at least two of the plurality of interconnection structures of the first frame and (ii) providing a plurality of vertical supports and connecting a first end of the vertical support a corresponding interconnection structure of the plurality of interconnection structures of the first frame;

assembling a second frame comprising a plurality of interconnection structures and at least one of (i) a plurality of joists and (ii) a plurality of chords; and at least one of (i) providing at plurality of interconnection structure brackets and attaching at least one interconnection structure bracket to at least two of the plurality of interconnection structures of the second frame and (ii) securing a second end of the vertical supports of the plurality of vertical supports to a corresponding interconnection structure of the plurality of interconnection structures of the second frame.

E2: The method of E1, wherein the assembling a first frame comprises providing a first interconnection structure, second interconnection structure and first joist, wherein the first joist is connected to and in operable association with the first and second interconnection structures, providing a second joist, a third joist, a third interconnection structure and a fourth interconnection structure, connecting the second joist to the first interconnection structure and the third interconnection structure, connecting the third joist to the second interconnection structure and the fourth interconnection structure, providing a fourth joist, connecting the fourth joist to the third and fourth interconnection structures, and articulating the second joist, third joist, fourth joist, third interconnection structure and fourth interconnection structure with respect to the first joist, first interconnection structure and second interconnection structure from a collapsed position to an extended position.

E3: The method of E1 or E2, wherein the assembling a second frame comprises providing a second frame comprising at least four interconnection structures and at least one of (i) four chords and (ii) four joists.

E4. The method of E2, wherein the assembling a second frame comprises providing a fifth interconnection structure, sixth interconnection structure and fifth joist, wherein the fifth joist is connected to and in operable association with the fifth and sixth interconnection structures, providing a sixth joist, a seventh joist, a seventh interconnection structure and a eighth interconnection structure, connecting the sixth joist to the first interconnection structure and the seventh interconnection structure, connecting the seventh joist to the sixth interconnection structure and the eighth interconnection structure, providing an eighth joist, connecting the eighth joist to the seventh and eighth interconnection structures, and articulating the sixth joist, seventh joist, eighth joist, seventh interconnection structure and eighth interconnection structure with respect to the fifth joist, fifth interconnection structure and sixth interconnection structure from a collapsed position to an extended position.

E5: A modular space frame support system comprising:

an upper frame comprising at least four interconnection structures and at least four joists arranged such that:

a first interconnection structure connected in fixed relation to a second interconnection structure using a first joist;

a second joist connectable to the first interconnection structure, wherein, when connected, the second joist is pivotable relative to the first joist from a collapsed position to an extended or final position;

a third joist connectable to the second interconnection structure, wherein, when connected, the third joist is pivotable relative to the first joist from a collapsed position to an extended or final position;

a third interconnection structure connected to the second joist;

a fourth interconnection structure connected to the third joist; and a fourth joist connected to the third and fourth interconnection structures, wherein the third and fourth interconnection structures are connected in fixed relation to one another using the fourth joist;

a lower frame comprising at least four interconnection structures and at least one of (i) four joists and (ii) four chords arranged such that:

a fifth interconnection structure connected in fixed relation to a sixth interconnection structure using a fifth joist or chord;

a sixth joist or chord connectable to the fifth interconnection structure;

a seventh joist or chord connectable to the sixth interconnection structure;

a seventh interconnection structure connected to the sixth joist or chord;

an eighth interconnection structure connected to the seventh joist or chord; and an eighth joist or chord connected to the seventh and eighth interconnection structures;

at least one of a diagonal chord or a vertical support connected at a first end to one of the first, second, third or fourth interconnection structures of the upper frame and at a second end to one of the fifth, sixth, seventh or eighth interconnection structures of the lower frame.

E6: The modular space frame support system of E5, wherein at least one interconnection structure of the upper frame is disposed directly above an interconnection structure of the lower frame.

E7: The modular space frame support system of E6, wherein each of the interconnection structures of the upper frame is disposed directly above a corresponding interconnection structure of the lower frame.

E8: The modular space frame support system of E7 comprising at least one vertical support.

E9: The modular space frame support system of any of E5-E8 comprising at least one diagonal chord.

E10: The modular space frame support system of E5, wherein each of the interconnection structures of the upper frame is offset from the interconnection structures of the lower frame.

E11: The modular space frame support system of E10 comprising at least one diagonal chord.

E12. A method of assembling a modular space frame support system comprising:

providing a first frame comprising at least four interconnection structures and at least four joists, wherein the providing a first frame comprises providing a first interconnection structure, second interconnection structure and first joist, wherein the first joist is connected to and in operable association with the first and second interconnection structures, providing a second joist, a third joist, a third interconnection structure and a fourth interconnection structure, connecting the second joist to the first interconnection structure and the third interconnection structure, connecting the third joist to the second interconnection structure and the fourth interconnection structure, providing a fourth joist, connecting the fourth joist to the third and fourth interconnection structures, and articulating the second joist, third joist, fourth joist, third interconnection structure and fourth interconnection structure with respect to the first joist, first interconnection structure and second interconnection structure from a collapsed position to an extended position, providing a second frame comprising at least four interconnection structures and at least one of (i) four chords and (ii) four joists;

providing at least one of a diagonal chord and a vertical support; and connecting the at least one of the diagonal chord and vertical support to at least one interconnection structure of the first frame and at least one interconnection structure of the second frame.

E13: The method of E12 wherein the first frame is an upper frame and the second frame is a lower frame.

E14: The method of E12 wherein the first frame is a lower frame and the second frame is an upper frame.

E15: The method of E14, wherein the step of providing a second frame comprises:

providing a fifth interconnection structure, sixth interconnection structure and fifth joist, wherein the fifth joist is connected to and in operable association with the fifth and sixth interconnection structures, providing a sixth joist, a seventh joist, a seventh interconnection structure and a eighth interconnection structure, connecting the sixth joist to the fifth interconnection structure and the seventh interconnection structure, connecting the seventh joist to the sixth interconnection structure and the eighth interconnection structure, providing an eighth joist, connecting the eighth joist to the seventh and eighth interconnection structures, and articulating the sixth joist, seventh joist, eighth joist, seventh interconnection structure and eighth interconnection structure with respect to the fifth joist, fifth interconnection structure and sixth interconnection structure from a collapsed position to an extended position.

E16: A modular space frame support system comprising:

an upper frame comprising a plurality of joists interconnected with a plurality of interconnection structures;

a lower frame comprising a plurality of joists or chords interconnected with a plurality of interconnection structures;

at least two interconnection structure brackets, wherein a first of the at least two interconnection structure brackets is connected to one of the plurality of interconnection structures of the upper frame and a second of the at least two interconnection structure brackets is connected to one of the plurality of interconnection structures of the lower frame, each interconnection structure bracket comprising a hollow tubular section, and at least one chord-engaging structure; and at least one chord secured at a first end to the first of the at least two interconnection structure brackets and at a second end to the second of the at least two interconnection structure brackets.

E17: The modular space frame support system of E16, wherein the at least one chord-engaging structure comprises two plates, wherein each plate contains an opening therethrough.

E18: The modular space frame support system of E17, wherein each of the two plates is triangular.

E19: The modular space frame support system of any of E17-E18, wherein the two plates are non-symmetrical.

E20: The modular space frame support system of any of E16-E19, wherein the first end of the chord and the second end of the chord each include two plates, each of the two plates containing an opening therethrough.

E21: The modular space frame support system of any of E17-E19, wherein the first end of the chord and the second end of the chord each include two plates, each of the two plates containing an opening therethrough, and the distance between the two plates on the first and second ends of the chord is greater than the distance between the two plates of the interconnection structure bracket.

E22. A method of assembling a work platform system comprising:

assembling a first frame comprising a plurality of interconnection structures and a plurality of joists;

securing the first frame with one or more suspension connectors;

at least one of (i) providing at plurality of interconnection structure brackets and attaching at least one interconnection structure bracket to at least two of the plurality of interconnection structures of the first frame and (ii) providing a plurality of vertical supports and connecting a first end of the vertical support a corresponding interconnection structure of the plurality of interconnection structures of the first frame;

assembling a second frame comprising a plurality of interconnection structures and at least one of (i) a plurality of joists and (ii) a plurality of chords;

securing the second frame with one or more suspension connectors;

at least one of (i) providing at plurality of interconnection structure brackets and attaching at least one interconnection structure bracket to at least two of the plurality of interconnection structures of the second frame and (ii) securing a second end of the vertical supports of the plurality of vertical supports to a corresponding interconnection structure of the plurality of interconnection structures of the second frame; and removing the one or more suspension connectors securing the first frame.

E23: The method of E22, comprising both of (i) providing at plurality of interconnection structure brackets and attaching at least one interconnection structure bracket to at least two of the plurality of interconnection structures of the first frame and (ii) providing a plurality of vertical supports and connecting a first end of the vertical support a corresponding interconnection structure of the plurality of interconnection structures of the first frame, and both of (i) providing at plurality of interconnection structure brackets and attaching at least one interconnection structure bracket to at least two of the plurality of interconnection structures of the second frame and (ii) securing a second end of the vertical supports of the plurality of vertical supports to a corresponding interconnection structure of the plurality of interconnection structures of the second frame.

E24: The method of E23 further comprising providing a plurality of diagonal chords, attaching a first end of the diagonal chords to a corresponding interconnection structure bracket of the first frame, and attaching a second end of the diagonal chords to a corresponding interconnection structure bracket of the second frame.

E25: A modular space frame support system and shown and described herein.

E26: A work platform system as shown and described herein.

E27: An interconnection structure bracket as shown and described herein.

E28: A connection between an upper frame and a lower frame of a modular space frame support system as shown and described herein.

E29: A method of assembling a modular space frame support system as shown and described herein.

E30: A method of assembling a work platform system as shown and described herein.

E31: A method of connecting an upper frame of modular space frame support system and a lower frame of a modular space frame support system as shown and described herein.

E32: A method of assembling a modular space frame support system from an existing work platform system as shown and described herein.

Thus, it is specifically intended that the present disclosure not be limited to the embodiments and illustrations contained herein, but include modified forms of those embodiments including portions of the embodiments and combinations of elements of different embodiments as come within the scope of the following claims.

The invention claimed is:

1. A method of assembling a work platform system comprising:

assembling a first frame comprising a plurality of interconnection structures and a plurality of joists;

at least one of (i) providing a plurality of interconnection structure brackets and attaching at least one interconnection structure bracket to at least two of the plurality of interconnection structures of the first frame and (ii) providing a plurality of vertical supports and connecting a first end of the vertical support to a corresponding interconnection structure of the plurality of interconnection structures of the first frame;

assembling a second frame comprising a plurality of interconnection structures and at least one of (i) a plurality of joists and (ii) a plurality of chords;

at least one of (i) providing a plurality of interconnection structure brackets and attaching at least one interconnection structure bracket to at least two of the plurality of interconnection structures of the second frame and (ii) securing a second end of the vertical supports of the plurality of vertical supports to a corresponding interconnection structure of the plurality of interconnection structures of the second frame; and connecting at least one chord to at least one of the interconnection structure brackets attached to at least one of the plurality of interconnection structures of the first frame and to at least one of the interconnection structure brackets attached to at least one of the plurality of interconnection structures of the second frame.

2. The method of claim 1, wherein the assembling a first frame comprises:

providing a first interconnection structure, second interconnection structure and first joist, wherein the first joist is connected to and in operable association with the first and second interconnection structures, providing a second joist, a third joist, a third interconnection structure and a fourth interconnection structure, connecting the second joist to the first interconnection structure and the third interconnection structure, connecting the third joist to the second interconnection structure and the fourth interconnection structure, providing a fourth joist, connecting the fourth joist to the third and fourth interconnection structures; and articulating the second joist, third joist, fourth joist, third interconnection structure and fourth interconnection structure with respect to the first joist, first interconnection structure and second interconnection structure from a collapsed position to an extended position.

3. The method of claim 2, wherein the assembling a second frame comprises:

providing a fifth interconnection structure, sixth interconnection structure and fifth joist, wherein the fifth joist is connected to and in operable association with the fifth and sixth interconnection structures, providing a sixth joist, a seventh joist, a seventh interconnection structure and an eighth interconnection structure, connecting the sixth joist to the fifth interconnection structure and the seventh interconnection structure, connecting the seventh joist to the sixth interconnection structure and the eighth interconnection structure, providing an eighth joist, connecting the eighth joist to the seventh and eighth interconnection structures, and articulating the sixth joist, seventh joist, eighth joist, seventh interconnection structure and eighth interconnection structure with respect to the fifth joist, fifth interconnection structure and sixth interconnection structure from a collapsed position to an extended position.

4. The method of claim 1, wherein the step of connecting the at least one chord comprises (i) providing a chord subassembly comprising a first chord section and a connecting section; (ii) securing the chord subassembly to one of the interconnection structure brackets of the first frame or the second frame; (iii) providing a second chord section; (iv) securing the second chord section to the other of the interconnection structure brackets of the first frame or the second frame; and (v) connecting the chord subassembly to the second chord section by extending the length of the chord subassembly.

5. The method of claim 4, wherein the at least one chord further includes a linear force-applying device operably connected to the first chord section and the second chord section.

6. The method of claim 5, wherein the step of connecting the chord subassembly to the second chord section by extending the length of the chord subassembly comprises actuating the linear force-applying device to extend the length of the chord subassembly.

7. The method of claim 5, wherein the linear force-applying device is a ratcheting turnbuckle.

8. A modular space frame support system comprising:

an upper frame comprising at least four interconnection structures and at least four joists arranged such that:

a first interconnection structure connected in fixed relation to a second interconnection structure using a first joist;

a second joist connectable to the first interconnection structure, wherein, when connected, the second joist is pivotable relative to the first joist from a collapsed position to an extended or final position;

a third joist connectable to the second interconnection structure, wherein, when connected, the third joist is pivotable relative to the first joist from a collapsed position to an extended or final position;

a third interconnection structure connected to the second joist;

a fourth interconnection structure connected to the third joist; and a fourth joist connected to the third and fourth interconnection structures, wherein the third and fourth interconnection structures are connected in fixed relation to one another using the fourth joist;

a lower frame comprising at least four interconnection structures and at least one of (i) four joists and (ii) four chords arranged such that:

a fifth interconnection structure connected in fixed relation to a sixth interconnection structure using a fifth joist or chord;

a sixth joist or chord connectable to the fifth interconnection structure;

a seventh joist or chord connectable to the sixth interconnection structure;

a seventh interconnection structure connected to the sixth joist or chord;

an eighth interconnection structure connected to the seventh joist or chord; and an eighth joist or chord connected to the seventh and eighth interconnection structures;

at least one of a diagonal chord or a vertical support connected at a first end to one of the first, second, third or fourth interconnection structures of the upper frame and at a second end to one of the fifth, sixth, seventh or eighth interconnection structures of the lower frame.

9. The modular space frame support system of claim 7, wherein at least one interconnection structure of the upper frame is disposed directly above an interconnection structure of the lower frame, and the system comprises at least one vertical support.

10. The modular space frame support system of claim 7, wherein each of the interconnection structures of the upper frame is offset from the interconnection structures of the lower frame.

11. The modular space frame support system of claim 9 comprising at least one diagonal chord.

12. The modular space frame support system of claim 11 in which at least one diagonal chord comprises two chord sections slidingly engaged in a connecting section.

13. The modular space frame support system of claim 8 further comprising:

at least two interconnection structure brackets, wherein a first of the at least two interconnection structure brackets is connected to one of the interconnection structures of the upper frame and a second of the at least two interconnection structure brackets is connected to one of the interconnection structures of the lower frame, each interconnection structure bracket comprising a hollow tubular section, and at least one chord-engaging structure; and at least one chord secured at a first end to the first of the at least two interconnection structure brackets and at a second end to the second of the at least two interconnection structure brackets.

14. The modular space frame support system of claim 13, wherein the at least one chord-engaging structure comprises two plates, wherein each plate contains an opening therethrough.

15. The modular space frame support system of claim 14, wherein each of the two plates is triangular.

16. The modular space frame support system of claim 14, wherein the two plates are non-symmetrical.

17. The method of claim 1 further comprising:

securing the first frame with one or more suspension connectors after the assembling of the first frame;

securing the second frame with one or more suspension connectors after the assembling of the second frame; and removing the one or more suspension connectors securing the first frame after the at least one of (i) providing a plurality of interconnection structure brackets and attaching at least one interconnection structure bracket to at least two of the plurality of interconnection structures of the second frame and (ii) securing a second end of the vertical supports of the plurality of vertical supports to a corresponding interconnection structure of the plurality of interconnection structures of the second frame.

18. The method of claim 17, comprising both of (i) providing a plurality of interconnection structure brackets and attaching at least one interconnection structure bracket to at least two of the plurality of interconnection structures of the first frame and (ii) providing a plurality of vertical supports and connecting a first end of the vertical support to a corresponding interconnection structure of the plurality of interconnection structures of the first frame, and both of (i) providing a plurality of interconnection structure brackets and attaching at least one interconnection structure bracket to at least two of the plurality of interconnection structures of the second frame and (ii) securing a second end of the vertical supports of the plurality of vertical supports to a corresponding interconnection structure of the plurality of interconnection structures of the second frame.

19. The method of claim 18 further comprising providing a plurality of diagonal chords, attaching a first end of the diagonal chords to a corresponding interconnection structure bracket of the first frame, and attaching a second end of the diagonal chords to a corresponding interconnection structure bracket of the second frame.

* * * * *